US009345643B2

(12) United States Patent
Okiyama

(10) Patent No.: US 9,345,643 B2
(45) Date of Patent: May 24, 2016

(54) MEDICAL CONNECTOR

(71) Applicant: JMS CO., LTD., Hiroshima-shi, Hiroshima (JP)

(72) Inventor: Tadashi Okiyama, Hiroshima (JP)

(73) Assignee: JMS Co., Ltd., Hiroshima (JP)

( * ) Notice: Subject to any disclaimer, the term of this patent is extended or adjusted under 35 U.S.C. 154(b) by 34 days.

(21) Appl. No.: 14/396,280

(22) PCT Filed: Apr. 26, 2013

(86) PCT No.: PCT/JP2013/062333
§ 371 (c)(1),
(2) Date: Oct. 22, 2014

(87) PCT Pub. No.: WO2013/161979
PCT Pub. Date: Oct. 31, 2013

(65) Prior Publication Data

US 2015/0083950 A1 Mar. 26, 2015

(30) Foreign Application Priority Data

Apr. 26, 2012 (JP) ..... 2012-101032

(51) Int. Cl.
*A61J 1/20* (2006.01)
*A61J 1/10* (2006.01)

(52) U.S. Cl.
CPC ..... *A61J 1/2096* (2013.01); *A61J 1/2062* (2015.05); *A61J 1/2082* (2015.05); *A61J 1/2089* (2013.01);
(Continued)

(58) Field of Classification Search
CPC ..... A61J 1/2096; A61J 1/2062; A61J 1/2082; A61J 1/2089
See application file for complete search history.

(56) References Cited

U.S. PATENT DOCUMENTS 4,397,335 A * 8/1983 Doblar ..... A61B 5/02152 137/625.19
4,534,758 A * 8/1985 Akers ..... A61M 5/1409 604/247
(Continued)

FOREIGN PATENT DOCUMENTS

| | | |
|---|---|---|
| JP | 2001-190689 | 7/2001 |
| WO | 2010/061742 | 6/2010 |
| WO | 2010/061743 | 6/2010 |

*Primary Examiner* — Craig Schneider
*Assistant Examiner* — Kevin Barss
(74) *Attorney, Agent, or Firm* — Hamre, Schumann, Mueller & Larson, P.C.

(57) ABSTRACT

A first male member (110) and a tubular portion (30) are in communication via first to third holes (21 to 23). A liquid channel (211) and a gas channel (212) of the second male member (210) are in communication with the tubular portion. First to third channels (41 to 43) are formed in a stopcock (40). The stopcock can switch between a first rotation position at which the first channel puts the first hole and a syringe connection portion (32) of the tubular portion in communication, and a second rotation position at which the first channel puts the liquid channel and the syringe connection portion in communication. When the stopcock is at the second rotation position, the second hole and the gas channel are in communication via the second channel, and the first male member and an inner cavity (45) of the stopcock are in communication via the third hole and the third channel. A first hydrophobic filter (50*a*) is provided in the channel that connects the first male member and the gas channel when the stopcock is at the second rotation position, and a second hydrophobic filter (50*b*) is provided in the channel that connects the first male member and the air supplying member (410) that is connected to the stopcock when the stopcock is at the second rotation position.

13 Claims, 45 Drawing Sheets

(52) U.S. Cl.
CPC ... *A61J 1/10* (2013.01); *A61J 1/201* (2015.05); *A61J 1/2013* (2015.05); *A61J 1/2051* (2015.05); *A61J 2001/201* (2013.01); *A61J 2001/2013* (2013.01); *A61J 2001/2051* (2013.01); *A61J 2001/2062* (2013.01)

(56) References Cited

U.S. PATENT DOCUMENTS 4,759,756 A * 7/1988 Forman ..... A61J 1/2089 604/413
4,972,876 A * 11/1990 Kabata ..... F16K 11/0856 137/625.16
5,466,220 A * 11/1995 Brenneman ..... A61J 1/2089 604/411
5,871,110 A * 2/1999 Grimard ..... A61J 1/2096 215/249
6,221,041 B1 * 4/2001 Russo ..... A61J 1/2089 604/82
8,506,548 B2 * 8/2013 Okiyama ..... A61J 1/2089 604/403
8,556,879 B2 * 10/2013 Okiyama ..... A61J 1/2089 604/403
2011/0175347 A1 7/2011 Okiyama
2011/0178493 A1 7/2011 Okiyama

* cited by examiner

MEDICAL CONNECTOR

TECHNICAL FIELD

The present invention relates to a medical connector that preferably can be used to connect two containers and transfer a drug solution obtained by dissolving a drug in one container to the other container.

BACKGROUND ART

A drug in a vial container is generally in powder form. When administering this drug to a patient, a solution is injected into the vial container to dissolve the drug and obtain a drug solution, and then the drug solution is transferred to a drug solution bag. The amount of drug solution transferred to the drug solution bag needs to be measured appropriately according to the patient's physique.

There are cases where the drug stored in the vial container is a drug designated as a dangerous drug, such as an anticancer drug. It is necessary to avoid a situation where a drug solution that contains such a dangerous drug leaks out and comes into contact with the operator's finger or the like, or the operator inhales vapor from the liquid. Accordingly, it is desired that the above series of tasks including dissolving the drug in the vial container and transferring the drug solution to a drug solution bag is performed using a "closed-system device" that has a low possibility of the drug solution leaking.

A medical connector 900 shown in FIG. 33 (see Patent Documents 1 and 2) is known as one example of such a device. The connector 900 includes a first connector 910, a second connector 920, and a tubular portion 930 therebetween. The first connector 910 includes a male luer 911 that is inserted into a port 970 of a drug solution bag (not shown). The second connector 920 includes a bottle needle 921 that punctures a rubber plug 985 of a vial container 980. A liquid channel 922 for the flow of a liquid and a gas channel 923 for the flow of a gas (air) are formed independent of each other in the bottle needle 921.

The tubular portion 930 is approximately cylinder-shaped. An inner cavity 935 of the tubular portion 930 is in communication with the male luer 911 via a first hole 931 and a second hole 932. Also, the liquid channel 922 and the gas channel 923 of the bottle needle 921 are also in communication with the inner cavity 935 of the tubular portion 930. The first hole 931 and the liquid channel 922 are formed at positions that oppose each other in the inner circumferential face of the tubular portion 930. Also, the second hole 932 and the gas channel 923 are formed at positions that oppose each other in the inner circumferential face of the tubular portion 930.

A syringe 990 is connected to one end of the tubular portion 930. A stopcock 940 is inserted into the other end of the tubular portion 930. The stopcock 940 includes an insertion portion 946 that is inserted into the tubular portion 930 and an operation portion 947 that is exposed outside the tubular portion 930. By operating the operation portion 947, the stopcock 940 can be rotated while the insertion portion 946 is inserted into the tubular portion 930.

A first channel 941 and a second channel 942 are formed in the insertion portion 946. The first channel 941 puts the syringe 990 in communication with the first hole 931 or the liquid channel 922 depending on the position of the stopcock 940 in the rotation direction (in FIG. 33, the first channel 941 has put the syringe 990 and the liquid channel 922 in communication). When the first channel 941 puts the syringe 990 and the first hole 931 or the liquid channel 922 in communication, the second channel 942 puts the second hole 932 and the gas channel 923 in communication. A hydrophobic filter 950 is provided in the second channel 942. The hydrophobic filter 950 has the property of allowing gases to pass and not allowing liquids to pass.

A method for preparing a drug solution using the connector 900 configured as described above will be described below with reference to FIGS. 34 to 37. In FIGS. 34 to 37, the members other than the connector 900 are shown by dashed double-dotted lines in order to simplify the drawings.

First, as shown in FIG. 34, the connector 900 is held such that the drug solution bag (not shown) is at the top and the vial container 980 is at the bottom. The drug solution bag is a bag-like object obtained by sealing the outer peripheral edge portions of two flexible sheets. The vial container 980 is an airtight container made of a hard material such as glass. A solution for dissolving the powdered drug in the vial container 980 is stored in the drug solution bag. The first channel 941 of the stopcock 940 has put the syringe 990 and the first hole 931 in communication. The plunger (not shown) of the syringe 990 has been inserted to the maximum depth in the outer cylinder (not shown) of the syringe 990. The plunger of the syringe 990 is pulled in this state (see arrow P91). The solution in the drug solution bag passes through the male luer 911, the first hole 931, the first channel 941, and the inner cavity 935 of the tubular portion 930 in the stated order, and then flows into the syringe 990 (see arrow L91). The pull amount of the plunger is adjusted so as to transfer a predetermined amount of solution into the syringe 990. Since the drug solution bag undergoes deformation as the solution flows out, the air pressure inside the drug solution bag is kept constant. Since the hydrophobic filter 950 is provided in the second channel 942, even if the interior of the vial container 980 is at a negative pressure, the solution in the drug solution bag does not pass through the male luer 911, the second hole 932, the second channel 942, and the gas channel 923 in the stated order and flow into the vial container 980.

Next, as shown in FIG. 35, the stopcock 940 is rotated 180 degrees while keeping the orientation of the connector 900 the same as in FIG. 34. As a result, the syringe 990 and the liquid channel 922 are put in communication via the first channel 941 of the stopcock 940. The plunger (not shown) of the syringe 990 is then pushed in this state (see arrow P92). The solution in the syringe 990 passes through the inner cavity 935 of the tubular portion 930, the first channel 941, and the liquid channel 922 in the stated order, and then flows into the vial container 980 (see arrow L92). Since the vial container 980 is an airtight container, the interior of the vial container 980 becomes positively pressured as the solution flows in. For this reason, the air inside the vial container 980 passes through the gas channel 923, the second channel 942, the hydrophobic filter 950, the second hole 932, and the male luer 911 in the stated order, and then moves into the drug solution bag (see arrow G92). The air pressure in the vial container 980 is thus kept constant. The drug in the vial container 980 is dissolved by the injected solution, and a drug solution is obtained.

Next, as shown in FIG. 36, the connector 900 is inverted vertically such that the vial container 980 is at the top and the drug solution bag (not shown) is at the bottom, while keeping the direction of the stopcock 940 the same as in FIG. 35. The plunger (not shown) of the syringe 990 then is pulled in this state (see arrow P93). The drug solution in the vial container 980 passes through the liquid channel 922, the first channel 941, and the inner cavity 935 of the tubular portion 930 in the stated order, and then flows into the syringe 990 (see arrow L93). The interior of the vial container 980 becomes negatively pressurized as the drug solution flows out. For this reason, the air in the drug solution bag (not shown) passes through the male luer 911, the second hole 932, the second channel 942, the hydrophobic filter 950, and the gas channel 923 in the stated order, and then flows into the vial container 980 (see arrow G93).

Next, as shown in FIG. 37, the stopcock 940 is rotated 180 degrees while keeping the orientation of the connector 900 the same as in FIG. 36. As a result, the syringe 990 and the first hole 931 are put in communication via the first channel 941 of the stopcock 940. The plunger (not shown) of the syringe 990 is then pushed in this state (see arrow P94). The drug solution in the syringe 990 passes through the inner cavity 935 of the tubular portion 930, the first channel 941, the first hole 931, and the male luer 911 in the stated order, and then flows into the drug solution bag (not shown) (see arrow L94). The push amount of the plunger is adjusted so as to inject a predetermined amount of drug solution into the drug solution bag.

As described above, according to the conventional connector 900, the amount of solution injected into the vial container 980 and the amount of drug solution injected into the drug solution bag can be appropriately measured using the syringe 990. Also, the series of tasks for preparing the drug solution can be performed in the state in which the male luer 911 is inserted into the port 970 of the drug solution bag and the bottle needle 921 has punctured the rubber plug 985 of the vial container 980, and thus there is a low possibility of the dangerous drug solution and vapor therefrom leaking to the outside.

PRIOR ART DOCUMENTS

Patent Document

[Patent Document 1] WO 2010/061743
[Patent Document 2] WO 2010/061742

DISCLOSURE OF INVENTION

Problem to be Solved by the Invention

In order to prepare a drug solution using the conventional connector 900 as described above, in the steps in FIGS. 34 to 37, the operations of rotating the stopcock 940, vertically inverting the orientation of the connector 900, and pushing or pulling the plunger of the syringe 990 need to be performed in a predetermined order. These operations are complicated, and therefore there can be some possibility of an operation error in which the operator makes a mistake in the operation order.

There has been a problem in that if the conventional connector 900 is misoperated by the operator, it is difficult to continue with the subsequent drug preparation tasks. This will be described below.

As described above, following the step in FIG. 35 in which the drug in the vial container 980 is dissolved with a solution to obtain a drug solution, in the step in FIG. 36 it is necessary to invert the connector 900 vertically and then pull the plunger of the syringe 990. At this time, if, after the step in FIG. 35, the plunger of the syringe 990 is pulled mistakenly without having vertically inverted the connector 900 as shown in FIG. 38 (see arrow P95), the gas in the vial container 980 passes through the liquid channel 922, the first channel 941, and the inner cavity 935 of the tubular portion 930 in the stated order, and then flows into the syringe 990 (see arrow G95). The interior of the vial container 980 thus becomes negatively pressurized, and therefore the solution in the drug solution bag flows into the male luer 911, the second hole 932, and the second channel 942 in the stated order (see arrow L95). Note that the solution cannot pass through the hydrophobic filter 950 provided in the second channel 942. Accordingly, as shown in FIG. 38, the portion of the second channel 942 on the drug solution bag side relative to the hydrophobic filter 950, the second hole 932, and the male luer 911 are filled with the solution 968. In FIG. 38, the region in which a solution 968 exists in the connector 900 is denoted by a dotted pattern.

After this state is reached, even if an attempt is made to pull the plunger of the syringe 990 farther, it cannot be pulled since the interior of the vial container 980 becomes negatively pressurized. At this point, the operator recognizes the operation error of forgetting to vertically invert the connector 900. The operator thus vertically inverts the connector 900 as shown in FIG. 39 in order to move to the step in FIG. 36. However, even if the connector 900 is inverted, the region between the hydrophobic filter 950 and the male luer 911 remains filled with the solution 968. Accordingly, even if an attempt is made to pull the plunger of the syringe 990 in this state (see arrow P96), it cannot be pulled as expected since the interior of the vial container 980 becomes negatively pressurized. If the plunger is inserted to the maximum depth in the outer cylinder of the syringe 990 when the step in FIG. 35 has ended, the plunger can only be inserted a slight amount further in the state shown in FIG. 39. Accordingly, it is difficult to discharge the solution 968 that fills the region between the hydrophobic filter 950 and the male luer 911 by pushing the plunger.

In this way, if the states shown in FIG. 38 and FIG. 39 are reached due to operation error, it becomes difficult to perform the operations of pushing and pulling the plunger of the syringe 990, and it is not possible to continue with the subsequent drug solution preparation tasks.

If the hydrophobic filter 950 is not provided, the aforementioned problem of not being able to continue with the drug solution preparation tasks after an operation error does not occur. However, when the hydrophobic filter 950 is not present, if the plunger of the syringe 990 is mistakenly pulled without having vertically inverted the connector 900 after the step in FIG. 35 similarly to the aforementioned operation error (see FIG. 38), the solution in the drug solution bag passes through the male luer 911, the second hole 932, the second channel 942, and the gas channel 923 in the stated order, and then flows into the vial container 980. Also, in the case where the hydrophobic filter 950 does not exist, even if proper operations are performed, there is a possibility of the solution or the drug solution flowing between the drug solution bag and the vial container 980 via the second hole 932, the second channel 942, and the gas channel 923 (i.e., without passing through the syringe 990). These situations make it difficult to prepare a desired drug solution.

The present invention resolves the problems of the conventional medical connector described above. Specifically, an object of the present invention is to make it possible to continue to perform preparation tasks even if an operation error is made in drug solution preparation tasks in a closed-system medical connector used for preparing a drug solution.

Means for Solving Problem

A medical connector of the present invention includes: a first connector including a bar-shaped first male member capable of being in communication with a first container; a second connector including a bar-shaped second male member capable of being in communication with a second container; a tubular portion including a syringe connection portion that is configured to be in communication with a syringe;

and a stopcock that is inserted into the tubular portion and is capable of rotation relative to the tubular portion. A first hole, a second hole, and a third hole that put the first male member and the tubular portion in communication are formed in the tubular portion. A liquid channel and a gas channel formed in the second male member are in communication with the tubular portion. A first channel, a second channel, and a third channel are formed in the stopcock. By rotating the stopcock, the position of the stopcock can be switched to a first rotation position at which the first channel puts the first hole and the syringe connection portion in communication, and a second rotation position at which the first channel puts the liquid channel and the syringe connection portion in communication. When the stopcock is at the second rotation position, the second hole and the gas channel of the second male member are in communication via the second channel. A first hydrophobic filter that allows passage of a gas and does not allow passage of a liquid is provided in a channel that connects the first male member and the gas channel and is formed when the stopcock is at the second rotation position. When the stopcock is at the second rotation position, the first male member and an inner cavity of the stopcock are in communication via the third hole and the third channel. An air supplying member capable of supplying a gas to the inner cavity of the stopcock is connected to the stopcock. A second hydrophobic filter that allows passage of a gas and does not allow passage of a liquid is provided in a channel that connects the air supplying member and the first male member and is formed when the stopcock is at the second rotation position.

Effects of the Invention

According to the present invention, in a state in which the first male member has been put in communication with the first container, and the second male member has been put in communication with the second container, it is possible to dissolve the drug in the second container with the solution transferred from the first container so as to obtain a drug solution, and then transfer the drug solution to the first container. Accordingly, it is possible to provide a very safe closed-system device with which there is a low possibility of a dangerous drug solution and vapor therefrom leaking to the outside.

The amount of solution transferred to the second container and the amount of drug solution transferred to the first container each can be measured accurately using the syringe that has been put in communication with the syringe connection portion of the tubular portion.

Even if it becomes difficult to perform pushing and pulling operations on the plunger of the syringe due to an operation error in the drug solution preparation tasks, the airflow of the first hydrophobic filter can be restored by operating the air supplying member. This thus makes it possible to continue with the drug preparation tasks without cancelation even if an operation error occurs in the drug solution preparation tasks.

DESCRIPTION OF THE INVENTION

Figure 1:
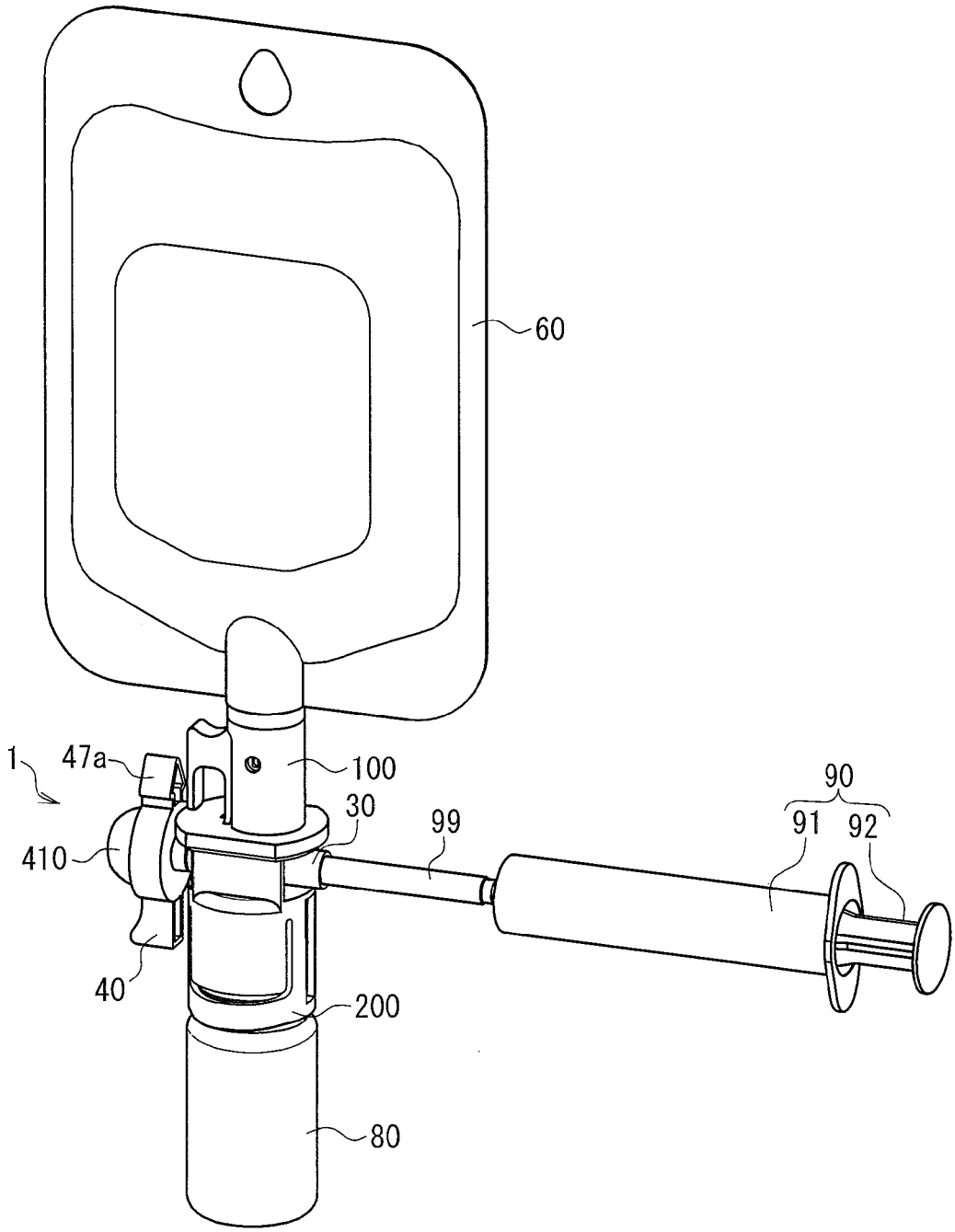
FIG. 1 is a perspective view showing an example of a usage state of a medical connector according to Embodiment 1 of the present invention.

A medical connector of the present invention includes: a first connector including a bar-shaped first male member capable of being in communication with a first container; a second connector including a bar-shaped second male member capable of being in communication with a second container; a tubular portion including a syringe connection portion that is configured to be in communication with a syringe; and a stopcock that is inserted into the tubular portion and is capable of rotation relative to the tubular portion. A first hole, a second hole, and a third hole that put the first male member and the tubular portion in communication are formed in the tubular portion. A liquid channel and a gas channel formed in the second male member are in communication with the tubular portion. A first channel, a second channel, and a third channel are formed in the stopcock. By rotating the stopcock, the position of the stopcock can be switched to a first rotation position at which the first channel puts the first hole and the syringe connection portion in communication, and a second rotation position at which the first channel puts the liquid channel and the syringe connection portion in communication. When the stopcock is at the second rotation position, the second hole and the gas channel of the second male member are in communication via the second channel. A first hydrophobic filter that allows passage of a gas and does not allow passage of a liquid is provided in a channel that connects the first male member and the gas channel and is formed when the stopcock is at the second rotation position. When the stopcock is at the second rotation position, the first male member and an inner cavity of the stopcock are in communication via the third hole and the third channel. An air supplying member capable of supplying a gas to the inner cavity of the stopcock is connected to the stopcock. A second hydrophobic filter that allows passage of a gas and does not allow passage of a liquid is provided in a channel that connects the air supplying member and the first male member and is formed when the stopcock is at the second rotation position.

In the above medical connector of the present invention, it is preferable that if a gas is supplied from the air supplying member to the inner cavity of the stopcock when the stopcock is at the second rotation position, the gas is introduced to a channel between the first hydrophobic filter and the first male member. According to this, it is possible to discharge a liquid that has filled the channel between the first hydrophobic filter and the first male member due to an operation error. Accordingly, the above preferable configuration is advantageous in restoring the airflow of the first hydrophobic filter.

In the above medical connector of the present invention, it is preferable that if a gas is supplied from the air supplying member to the inner cavity of the stopcock when the stopcock is at the second rotation position, the gas passes through the second hydrophobic filter, then flows over the first hydrophobic filter, and thereafter flows into the first male member.

According to this, it is possible to reliably eliminate a liquid on the first hydrophobic filter. Accordingly, the above preferable configuration is further advantageous in restoring the airflow of the first hydrophobic filter.

It is preferable that the first hydrophobic filter and the second hydrophobic filter are provided in a single common member. According to this, it is possible to reduce the number of parts constituting the medical connector of the present invention and the number of steps for assembling the medical connector of the present invention.

It is preferable that the first connector is provided on a first member. Also, it is preferable that the first hole, the second hole, and the third hole are formed in a second member. In this case, it is preferable that the single member provided with the first hydrophobic filter and the second hydrophobic filter is arranged between the first member and the second member. According to this, it is possible to increase the effective areas (areas through which a gas can pass) of the first hydrophobic filter and the second hydrophobic filter, thus making it possible to reduce the airflow resistance of the first hydrophobic filter and the second hydrophobic filter. Also, the medical connector of the present invention, in which the airflow of the first hydrophobic filter that became difficult due to an operation error can be restored by operating the air supplying member, can be realized with a simple configuration.

In the above configuration, it is preferable that a through-hole is formed in the single member provided with the first hydrophobic filter and the second hydrophobic filter, such that a liquid flows between the first male member and the first hole. According to this, it is possible to ensure the flow of a liquid between the first male member and the first hole while the single member is sandwiched between and firmly fixed by the first member and the second member.

It is preferable that a hole that puts the inner cavity of the air supplying member and the outside in communication is formed in the air supplying member. According to this, it is possible to reduce further the possibility of reaching a situation in which it is difficult to continue with the drug solution preparation task if an operation error is made.

In the above configuration, it is preferable that a one-way valve is provided in a channel that connects the second hydrophobic filter and the air supplying member and is formed when the stopcock is at the second rotation position, the one-way valve permitting a gas to flow from the air supplying member toward the second hydrophobic filter and prohibiting the gas from flowing from the second hydrophobic filter toward the air supplying member. According to this, it is possible to reduce the possibility of vapor from a dangerous drug solution leaking to the outside via the hole formed in the air supplying member.

It is preferable that the above medical connector of the present invention further includes a syringe that is in communication with the syringe connection portion. According to this, it is possible to measure precisely the amount of liquid to be transferred between the first container and the second container using the syringe.

It is preferable that the above medical connector of the present invention further includes a flexible tube that puts the syringe connection portion and the syringe in communication. Due to connecting the syringe to the syringe connection portion of the medical connector via a flexible tube, the orientation of the medical connector is not influenced by changes in the orientation of the syringe that occur when the plunger of the syringe is pushed and pulled. Accordingly, the plunger of the syringe can be pushed and pulled easily.

It is preferable that the first connector includes a first lock mechanism for maintaining a state in which the first male member is in communication with the first container. In this case, it is preferable that the first lock mechanism includes a hood that is arranged so as to surround the first male member and receives insertion of a first female connector of the first container, and a single lock lever having a cantilever support structure capable of elastic deformation. It is preferable that the lock lever includes a claw for engaging with the first female connector, and an operation portion for causing the lock lever to undergo elastic deformation in a direction of separation from the first male member. It is preferable that the claw and the operation portion are provided on a free end side of the lock lever. According to this preferable configuration, the claw provided on the single lock lever can be engaged with the first female connector inserted into the hood, thus making it possible to maintain the state in which the first male member is inserted into the first female connector. Also, the lock lever needs to be displaced in the direction of separation from the first male member in order to cancel the engagement of the claw and the first female connector, and therefore there is a low possibility of the locked state achieved by the first lock mechanism being unintentionally canceled by external force. Accordingly, it is possible to provide a first connector with a first lock mechanism that is very safe.

It is preferable that the second connector includes a second lock mechanism for maintaining a state in which the second male member is in communication with the second container. In this case, it is preferable that the second lock mechanism includes a ring-shaped portion that is arranged so as to surround the second male member and receives insertion of a second female connector of the second container, a pair of claws that oppose each other and are provided on the ring-shaped portion so as to protrude toward the second male member, and a pair of pressing portions that are provided on the ring-shaped portion and oppose each other in a direction orthogonal to the direction in which the pair of claws oppose each other. It is preferable that when pressing force in a direction in which the pair of pressing portions approach each other is applied to the pair of pressing portions, the ring-shaped portion undergoes elastic deformation such that the pair of claws separate from each other. According to this preferable configuration, by engaging the pair of claws with the second female connector, it is possible to prevent the second male member inserted into the second female connector from unintentionally coming out of the second female connector. Also, the gap between the pair of claws is widened by pressing the pair of pressing portions, and therefore the attachment and removal of the hood to and from the second female connector is easy. Accordingly, it is possible to provide a second connector that achieves both safety and ease of attachment and removal.

It is preferable that a lateral hole in communication with a channel in which a liquid flows is formed in an outer circumferential face of at least one of the first male member and the second male member. According to this, when the male member (first or second) in communication with the female connector (first or second) is withdrawn from the female connector (first or second), liquid attached to the periphery of the opening of the lateral hole is scraped away by the female connector (first or second), and therefore this is advantageous in reducing the amount of liquid that remains in the periphery of the opening of the lateral hole after withdrawal from the female connector (first or second). Accordingly, it is possible to reduce the possibility of the operator touching a dangerous drug solution or inhaling vapor therefrom.

Below, the present invention will be described in detail while disclosing preferred embodiments. However, it goes without saying that the present invention is not limited to the following embodiments. For the sake of convenience in the description, the drawings that are referenced in the following description show simplifications of, among the constituent members of the embodiment of the present invention, only relevant members that are necessary for describing the present invention. The present invention therefore can include arbitrary constituent members that are not shown in the following drawings. Also, regarding the dimensions of the members in the drawings, the dimensions of the actual constituent members, the ratios of the dimensions of the members, and the like are not shown faithfully.

Embodiment 1

FIG. 1 is a perspective view showing an example of a usage state of a medical connector (referred to hereinafter as simply "connector") 1 according to Embodiment 1 of the present invention. The connector 1 of Embodiment 1 includes a first connector 100 for connection to a drug solution bag (first container) 60, a second connector 200 for connection to a vial container (second container) 80, a tubular portion 30 arranged between the first connector 100 and the second connector 200, and a stopcock 40 inserted into one end of the tubular portion 30. A syringe 90 is connected to the other end of the tubular portion 30 via a flexible tube 99. The syringe 90 includes an outer cylinder 91 and a plunger 92 that is inserted into the outer cylinder 91 and pushed and pulled therein. A dome-shaped air supplying member 410 is attached to the end of the stopcock 40 on the side opposite to the tubular portion 30.

The drug solution bag 60 is a bag-like object obtained by overlaying two approximately rectangular flexible sheets and sealing the outer peripheral edge portions thereof using welding (e.g., heat sealing or ultrasonic welding). The shape of the drug solution bag 60 changes freely according to the amount of stored content. A solution for dissolving a drug in the vial container 80 has been injected into the drug solution bag 60.

The vial container 80 is an airtight container made of a transparent and hard (i.e., undergoing substantially no deformation) material such as glass. The opening of the vial container 80 is sealed by a rubber plug fitted therein (see later-described FIGS. 14, 15A, and 15B). A powdered drug is stored in the vial container 80.

Figure 2A:
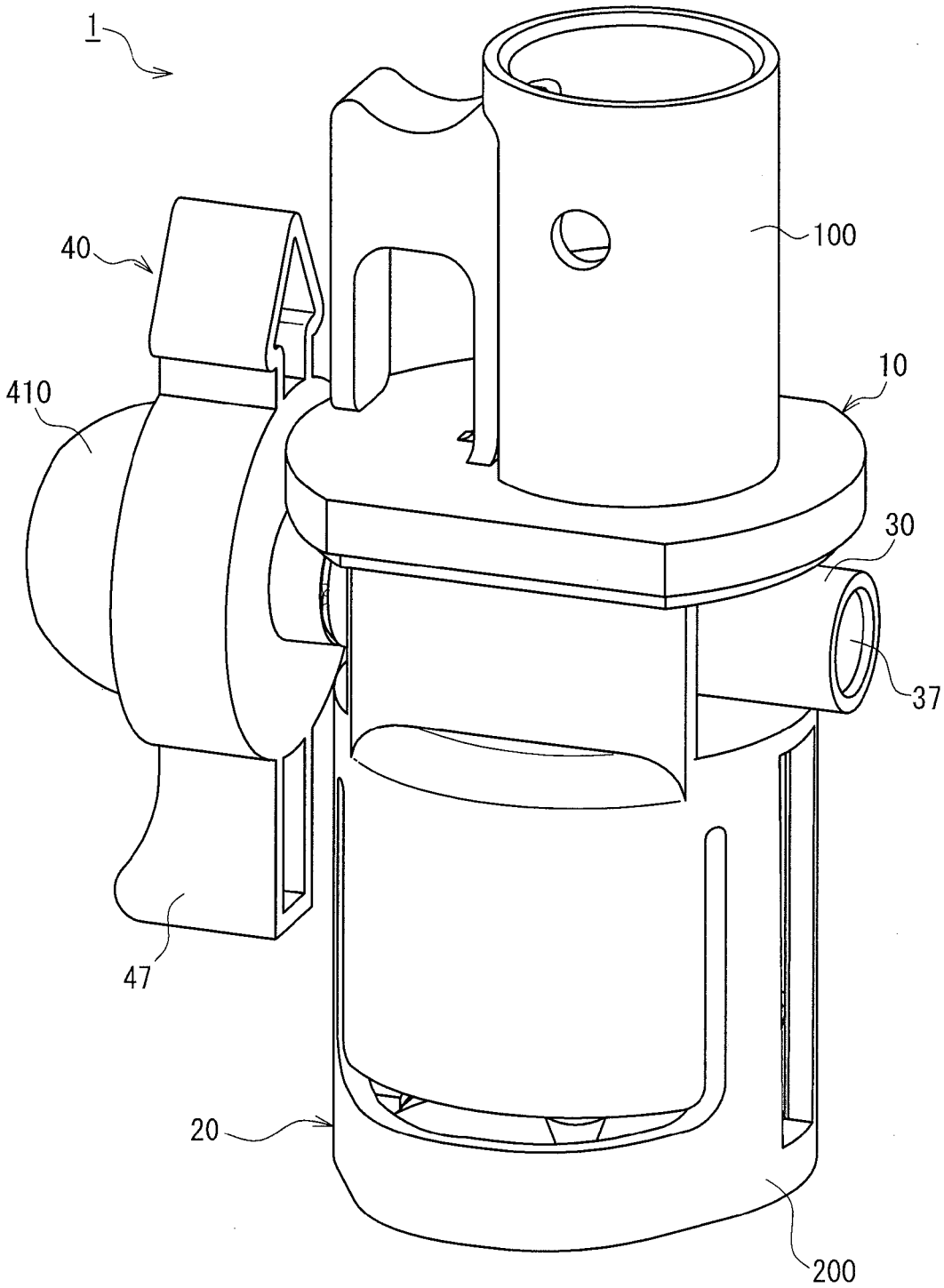
FIG. 2A is a perspective view from above the medical connector according to Embodiment 1 of the present invention.
Figure 2B:
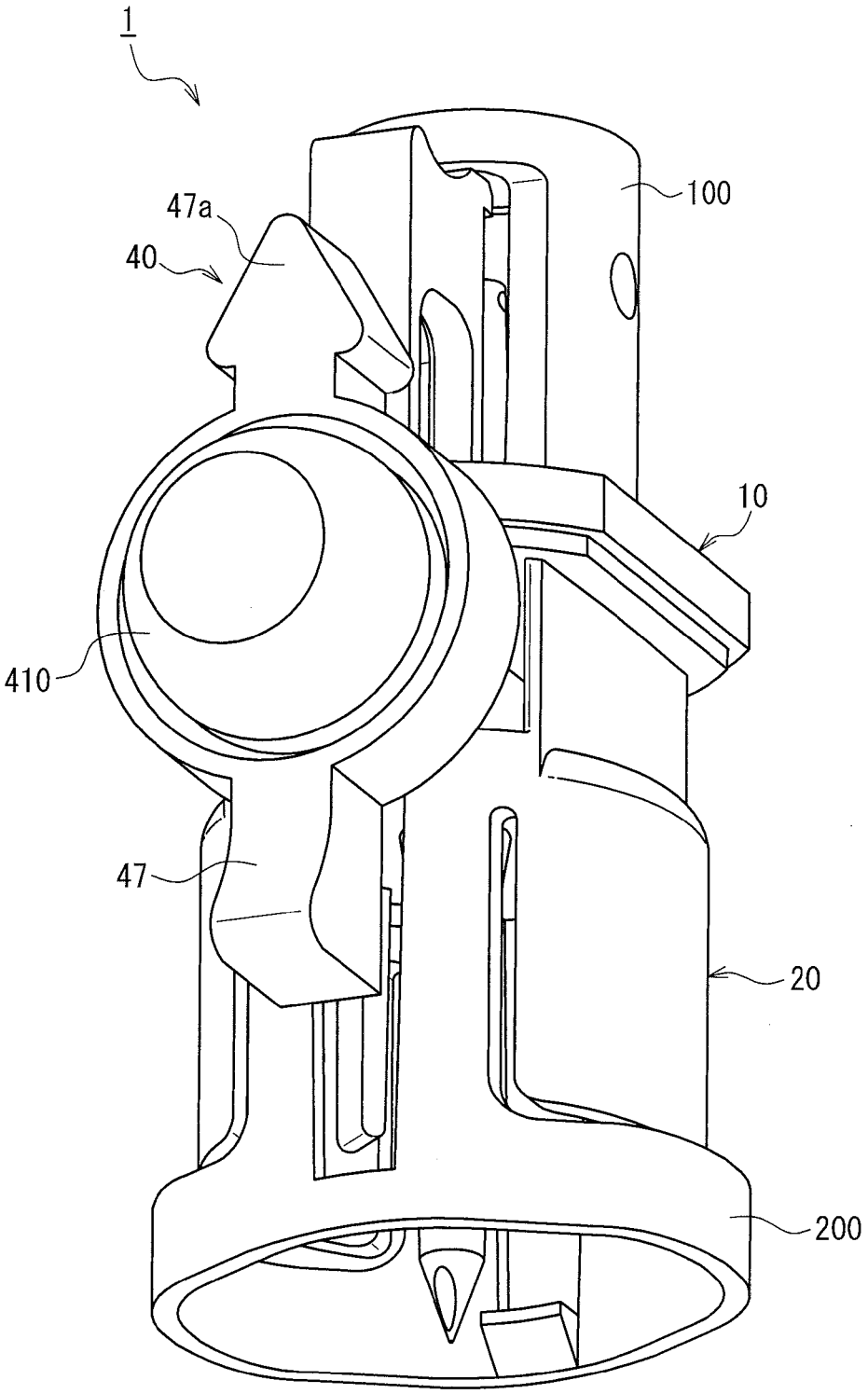
FIG. 2B is a perspective view from below the medical connector according to Embodiment 1 of the present invention.
Figure 3:
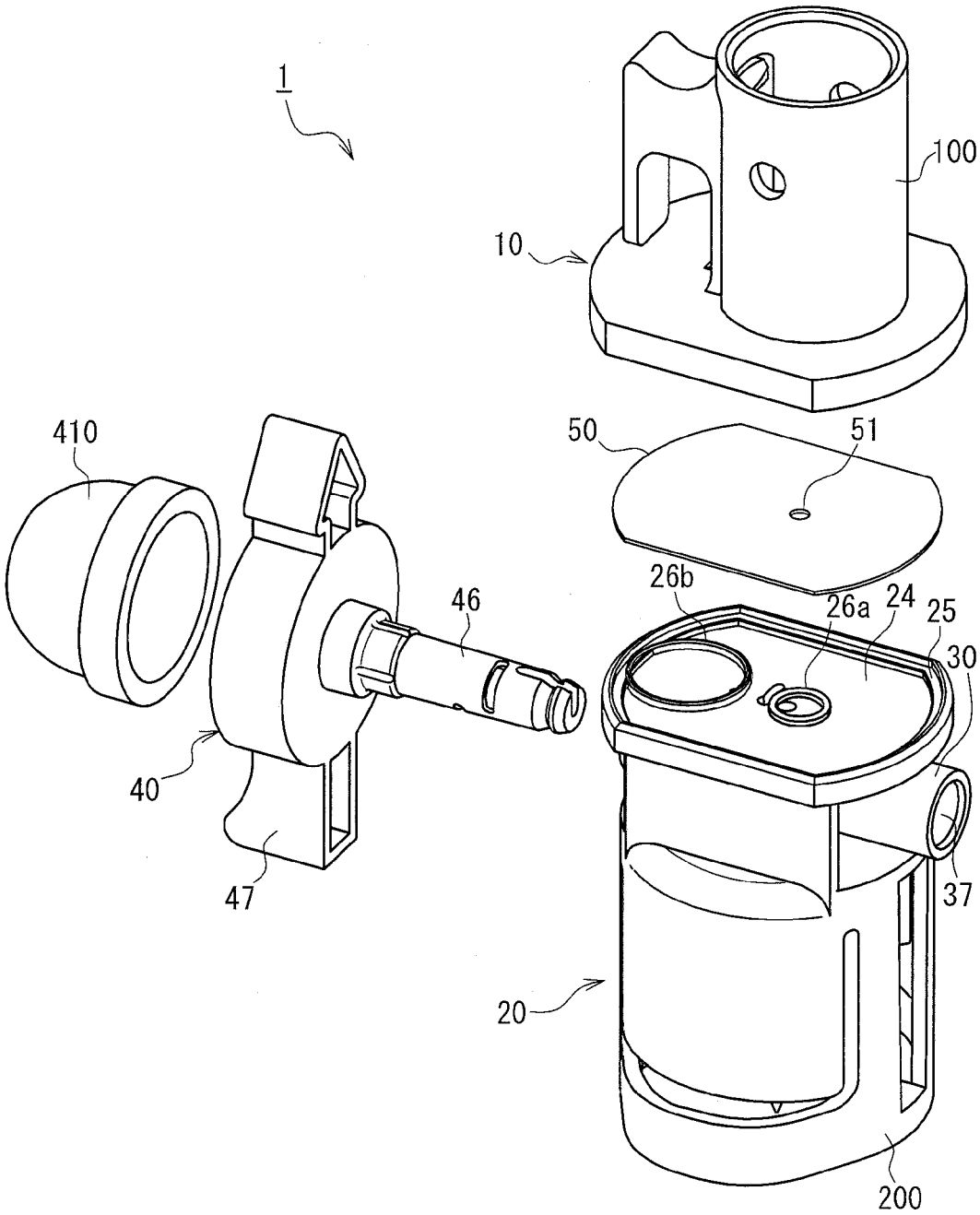
FIG. 3 is an exploded perspective view of the medical connector according to Embodiment 1 of the present invention.

FIG. 2A is a perspective view from above the connector 1, and FIG. 2B is a perspective view from below the connector 1. FIG. 3 is an exploded perspective view of the connector 1.

As shown in FIG. 3, the first connector 100 is provided on a first member 10, and the second connector 200 and the tubular portion 30 are provided on a second member 20. The first member 10 and the second member 20 are connected via a hydrophobic filter 50.

The stopcock 40 includes an insertion portion 46 having an outer circumferential face that is a substantially cylindrical face, and an operation portion 47. As shown in FIGS. 2A and 2B, the insertion portion 46 of the stopcock 40 is inserted into one end of the tubular portion 30. When the insertion portion 46 of the stopcock 40 is inserted into the tubular portion 30, the operation portion 47 is exposed outside the tubular portion 30. In the state in which the insertion portion 46 is inserted into the tubular portion 30, it is possible to pinch the operation portion 47 with fingers and freely rotate the stopcock 40 about the insertion portion 46 in the clockwise direction or the counterclockwise direction.

First Connector 100

The following describes the first connector 100.

Figure 4:
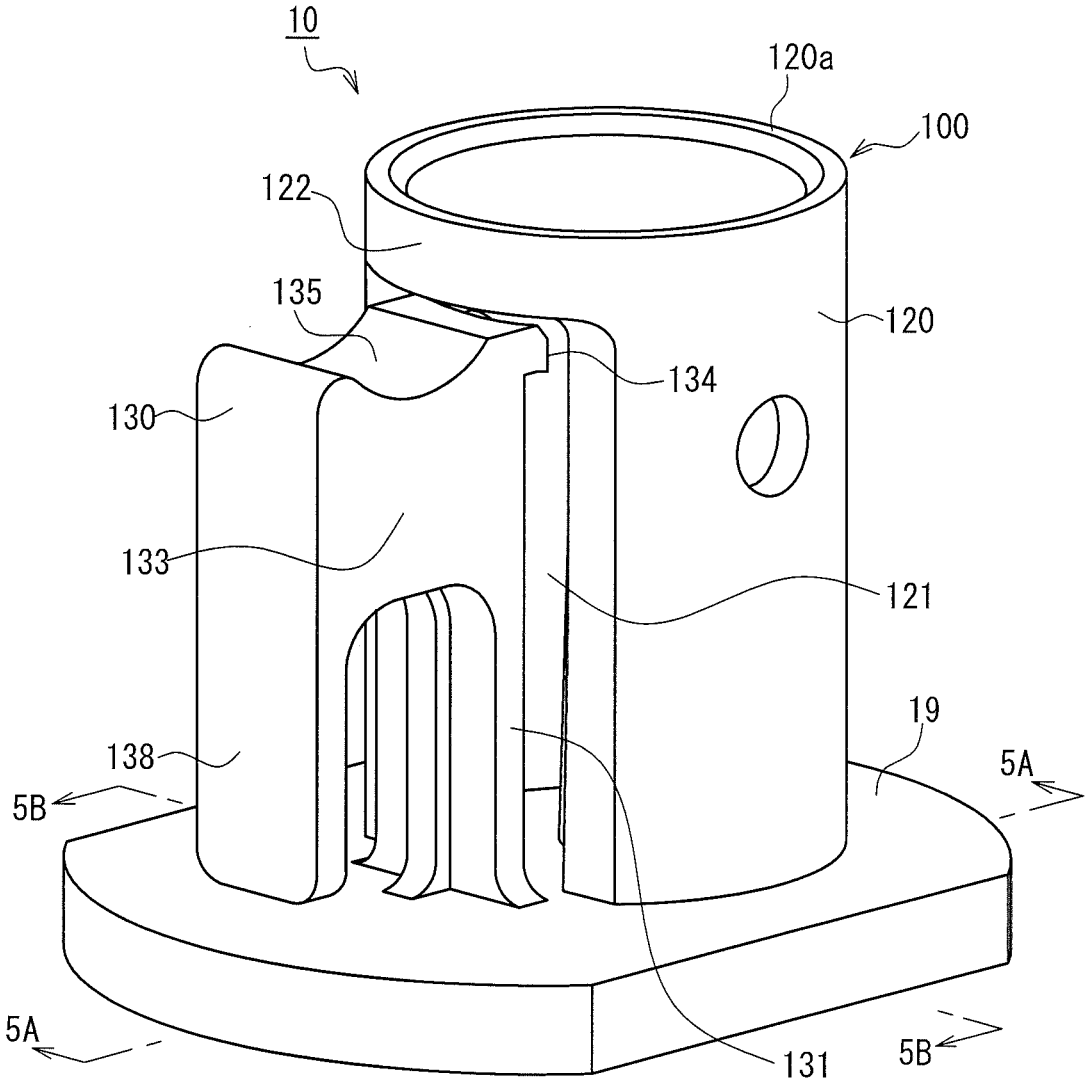
FIG. 4 is a perspective view of a first member that includes a first connector constituting a part of the medical connector according to Embodiment 1 of the present invention.
Figure 5B:
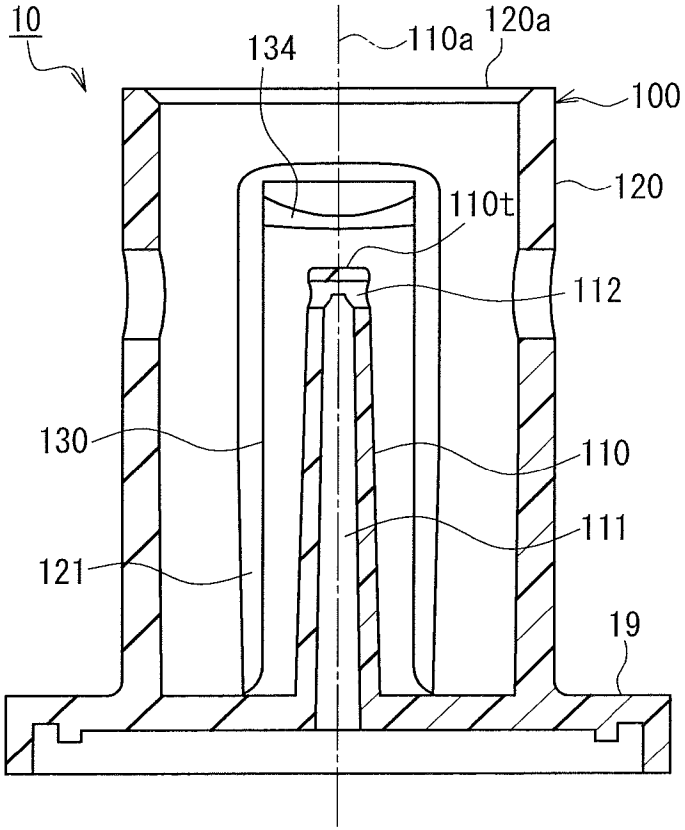
FIG. 5B is an arrow-view cross-sectional diagram of the first member taken along a plane including a line 5B-5B in FIG. 4.
Figure 5A:
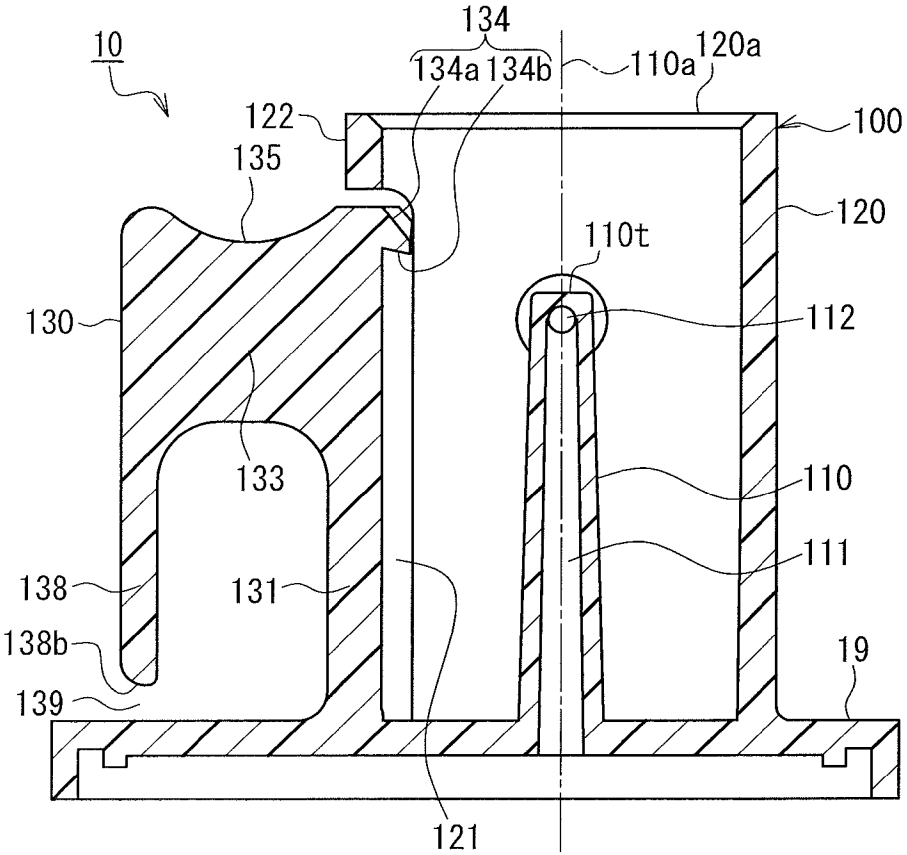
FIG. 5A is an arrow-view cross-sectional diagram of the first member taken along a plane including a line 5A-5A in FIG. 4.

FIG. 4 is a perspective view of the first member 10 that includes the first connector 100. FIG. 5A is a cross-sectional diagram of the first member 10 taken along a plane including a line 5A-5A in FIG. 4. FIG. 5B is a cross-sectional diagram of the first member 10 taken along a plane including a line 5B-5B in FIG. 4. The first connector 100 includes a bar-shaped male luer 110 as a first male member for insertion into a septum 71 of a needleless port 70 (see later-described FIGS. 8A and 8B). In FIGS. 5A and 5B, numeral 110*a* indicates the central axis of the male luer 110.

As shown in FIGS. 5A and 5B, the male luer 110 is a bar-shaped member that protrudes from a base 19. The outer circumferential face (i.e., side face) of the male luer 110 is a tapered face such that the outer diameter slightly decreases with increasing distance from the base 19 in the present embodiment. Note that the shape of the outer circumferential face of the male luer 110 is not limited to this, and any shape can be selected. For example, it may be a cylindrical face such that the outer diameter is constant in the central axis 110*a* direction.

A channel 111 is formed in the male luer 110 along the lengthwise direction thereof. The channel 111 is not open at a tip face 110*t* of the male luer 110. Instead, a lateral hole 112 that is in communication with the channel 111 is formed in the vicinity of the tip of the male luer 110. The lateral hole 112 passes through the male luer 110 in the radial direction (the direction of a straight line orthogonal to the central axis 110*a*), and is open at two locations on the outer circumferential face of the male luer 110. Note that the lateral hole 112 may be open at only one location on the outer circumferential face of the male luer 110 instead of passing completely through male luer 110.

A hood 120 is provided upright on the base 19 on the same side as the male luer 110 so as to surround the male luer 110. The hood 120 is shaped as a hollow cylinder that is coaxial with the male luer 110, and the height (dimension in the central axis 110*a* direction) of the hood 120 is greater than the height of the male luer 110. The inner circumferential face of the hood 120 (the face opposing the male luer 110) is a cylindrical face having an inner diameter approximately the same as or slightly greater than the outer diameter of a first female connector (later-described needleless port 70) to which the first connector 100 is to be connected. An opening (notch) 121 is formed in the hood 120. The opening 121 extends from the base 19 to a position slightly higher than the male luer 110. The opening 121 does not extend to the upper end of the hood 120, and a bridge portion 122 provided on the side opposite to the base 19 relative to the opening 121 connects portions of the hood 120 on the two sides of the opening 121 in the circumferential direction.

A lock lever 130 is provided upright on the base 19 so as to oppose the male luer 110 via the opening 121 of the hood 120. The lock lever 130 includes an elastic portion 131 that extends perpendicularly from the base 19, a lock piece 133 provided on the upper end of the elastic portion 131, and a stopper 138 that extends from the lock piece 133 toward the base 19, and as shown in FIG. 5A, the lock lever 130 has an overall shape as an upside-down "J" or an upside-down "U".

The elastic portion 131 is shaped as a thin plate that extends along a plane orthogonal to the radial direction of the male luer 110. As a result, the elastic portion 131 is capable of undergoing deformation so as to bend elastically in a plane that includes the central axis 110*a* of the male luer 110.

The lock piece 133 is an approximately quadrangular plate-shaped member that extends along the radial direction of the male luer 110. The face of the lock piece 133 on the side opposing the male luer 110 is on the same plane as the elastic portion 131, and a claw 134 that protrudes toward the male luer 110 is formed on the upper end of this face of the lock piece 133. As shown in FIG. 5A, the claw 134 includes an inclined face 134*a* and an engaging face 134*b*. The inclined face 134*a* is inclined so as to move away from the male luer 110 with increasing distance from the base 19. The engaging face 134*b* is arranged on the base 19 side relative to the inclined face 134*a*, and is a flat face that is approximately parallel to the horizontal direction. The apex portion of the claw 134 (the portion closest to the male luer 110) protrudes to a position on the male luer 110 side relative to the inner circumferential face of the hood 120.

The upper face of the lock piece 133 is an operation portion 135 that is sunken so as to be shaped as an approximately cylindrical face. The operation portion 135 extends and protrudes outward along the radial direction from the outer circumferential face of the hood 120.

The stopper 138 is elongated such that the face of the lock piece 133 on the side opposite to the male luer 110 extends toward the base 19. A lower end 138*b* of the stopper 138 and the base material 19 are separated via a gap 139.

Figure 6:
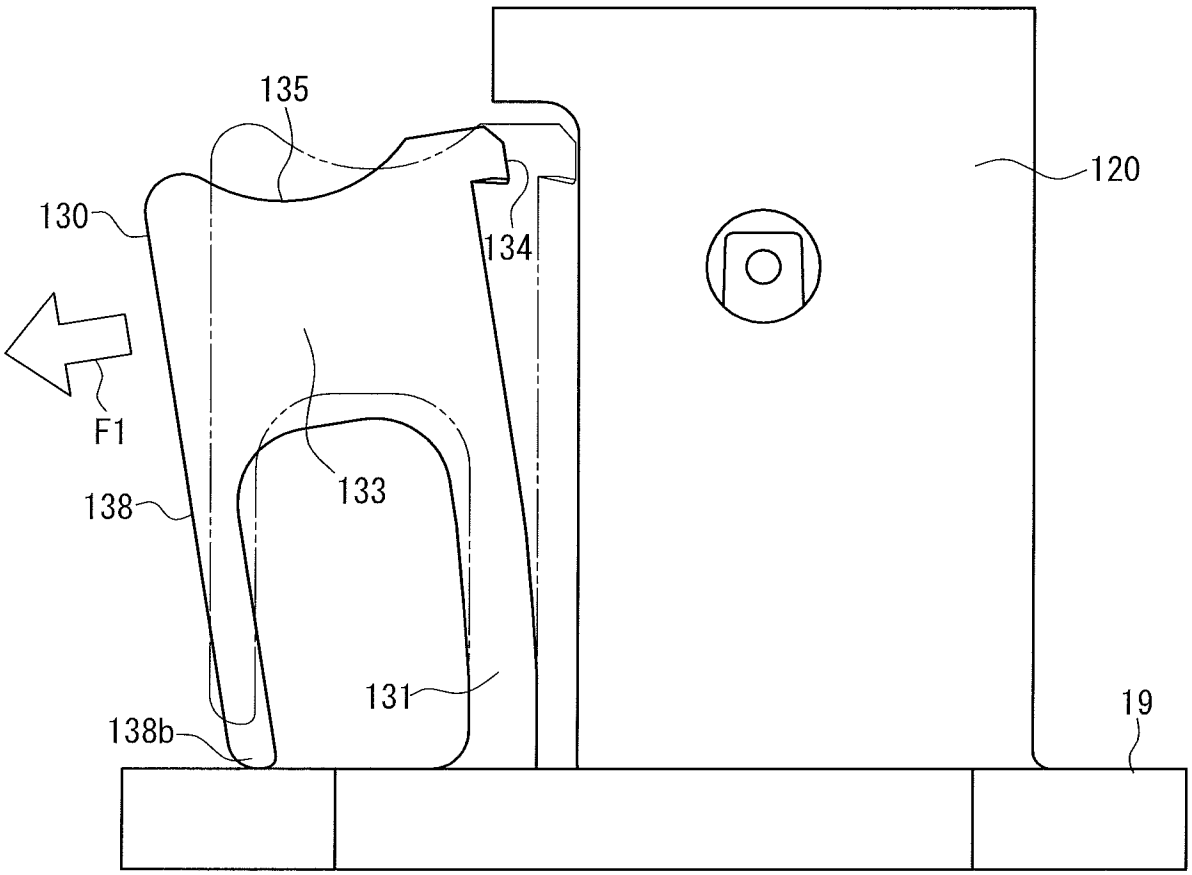
FIG. 6 is a side view showing an elastically deformed lock lever in the first member that includes the first connector constituting a part of the medical connector according to Embodiment 1 of the present invention.

The lock lever 130 has a cantilever support structure in which the lower end of the elastic portion 131 fixed to the base 19 is the fixed end, and the upper end side provided with the claw 134 and the operation portion 135 is the free end. If a finger is brought into contact with the operation portion 135, and force F1 in a direction of separation from the hood 120 is applied to the operation portion 135, the elastic portion 131 undergoes elastic bending deformation, and the lower end 138*b* of the stopper 138 comes into contact with the base 19 as shown in FIG. 6. At this time, the claw 134 becomes displaced in a direction of separation from the male luer 110 approximately along the radial direction.

The hood 120 and the lock lever 130 described above configure a first lock mechanism of the first connector 100.

It is preferable that the first member 10 including the first connector 100 is made of a hard material. Specifically, the first member 10 can be created with a method such as integral molding, using a resin material such as polyacetal, polycarbonate, polystyrene, polyamide, polypropylene, or rigid polyvinyl chloride.

The following describes a method for connecting the drug solution bag 60 and the first connector 100 of Embodiment 1 configured as described above. In FIGS. 7 to 10A and 10B referenced in the following description, among the members configuring the connector 1, the members other than the first member 10 including the first connector 100 are not depicted in order to simplify the drawings.

Figure 7:
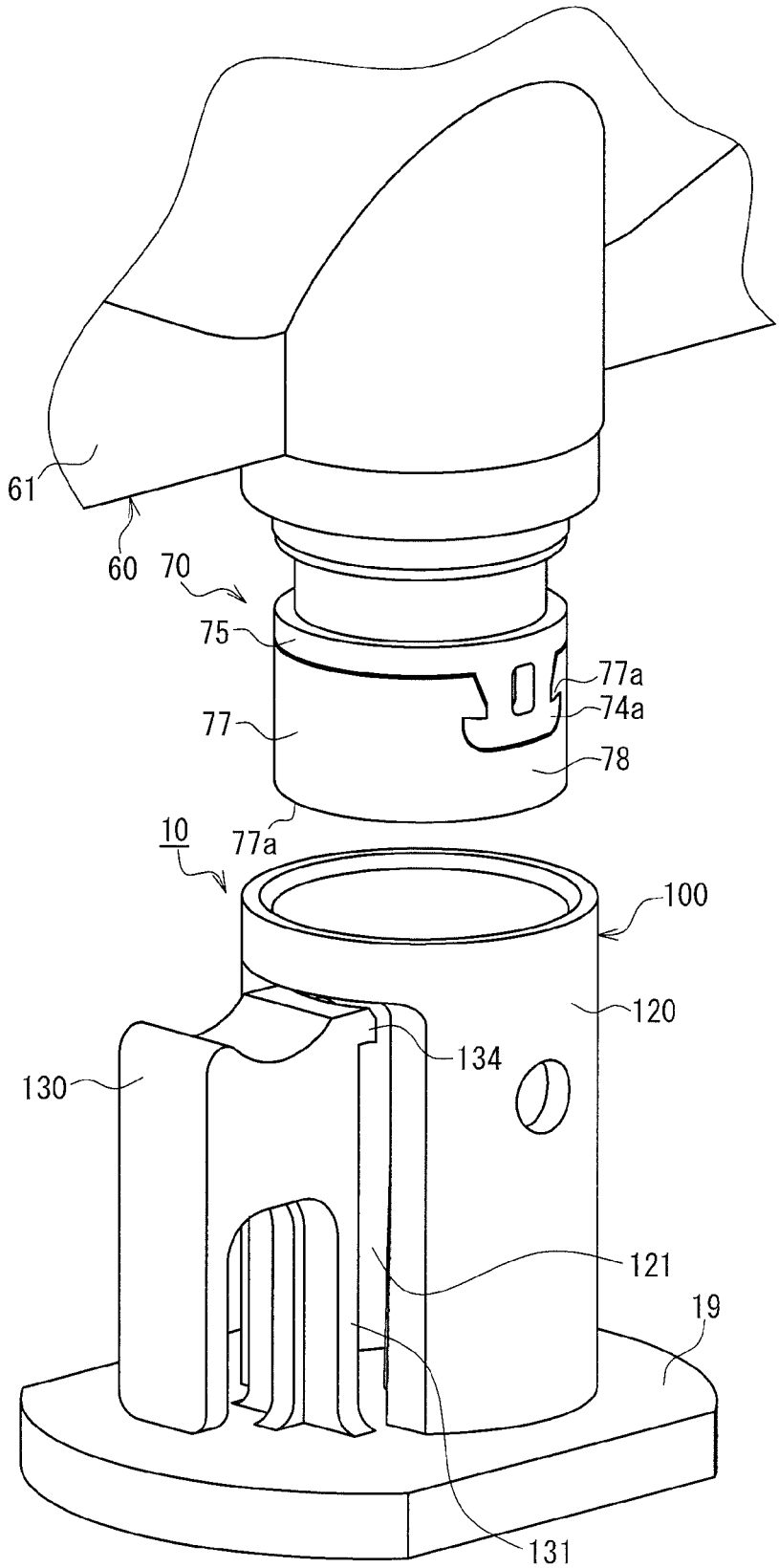
FIG. 7 is a perspective view of the first connector and a needleless port immediately before connection in Embodiment 1 of the present invention.
Figure 8B:
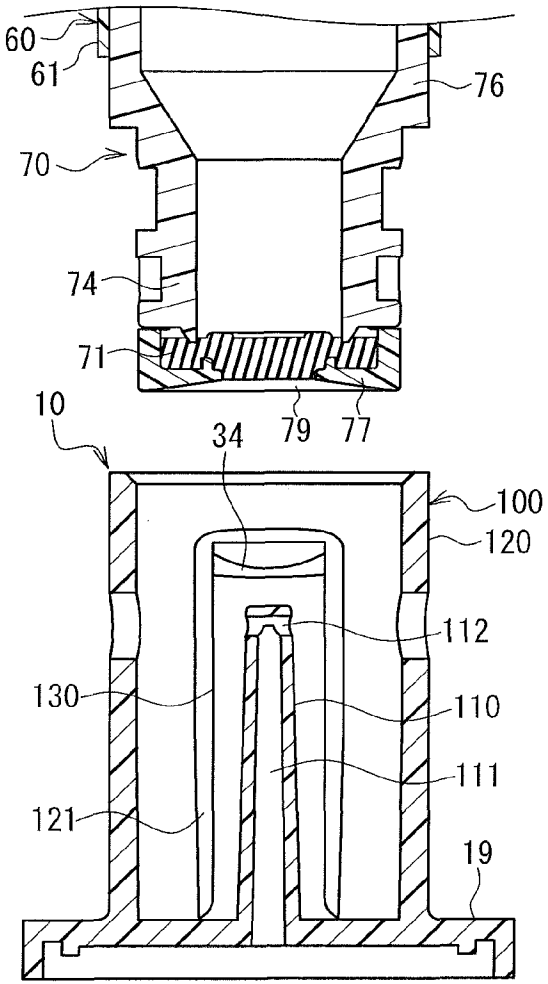
FIGS. 8A and 8B are cross-sectional views of the first connector and the needleless port immediately before connection in Embodiment 1 of the present invention.
Figure 8A:
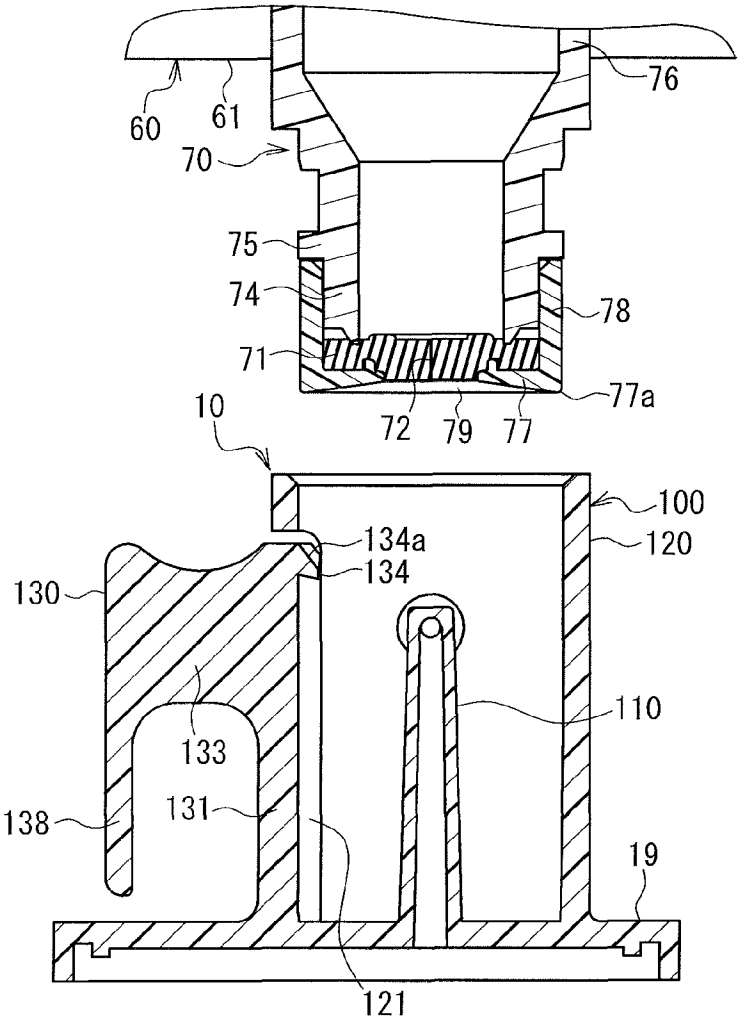

FIG. 7 is a perspective view showing the first connector 100 and a needleless port (first female connector) 70 provided on the drug solution bag 60, immediately before connection. FIGS. 8A and 8B are cross-sectional views of the first connector 100 and the needleless port 70 immediately before connection. The cross-sections in FIGS. 8A and 8B are the same as the cross-sections in FIGS. 5A and 5B respectively.

The needleless port 70 includes a disk-shaped partition wall member (septum) 71 that is made of an elastic material such as rubber and is provided with a linear slit (incision) 72 in the central portion. The septum 71 is placed at the tip of a tubular base portion 74, and is covered by cap 77. A locking claw 77*a* is formed by a notch in a cylinder portion 78 encompassing the cap 77, and the cap 77 is fixed to the base portion 74 by engaging the locking claw 77*a* with a locking claw 74*a* formed on the outer circumferential face of the base portion 74. Accordingly, the septum 71 is sandwiched between the base portion 74 and the cap 77. An opening 79 is formed in the center of the cap 77, and the slit 72 in the septum 71 is exposed inside the opening 79. A protruding portion 75 is formed on the outer circumferential face of the base portion 74 on the side opposite to the septum 71, and protrudes so as to form a cylindrical face that is approximately the same as the cylinder portion 78 of the cap 77. The protruding portion 75 is continuous in the circumferential direction of the base portion 74. A connection portion 76 extending from the base portion 74 in a direction away from the septum 71 is sandwiched by two sheets 61 that configure the drug solution bag 60, and these members are connected by a method such as welding (e.g., heat sealing).

As shown in FIGS. 7, 8A, and 8B, the needleless port 70 is placed in opposition to the first connector 100. The cap 77 of the needleless port 70 is then inserted into the hood 120 of the first connector 100, and then the needleless port 70 is pushed toward the first connector 100. The tip of the male luer 110 then comes into contact with the septum 71 that is exposed inside the opening 79 of the cap 77, and enters the slit 72. At the same time, the inclined face 134*a* of the claw 134 of the lock lever 130 comes into contact with an outer edge 77*a* of the cap 77. While sliding over the inclined face 134*a*, the edge 77*a* of the cap 77 causes the elastic portion 131 to undergo deformation so as to elastically bend, and displaces the lock lever 130 in the direction in which the claw 134 moves away from the male luer 110. As the needleless port 70 enters the hood 120, the claw 134 slides over the cylinder portion 78 of the cap 77 and the protruding portion 75 in the stated order. Then, when the claw 134 has completely passed the protruding portion 75, the elastic portion 131 undergoes elastic restoration, and the claw 134 and the protruding portion 75 engage with each other (enter a locked state).

Figure 9:
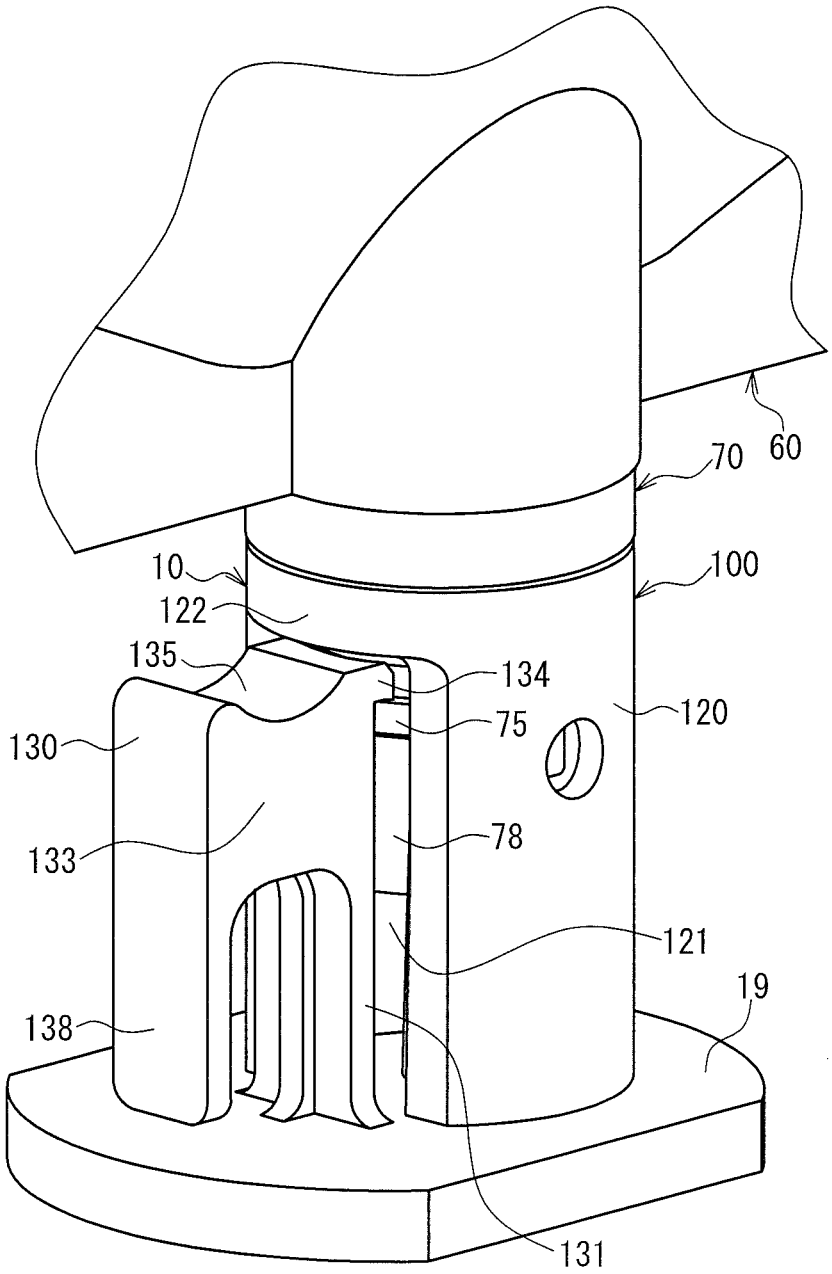
FIG. 9 is a perspective view of the first connector and the needleless port in the connected state locked by a first lock mechanism in Embodiment 1 of the present invention.
Figure 10B:
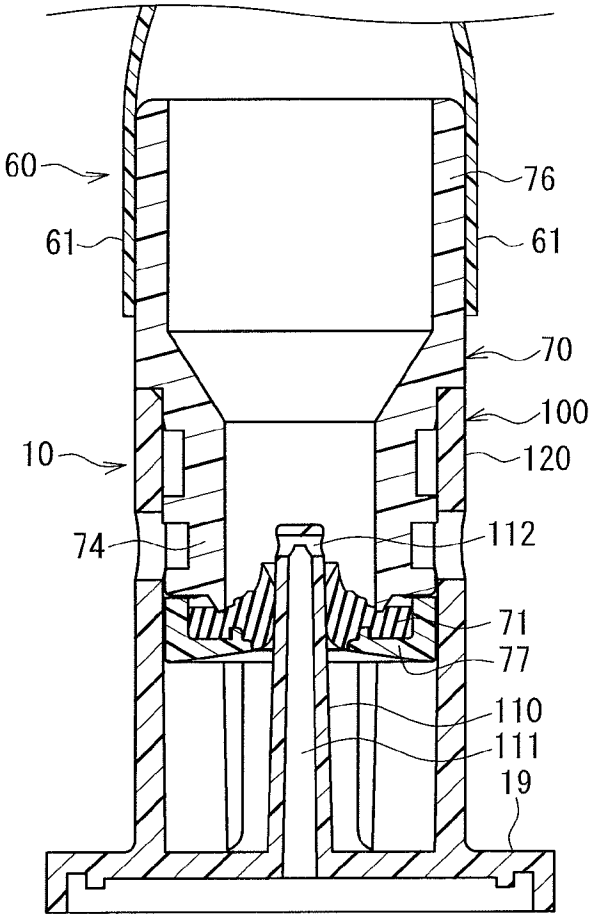
FIGS. 10A and 10B are cross-sectional views of the first connector and the needleless port in the connected state locked by the first lock mechanism in Embodiment 1 of the present invention.
Figure 10A:
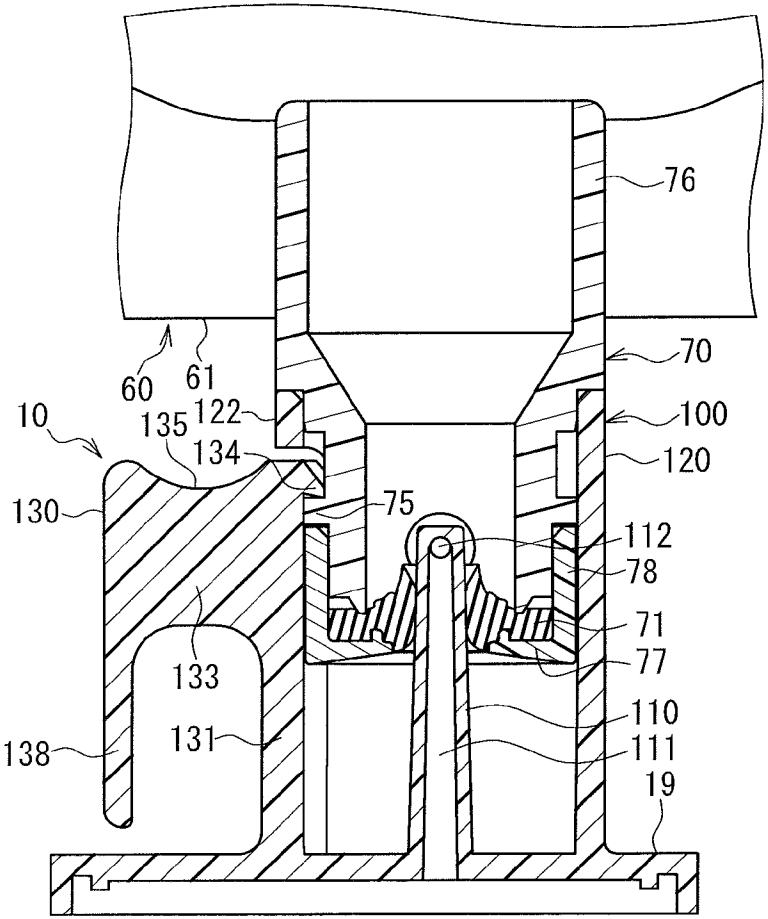

FIG. 9 is a perspective view showing the first connector 100 and the needleless port 70 in the connected and locked state. FIGS. 10A and 10B are cross-sectional views showing the first connector 100 and the needleless port 70 in the connected and locked state. The cross-sections in FIGS. 10A and 10B are the same as the cross-sections in FIGS. 8A and 8B respectively.

The lock lever 130 is at approximately the same position as in the initial state (see FIGS. 7, 8A, and 8B), and the claw 134 thereof (particularly the engaging face 134*b* thereof (see FIG. 5A)) is engaged with the protruding portion 75 of the needleless port 70. The male luer 110 has passed through the slit 72 in the septum 71, and thus the septum 71 is subject to a large amount of elastic deformation. The openings of the lateral hole 112 in the male luer 110 are exposed inside the inner cavity of the base portion 74. In this state, a liquid or a gas can be caused to flow between the male luer 110 and the needleless port 70 via the channel 111 and the lateral hole 112.

The first connector 100 and the needleless port 70 can be separated by pressing a finger against the operation portion 135 of the lock lever 130 and displacing the lock lever 130 in the direction of separation from the hood 120 (see FIG. 6). The engagement between the claw 134 and the protruding portion 75 thus is canceled. If, at the same time, the first connector 100 and the needleless port 70 are pulled in the direction of separation from each other, the first connector 100 and the needleless port 70 can be separated. Immediately after the male luer 110 is withdrawn from the septum 71, the septum 71 undergoes elastic restoration, and the slit 72 closes.

As described above, according to the first connector 100 of the present embodiment, in the state where the male luer 110 has passed through the septum 71, the claw 134 of the first connector 100 engages with the protruding portion 75 of the needleless port 70. Accordingly, the male luer 110 is prevented from unintentionally coming out of the septum 71.

In order to cancel the engagement between the claw 134 and the protruding portion 75, it is necessary to displace the lock lever 130 in the direction of separation from the hood 120 by applying force (pulling force) F1 (see FIG. 6) to the lock lever 130. In actual usage of the connector 1, the possibility of this pulling force F1 unintentionally acting on the lock lever 130 is generally low. Accordingly, the first lock mechanism of the first connector 100 is very safe since there is a reduced possibility of the locked state being unintentionally canceled by external force.

Since the claw 134 and the operation portion 135 are provided on the free end side of the lock lever 130, the direction in which the claw 134 needs to be moved in order to cancel the engagement between the claw 134 and the protruding portion 75 is the same as the direction of the force F1 (see FIG. 6) that needs to be applied to the operation portion 135 in order to move the claw 134 in the direction for canceling the engagement. Accordingly, the operation for canceling the locked state can be performed intuitively. Also, arranging the operation portion 135 at a position farther away from the fixed end of the lock lever 130 enables the amount of force F1 needed to be reduced. Furthermore, arranging the claw 134 at a position farther from the fixed end of the lock lever 130 enables the displacement amount of the claw 134 to be increased.

Since only one lock lever 130 is provided, the locked state can be canceled with one finger, thus improving the ease of the operation for canceling the locked state. Also, the lower the number of lock levers 130 is, the lower the possibility of unintended external force acting on the lock lever 130 is. Accordingly, providing only one lock lever 130 reduces the possibility of the pulling force F1 for canceling the engagement between the claw 134 and the protruding portion 75 unintentionally acting on the lock lever 130, thus further improving safety.

If the force F1 is applied to the operation portion 135 so as to displace the lock lever 130 in the direction of separation from the male luer 110, the lower end 138*b* of the stopper 138 comes into contact with the base 19, and thus the displacement of the lock lever 130 is limited. In this way, the stopper 138 of the lock lever 130 and the base 19 function as a displacement limiting means that provides an upper limit for the elastic displacement amount of the lock lever 130. The displacement limiting means prevents the operator from greatly displacing the lock lever 130 more than necessary when canceling the engagement between the claw 134 and the protruding portion 75, thus making it possible to prevent the elastic portion 131 from becoming plastically deformed or damaged by excessive bending deformation.

Since the hood 120 surrounds the male luer 110, there is a reduced possibility of the operator mistakenly touching the male luer 110 with his/her hand. This is advantageous in separating the operator from dangerous drug solutions.

Furthermore, the hood 120 contributes to the positioning of the needleless port 70 in the horizontal plane as well. Specifically, the hood 120 positions the needleless port 70 relative to the male luer 110 such that the male luer 110 is inserted precisely into the slit 72 in the septum 71 that is exposed inside the opening 79 of the cap 77. Also, the hood 120 positions the needleless port 70 relative to the lock lever 130 such that the claw 134 reliably engages with the protruding portion 75, and such that the engagement between the claw 134 and the protruding portion 75 is reliably canceled.

The opening 121 for allowing the claw 134 to engage with the needleless port 70 is formed in the hood 120. If it is only necessary that the claw 134 provided on the lock lever 130 that is arranged outside the hood 120 engages with the needleless port 70 inside the hood 120, it is possible to apply a method of, for example, reducing the height (up-down direction dimension) of the hood 120 or forming a notch extending toward the base 19 in the upper edge 120*a* of the hood 120. However, the method of reducing the height of the hood 120 reduces the above-described functionality of the hood 120 (i.e., the separation function of preventing the operator from touching the male luer 110, and the function of positioning the needleless port 70). Also, the method of forming a notch in the edge 120*a* of the hood 120 reduces the mechanical strength of the edge 120*a* of the hood 120. The configuration of the present embodiment, in which the opening 121 is formed in the hood 120 and the claw 134 is engaged with the needleless port 70 via the opening 121, is advantageous in preventing the operator from mistakenly touching the male luer 110, in positioning the needleless port 70 using the hood 120, and in suppressing a reduction in the mechanical strength of the hood 120.

The opening 121 formed in the hood 120 does not extend to the upper end of the hood 120. The hood 120 includes the bridge portion 122 at a position higher than the opening 121. As a result, the upper edge 120*a* of the hood 120 is continuous in the circumferential direction with the same height. This improves the strength of the upper edge 120*a* of the hood 120. Accordingly, in the case where external force in the horizontal direction (direction parallel to the plane orthogonal to the central axis 110*a*) acts on the needleless port 70 in the locked state (FIGS. 9, 10A, and 10B), the hood 120 suppresses inclination and movement of the needleless port 70. This thus prevents the engagement between the claw 134 and the protruding portion 75 from being canceled by inclination or movement of the needleless port 70, thus further reducing the possibility of the locked state being unintentionally canceled, and further improving safety. Also, it is possible to prevent the hood 120 from being damaged by inclination or movement of the needleless port 70.

The channel 111 of the male luer 110 is not open at the tip face 110*t* of the male luer 110, and the lateral hole 112 in communication with the channel 111 is open at the outer circumferential face of the male luer 110. When the male luer 110 that has passed through the septum 71 is withdrawn from the septum 71 at a later time, liquid attached to the periphery of the openings of the lateral hole 112 is likely to be scraped away by the edges of the slit 72 in the septum 71, and therefore the above configuration is advantageous in reducing the amount of liquid that remains in the periphery of the openings of the lateral hole 112 after withdrawal from the septum 71.

Second Connector 200

The following describes the second connector 200.

Figure 11:
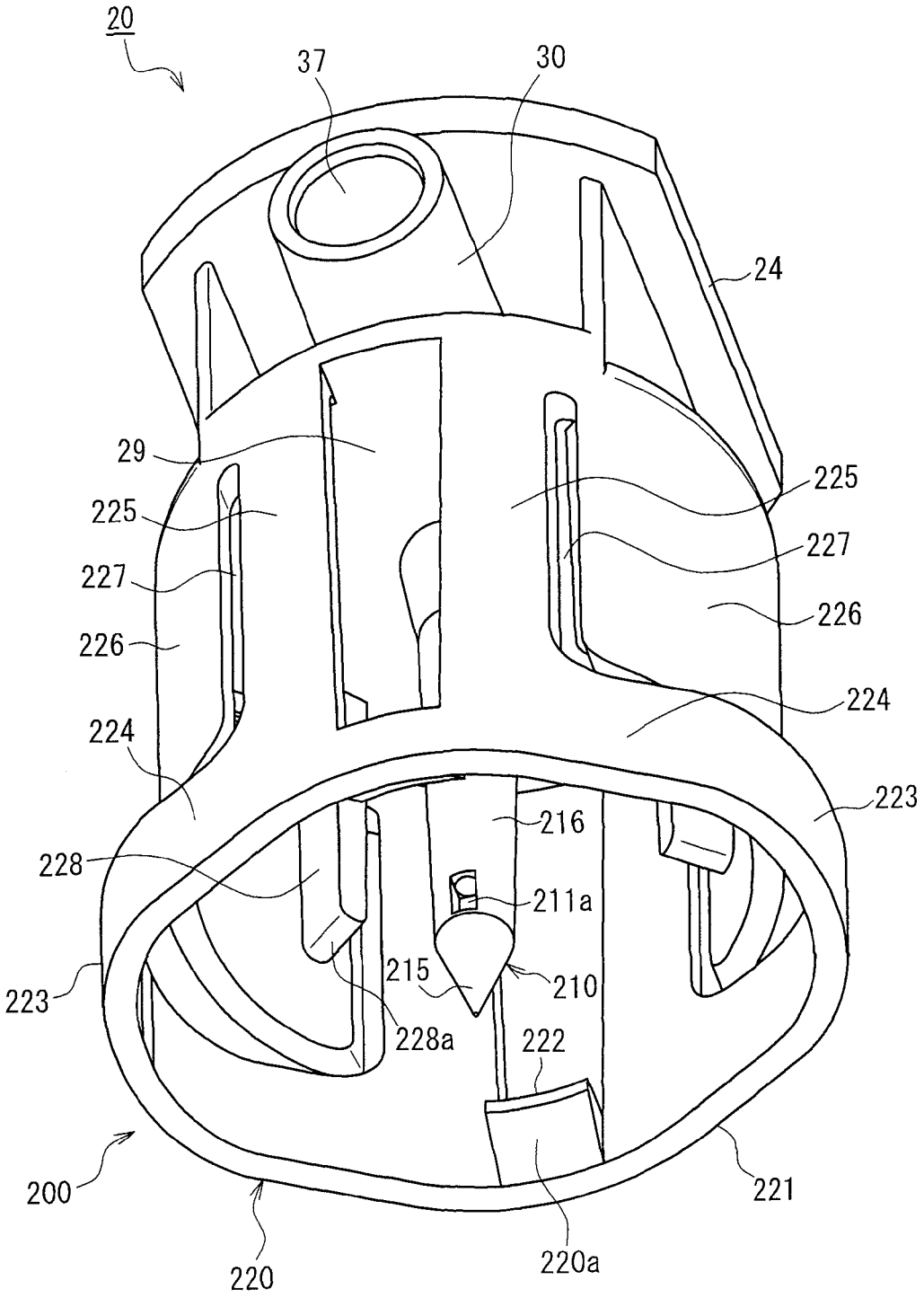
FIG. 11 is a perspective view of a second member that includes a second connector constituting a part of the medical connector according to Embodiment 1 of the present invention.
Figure 12:
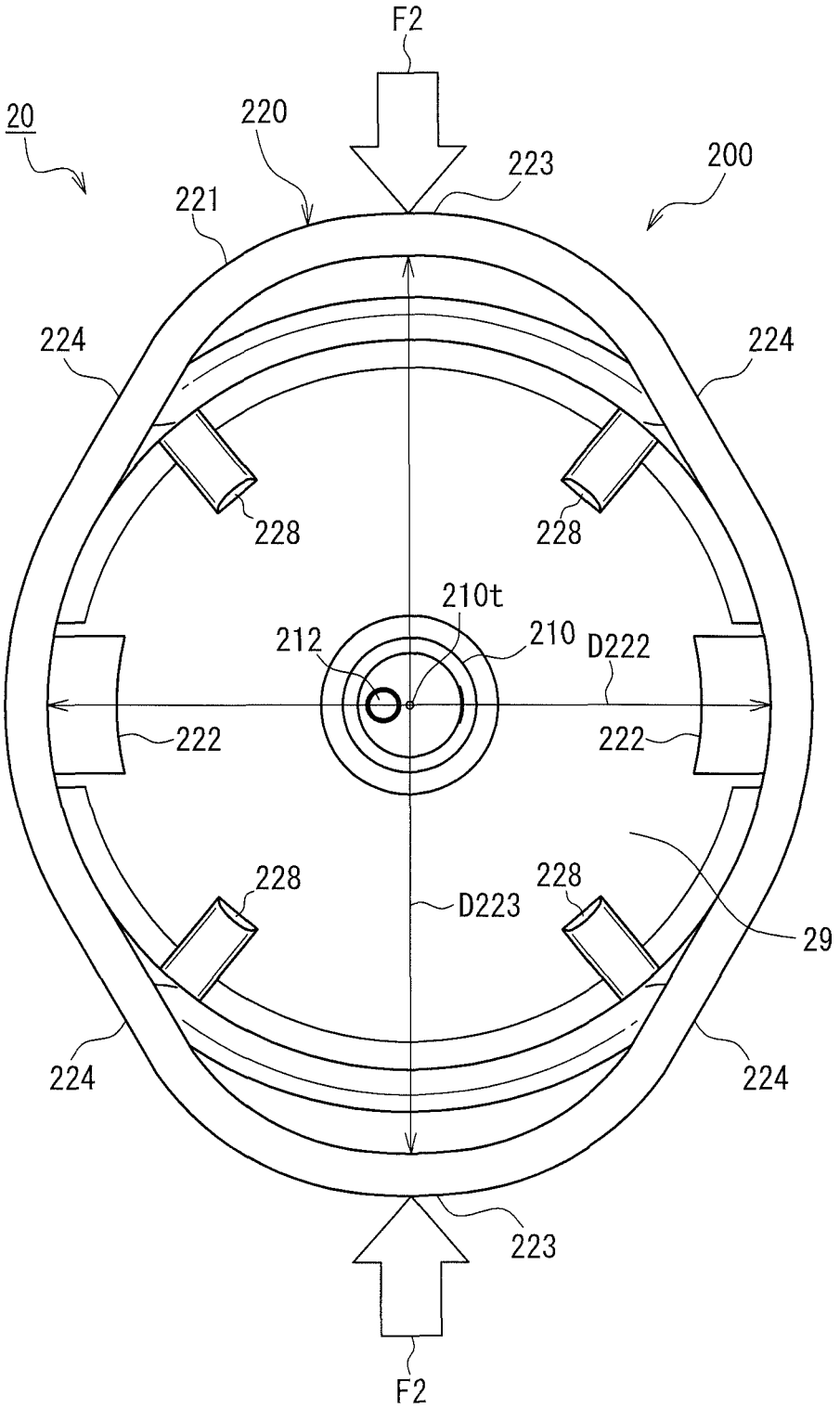
FIG. 12 is a bottom view of the second member in Embodiment 1 of the present invention.
Figure 13:
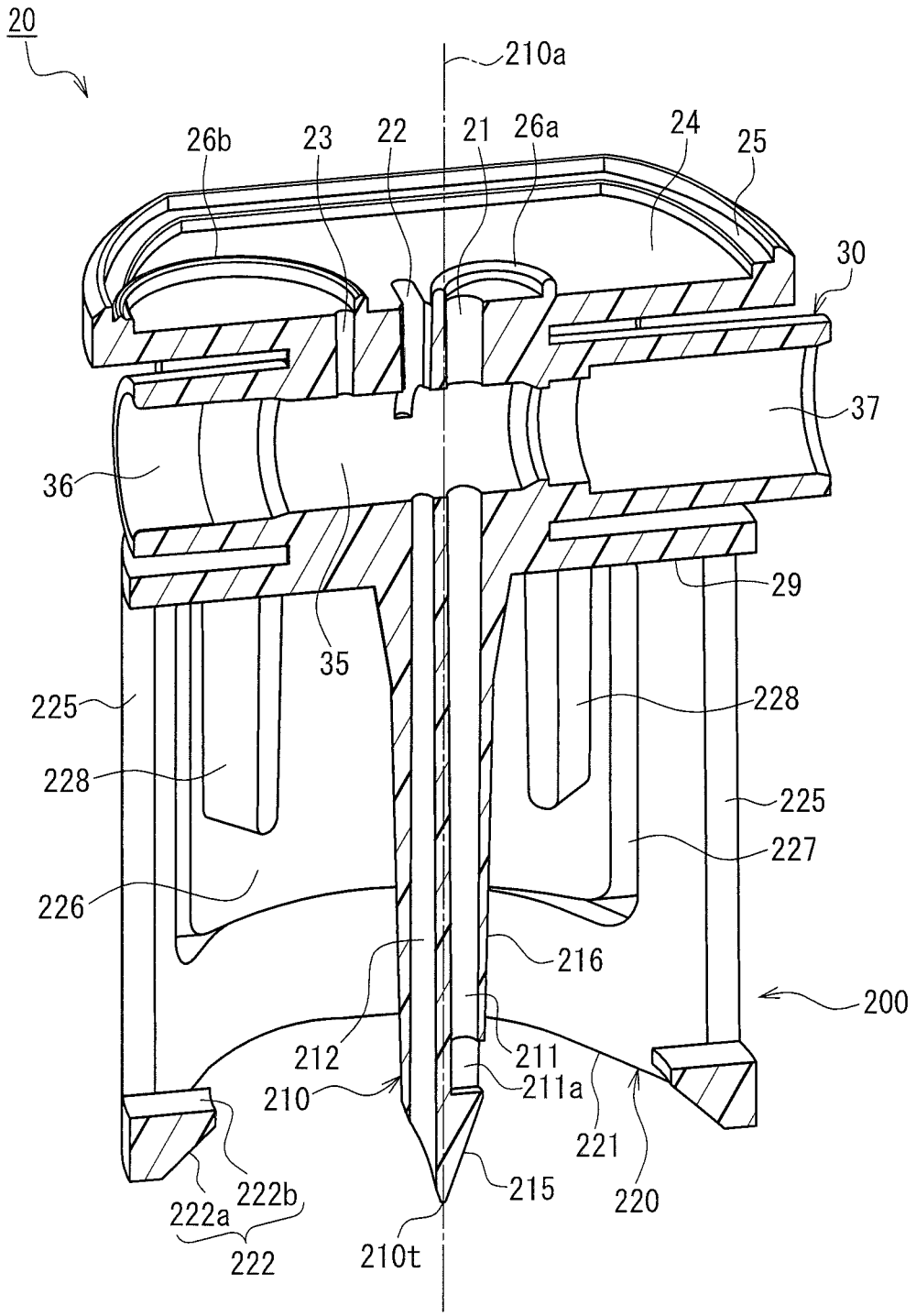
FIG. 13 is a cross-sectional perspective view of the second member in Embodiment 1 of the present invention.

FIG. 11 is a perspective view of the second member 20 that includes the second connector 200. FIG. 12 is a bottom view of the second member 20. FIG. 13 is a cross-sectional perspective view of the second member 20. The second connector 200 includes a bottle needle 210 as a second male member, which is for puncturing the rubber stopper 85 of the vial container 80 (see later-described FIG. 14). In FIG. 13, numeral 210*a* indicates the central axis of the bottle needle 210.

The bottle needle 210 is a bar-shaped member that protrudes from the center of a base 29 whose shape in a plan view is approximately circular. The bottle needle 210 includes a cone portion 215 having an outer face that is an approximately conical face (tapered face) in order to form a sharp tip 210*t*, and a columnar portion 216 that connects the cone portion 215 and the base 29. In the present embodiment, the outer circumferential face of the columnar portion 216 is a tapered face such that the outer diameter slightly decreases with increasing proximity to the cone portion 215. The taper angle of the outer circumferential face of the columnar portion 216 is smaller than the taper angle of the cone portion 215. Note that the shape of the outer circumferential face of the bottle needle 210 is not limited to this, and any configuration can be used. For example, the outer circumferential face of the columnar portion 216 may be a cylindrical face whose outer diameter is constant in the central axis 210*a* direction. In the present embodiment, the outer circumferential face of the columnar portion 216 is configured by two tapered faces having different taper angles, but it may be configured by one tapered face, or it may be configured by any combination of tapered faces and/or cylindrical faces. Furthermore, the outer circumferential face of the bottle needle 210 does not need to have a clear distinction between the cone portion 215 and the columnar portion 216, and it may be configured by, for example, a curved face such that the outer diameter changes smoothly as it extends from the tip 210*t* toward the base 29.

As shown in FIG. 13, two channels 211 and 212 that are approximately parallel to the central axis 210*a* are formed independent from each other in the bottle needle 210. The channel 211 is a liquid channel for the flow of a liquid, and the channel 212 is a gas channel for the flow of a gas. The liquid channel 211 is in communication with a lateral hole 211*a* on the tip 210*t* side. The lateral hole 211*a* extends along a direction orthogonal to the central axis 210*a* and is open at the outer circumferential face of the columnar portion 216. The gas channel 212 is open at the outer circumferential face of the cone portion 215 on the tip 210*t* side.

A hood 220 is provided upright on the base 29 on the same side as the bottle needle 210 so as to surround the bottle needle 210. The hood 220 includes, on the tip side thereof (the side farthest from the base 29), a ring-shaped portion 221 that is continuous in the circumferential direction (the direction of rotation about the bottle needle 210). The shape of the ring-shaped portion 221 in a plan view is approximately elliptical or approximately oblong. A pair of claws 222 are provided on the inner circumferential face of the ring-shaped portion 221. The pair of claws 222 oppose each other in the minor axis direction of the ring-shaped portion 221. The claws 222 protrude toward the bottle needle 210, and each include an inclined portion 222*a* on the tip side (the side opposite to the base 29) and an engaging portion 222*b* on the base 29 side. The inclined portion 222*a* is an inclined face that is inclined such that the distance to the bottle needle 210 increases with increasing distance from the base 29. The engaging portion 222*b* is a flat face that substantially extends along a plane orthogonal to the lengthwise direction of the bottle needle 210.

A pair of pressing portions 223 are provided on the ring-shaped portion 221 so as to oppose each other in a direction orthogonal to the direction in which the pair of claws 222 oppose each other (i.e., so as to oppose each other in the major axis direction of the ring-shaped portion 221).

As shown in FIG. 12, an inner dimension D223 of the ring-shaped portion 221 along the direction in which the pair of pressing portions 223 oppose each other is larger than an inner dimension (not including the claws 222) D222 of the ring-shaped portion 221 along the direction in which the pair of claws 222 oppose each other. The inner dimension D222 is approximately the same as or slightly larger than the outer diameter of the opening 82 and the rubber stopper 85 of the vial container 80 (see later-described FIGS. 15A and 15B) to which the second connector 200 is to be connected.

Connection portions 224 of the ring-shaped portion 221 connect the claws 222 and the pressing portions 223. The connection portions 224 are inclined relative to the minor axis direction and the major axis direction of the ring-shaped portion 221.

The ring-shaped portion 221 is fixed to the base 29 via four support members 225 that extend in the up-down direction from the vicinity of the claws 222. Note that the number of support members 225 does not need to be four, and two may be provided, for example.

A pair of holding plates 226 are provided upright on the base 29 between the pair of a pressing portion 223 of the ring-shaped portion 221 and the base 29. The pair of holding plates 226 oppose each other in the same direction as the direction in which the pair of pressing portions 223 oppose each other. Approximately "U" shaped slits 227 separate the holding plates 226 from the ring-shaped portion 221 and the support members 225. The faces of the pair of holding plates 226 on the side opposing each other are cylindrical faces, and their inner dimension approximately matches the outer diameter of the opening 82 and the rubber stopper 85 of the vial container 80 to which the second connector 200 is to be connected. Ribs 228 that extend in the up-down direction protrude toward the bottle needle 210 from the faces of the holding plates 226 on the side opposing the bottle needle 210. Although four ribs 228 are formed at equiangular intervals in the present example, the number of ribs 228 and their arrangement positions about the bottle needle 210 are not limited to this.

As shown in FIG. 12, since the inclined connection portions 224 connect the pressing portions 223 and the claws 222, when pressing force F2 in a direction in which the pair of pressing portions 223 approach each other is applied to the pair of pressing portions 223, the ring-shaped portion 221 undergoes elastic deformation such that the pair of claws 222 separate from each other. At this time, in accordance with the deformation of the ring-shaped portion 221, the support members 225 connected to the ring-shaped portion 221 also undergo elastic deformation in a direction in which the end portions on the side distant from the base 29 separate from the bottle needle 210. On the other hand, since the holding plates 226 are separated from the ring-shaped portion 221 and the support members 225 via the slits 227, the holding plates 226 undergo almost no deformation even if the ring-shaped portion 221 and the support members 225 undergo elastic deformation.

The above-described hood 220 including the ring-shaped portion 221 configure a second lock mechanism of the second connector 200.

It is preferable that the second member 20 including the second connector 200 and the tubular portion 30 is made of a hard material. Specifically, the second member 20 can be created by a method such as integral molding, using a resin material such as polyacetal, polycarbonate, polystyrene, polyamide, polypropylene, or rigid polyvinyl chloride.

The following describes a method for connecting the vial container 80 and the second connector 200 of Embodiment 1 configured as described above. In FIGS. 14 to 16A and 16B referenced in the following description, among the members configuring the connector 1, the members other than the second member 20 including the second connector 200 are not depicted in order to simplify the drawings.

Figure 14:
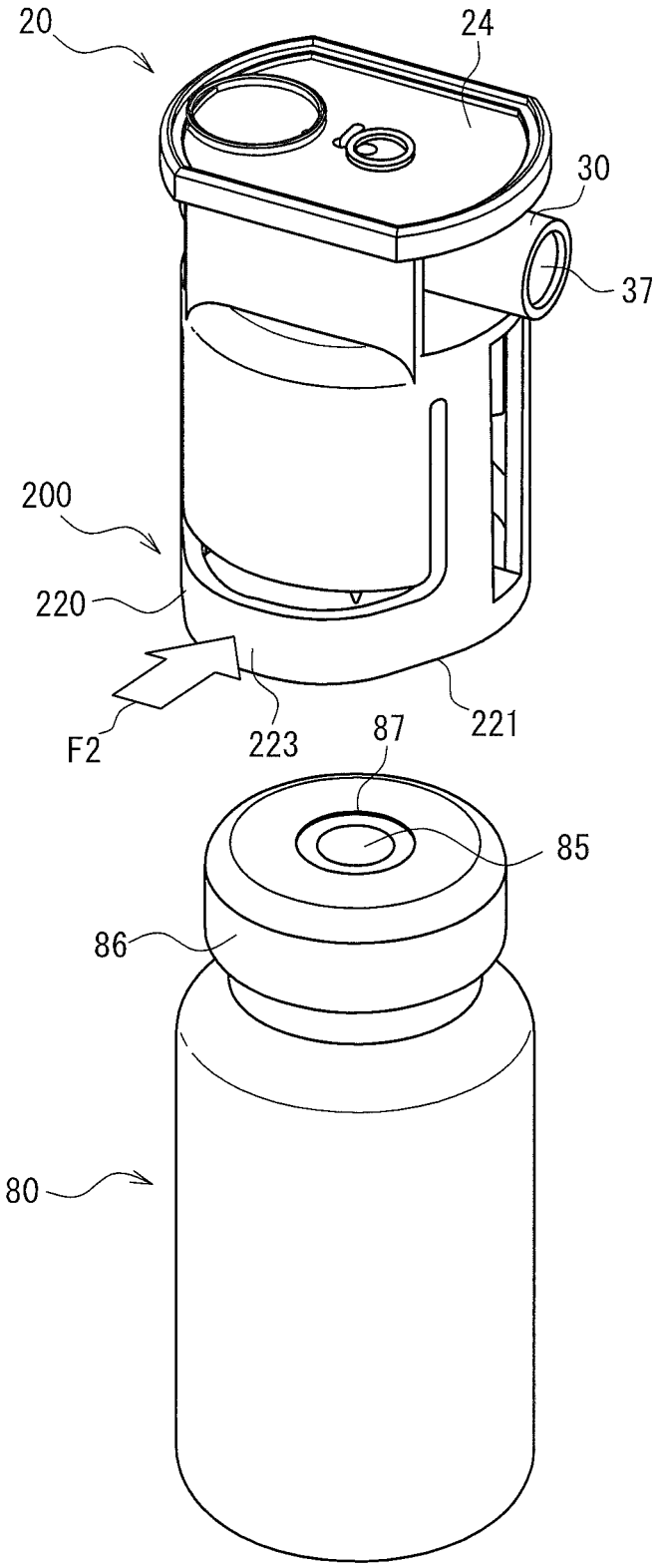
FIG. 14 is a perspective view of the second connector and a vial container immediately before connection in Embodiment 1 of the present invention.
Figure 15B:
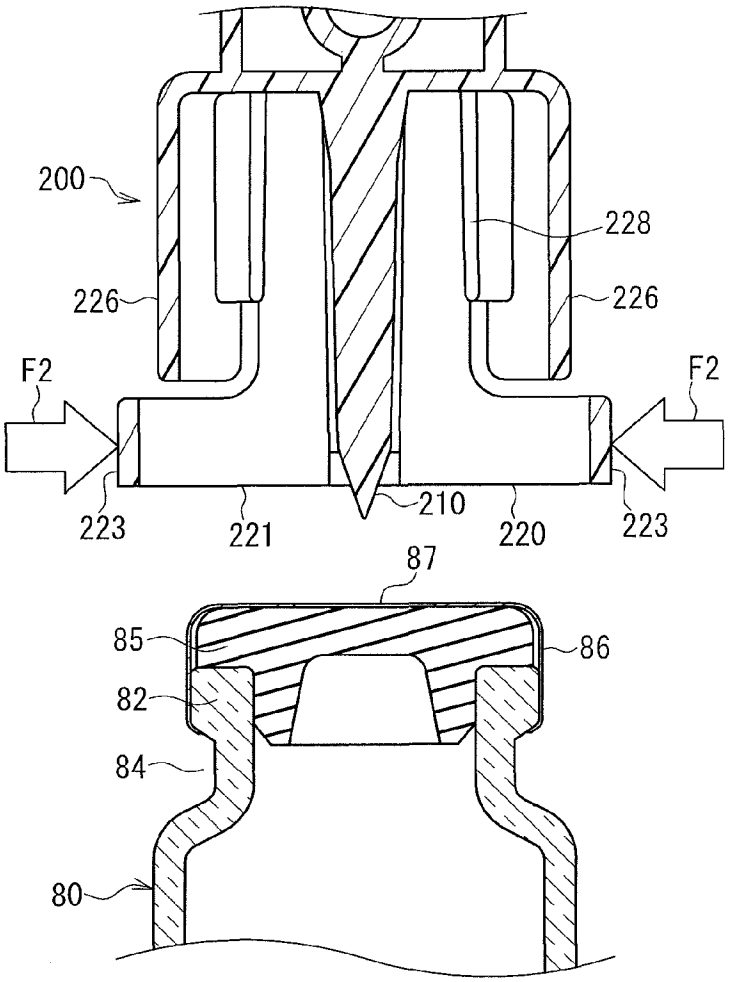
FIGS. 15A and 15B are cross-sectional views of the second connector and the vial container immediately before connection in Embodiment 1 of the present invention.
Figure 15A:
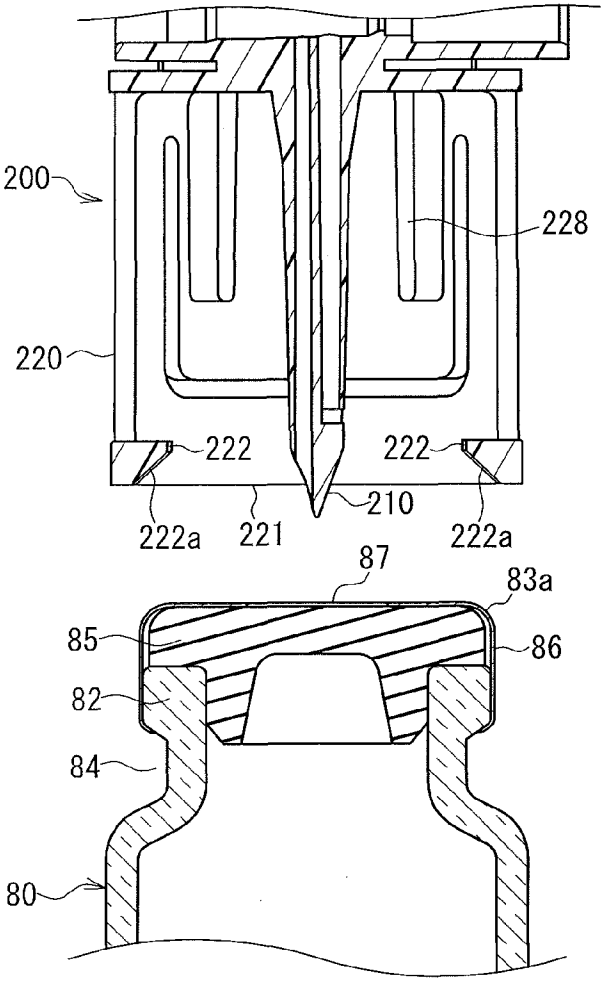

First, as shown in FIG. 14, the bottle needle 210 is placed in opposition to the rubber stopper 85 (second female connector) of the vial container 80. FIGS. 15A and 15B are cross-sectional views showing this state. The cross-section in FIG. 15A passes through the pair of claws 222, and the cross-section in FIG. 15B passes through the pair of pressing portions 223.

The rubber stopper 85 is mounted to the opening 82 of the vial container 80, and thus the vial container 80 is sealed. A cap 86 is mounted to the opening 82 and the rubber stopper 85 in order to prevent the rubber stopper 85 from coming out of the opening 82. An opening 87 is formed in the center of the cap 86, and the rubber stopper 85 is exposed in this opening 87.

The vial container 80 is held with one hand, and the hood 220 is held with the other hand. The pressing force F2 is applied to the pair of pressing portions 223 using two fingers such that the pair of pressing portions 223 approach each other, thus widening the gap between the pair of claws 222.

In this state, the bottle needle 210 is pressed into the rubber stopper 85 exposed in the opening 87, and pushed toward the vial container 80. The bottle needle 210 punctures the rubber stopper 85 and passes through it. At the same time, the rubber stopper 85 and the opening 82 of the vial container 80 are inserted into the ring-shaped portion 221 of the hood 220. At this time, an edge 83*a* on the upper side (hood 220 side) of the rubber stopper 85 can possibly collide with the inclined portions 222*a* of the claws 222. However, since the gap between the pair of claws 222 has already been widened by applying the pressing force F2 to the pair of pressing portions 223, by merely applying slightly more force for pushing the hood 220 toward the vial container 80, the ring-shaped portion 221 undergoes elastic deformation such that the gap between the pair of claws 222 widens, and the claws 222 pass over the edge 83*a*.

Figure 16B:
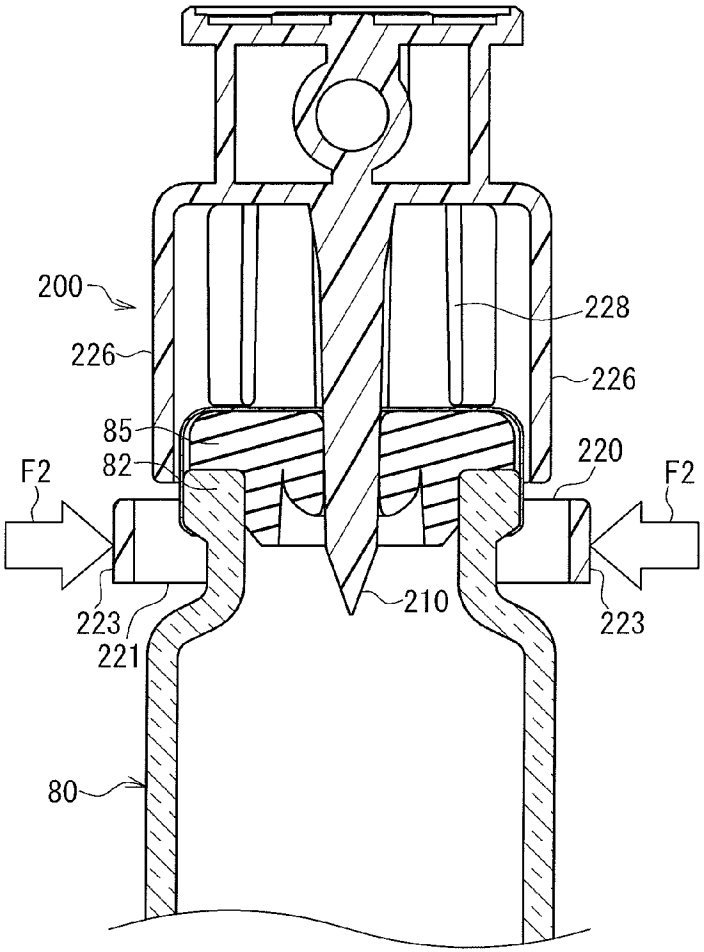
FIGS. 16A and 16B are cross-sectional views of the second connector and the vial container in the connected state in Embodiment 1 of the present invention.
Figure 16A:
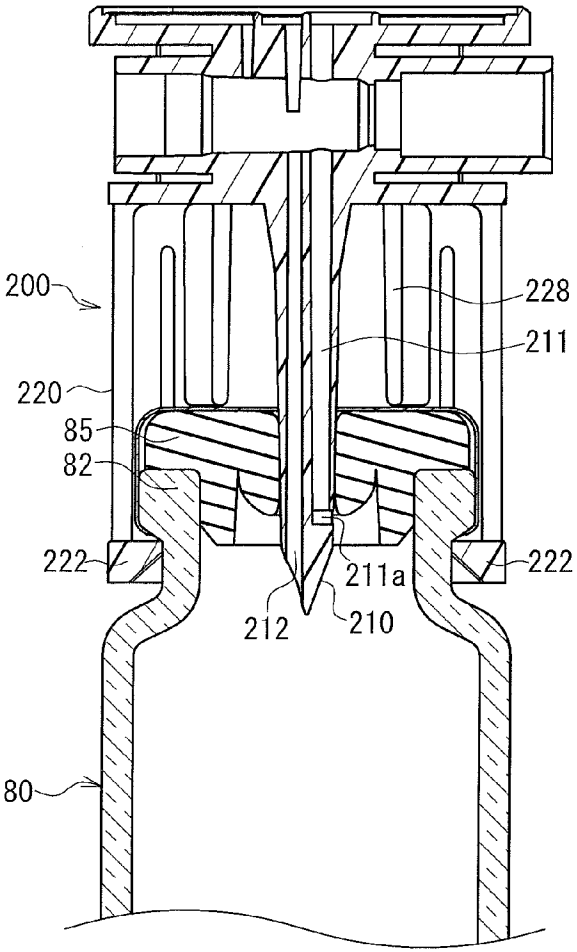

After the claws 222 have passed the opening 82 of the vial container 80, if the application of the pressing force F2 to the pressing portions 223 is stopped, the ring-shaped portion 221 undergoes elastic restoration, and thus the claws 222 fit into a constricted portion 84 below the opening 82, and the claws 222 engage with the opening 82. FIGS. 16A and 16B are cross-sectional views showing this state. The cross-sections in FIGS. 16A and 16B are the same as the cross-sections in FIGS. 15A and 15B respectively. The rubber stopper 85 and the opening 82 have been inserted between the pair of holding plates 262. Tips 228*a* of the ribs 228 (see FIG. 11) have been contacted with the upper face of the rubber stopper 85.

As shown in FIGS. 16A and 16B, the bottle needle 210 has passed through the rubber stopper 85. The lateral hole 211*a* and the gas channel 212 that are open on the tip 210*t* side of the bottle needle 210 are exposed inside the vial container 80. In this state, via the liquid channel 211 and the lateral hole 211*a*, a liquid can be caused to flow into the vial container 80 and a liquid in the vial container 80 can be caused to flow out from the vial container 80. When a liquid flows into or out of the vial container 80, air flows into or out of the vial container 80 via the gas channel 212. This reduces variation in the air pressure in the vial container 80, and facilitates the inflow and outflow of the liquid.

The second connector 200 and the vial container 80 are separated while holding the vial container 80 with one hand and holding the hood 220 with the other hand, similarly to when connecting the second connector 200 and the vial container 80. At this time, the pressing force F2 is applied to the pair of pressing portion 223 using two fingers such that the pair of pressing portions 223 approach each other, thus widening the gap between the pair of claws 222. The engagement between the claws 222 and the opening 82 thus is canceled. Thereafter, it is sufficient to apply force to the second connector 200 and the vial container 80 in the direction of separating from each other. When the bottle needle 210 is withdrawn from the rubber stopper 85, the hole through which the bottle needle 210 punctured the rubber stopper 85 closes immediately.

As described above, according to the second connector 200 of the present embodiment, the pair of claws 222 engage with the opening 82 of the vial container 80 in the state in which the bottle needle 210 has punctured the rubber stopper 85. Accordingly, the bottle needle 210 is prevented from unintentionally coming out of the rubber stopper 85.

When the pressing force F2 in a direction in which the pair of pressing portions 223 approach each other is applied to the pair of pressing portions 223, the ring-shaped portion 221 undergoes elastic deformation such that the pair of claws 222 separate from each other. Accordingly, when the bottle needle 210 punctures the rubber stopper 85, and when the bottle needle 210 that has punctured the rubber stopper 85 is withdrawn from the rubber stopper 85, the gap between the pair of claws 222 is widened by pressing the pair of pressing portions 223 while holding the hood 220. Accordingly, the attachment of the second connector 200 to the opening 82 of the vial container 80 and removal therefrom can be performed easily.

When the second connector 200 is attached to the opening 82, the rubber stopper 85 and the opening 82 are inserted between the pair of holding plates 226 of the hood 220. Since the holding plates 226 are separated from the ring-shaped portion 221 and the support member 225 via the slits 227, the gap between the pair of holding plates 226 is constant regardless of deformation of the ring-shaped portion 221. Also, the ribs 228 extending from the base 29 improve the rigidity of the holding plates 226. Accordingly, the orientation of the ring-shaped portion 221 and the bottle needle 210 relative to the rubber stopper 85 and the opening 82 is corrected due to the rubber stopper 85 and the opening 82 of the vial container 80 being inserted between the pair of holding plates 226. This is advantageous in stably engaging the claws 222 to the opening 82.

Furthermore, the insertion depth of the bottle needle 210 in the rubber stopper 85 is restricted due to the tips (contact portions) 228*a* of the ribs 228 colliding with the upper face of the rubber stopper 85. Also, the inclination of the ring-shaped portion 221 and the bottle needle 210 relative to the rubber stopper 85 can be reduced. Also, the vial container 80 can be sandwiched and held in the up-down direction (the direction of the central axis 210*a* of the bottle needle 210) between the tips 228*a* of the ribs 228 and the claws 222. These are advantageous in stably engaging the claws 222 with the opening 82. Furthermore, it is possible to reduce the possibility of an operation error in which the hood 220 (the ring-shaped portion 221 in particular) is damaged due to the rubber stopper 85 mistakenly being inserted too deep in the hood 220.

The liquid channel 211 of the bottle needle 210 is not open at the outer circumferential face of the cone portion 215, and the lateral hole 211*a* in communication with the liquid channel 211 is open at the outer circumferential face of the columnar portion 216. When the bottle needle 210 that has passed through the rubber stopper 85 is withdrawn from the rubber stopper 85 at a later time, liquid attached to the periphery of the opening of the lateral hole 211*a* is likely to be scraped away by the rubber stopper 85, and therefore the above configuration is advantageous in reducing the amount of liquid that remains in the periphery of the opening of the lateral hole 211*a* after withdrawal from the rubber stopper 85.

Tubular Portion 30 and Peripheral Members

As shown in FIGS. 11, 13, and 14, the tubular portion 30 as well as the second connector 200 is provided integrally to the second member 20.

As shown in FIG. 13, the tubular portion 30 has a substantially tubular shape with openings at the two ends, and the inner circumferential face thereof is a substantially cylindrical face. One end portion of the tubular portion 30 is a stopcock holding portion 36 for insertion of the insertion portion 46 (see FIG. 3) of the stopcock 40, and the other end portion is a syringe connection portion 37 for insertion of the tube 99 (see FIG. 1) connected to the tip of the syringe 90.

A connection plate 24 for connection to the first member 10 is provided on the side opposite to the second connector 200 relative to the tubular portion 30. A first hole 21, a second hole 22, and a third hole 23 connect the inner cavity 35 of the tubular portion 30 and the connection plate 24. The liquid channel 211 and the gas channel 212 of the bottle needle 210 are in communication with the inner cavity 35 of the tubular portion 30. On the inner circumferential face of the tubular portion 30, the first hole 21 and the liquid channel 211 are open at positions opposing each other, and the second hole 22 and the gas channel 212 are open at positions opposing each other.

As shown in FIG. 13, on the upper face of the connection plate 24 (the face on the side opposing the first member 10), an outer circumferential sealing protruding portion 25, a first sealing protruding portion 26*a*, and a second sealing protruding portion 26*b* protrude from the connection plate 24. The outer circumferential sealing protruding portion 25 has the shape of a ring that approximates the track of an athletic field, and is formed so as to substantially conform to the outer edge of the connection plate 24. The first sealing protruding portion 26*a* is formed in a region surrounded by the outer circumferential sealing protruding portion 25, and has the shape of a ring that surrounds the opening of the first hole 21. The second sealing protruding portion 26*b* is formed in a region surrounded by the outer circumferential sealing protruding portion 25, and has the shape of a ring that surrounds the opening of the third hole 23. The opening of the second hole 22 on the connection plate 24 side is in a region surrounded by the outer circumferential sealing protruding portion 25, and is positioned outside the region surrounded by the first sealing protruding portion 26*a* and outside the region surrounded by the second sealing protruding portion 26*b*.

Hydrophobic Filter 50

As shown in FIG. 3, the hydrophobic filter 50 is a sheet-like object whose outer shape substantially conforms to the outer circumferential sealing protruding portion 25. A through-hole 51 is formed in a region that corresponds to the region surrounded by the first sealing protruding portion 26*a*. The hydrophobic filter 50 has a hydrophobic property and a gas permeation property. Specifically, it has the property of substantially not allowing liquids to pass, while allowing gases to pass. Furthermore, the water bearing pressure, which is measured using a water bearing pressure test defined in JIS L 1092 method B, is preferably 0.01 MPa or more, and more preferably 0.1 MPa or more. Although there are no particular limitations on the material of the hydrophobic filter 50, examples include polytetrafluoroethylene (PTFE), polyolefin (polypropylene, polyethylene, etc.), polyvinylidene fluoride, and acrylic copolymer. It is preferable that the hydrophobic filter 50 is a flat membrane filter having a porous layer or non-woven cloth including any of these materials.

Figure 17:
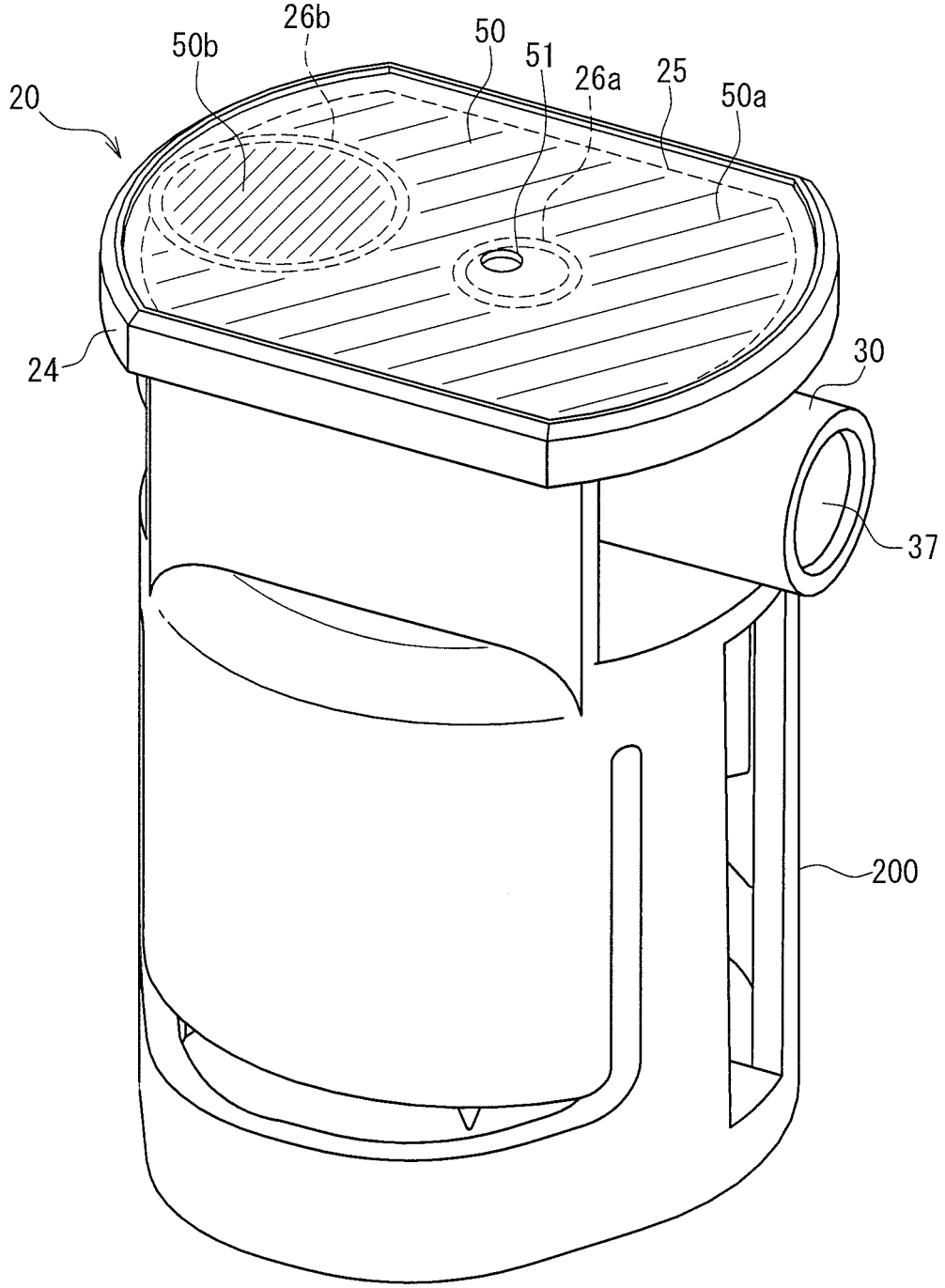
FIG. 17 is a perspective view showing a hydrophobic filter attached to the first member in the medical connector according to Embodiment 1 of the present invention.

As shown in FIG. 17, the hydrophobic filter 50 is connected to the apex portions of the outer circumferential sealing protruding portion 25, the first sealing protruding portion 26*a*, and the second sealing protruding portion 26*b*. Although there are no particular limitations on the method for connecting the hydrophobic filter 50, it is possible to use welding (e.g., heat sealing or ultrasonic welding) for example. The portion of the hydrophobic filter 50 that is outward of the first sealing protruding portion 26*a* and the second sealing protruding portion 26*b* and surrounded by the outer circumferential sealing protruding portion 25 is called a first hydrophobic filter 50*a*. Also, the portion of the hydrophobic filter 50 that is surrounded by the second sealing protruding portion 26*b* is called a second hydrophobic filter 50*b*. In other words, in the present embodiment, the first hydrophobic filter 50*a* and the second hydrophobic filter 50*b* are provided in a single common member (the hydrophobic filter 50).

Cock 40

Figure 18:
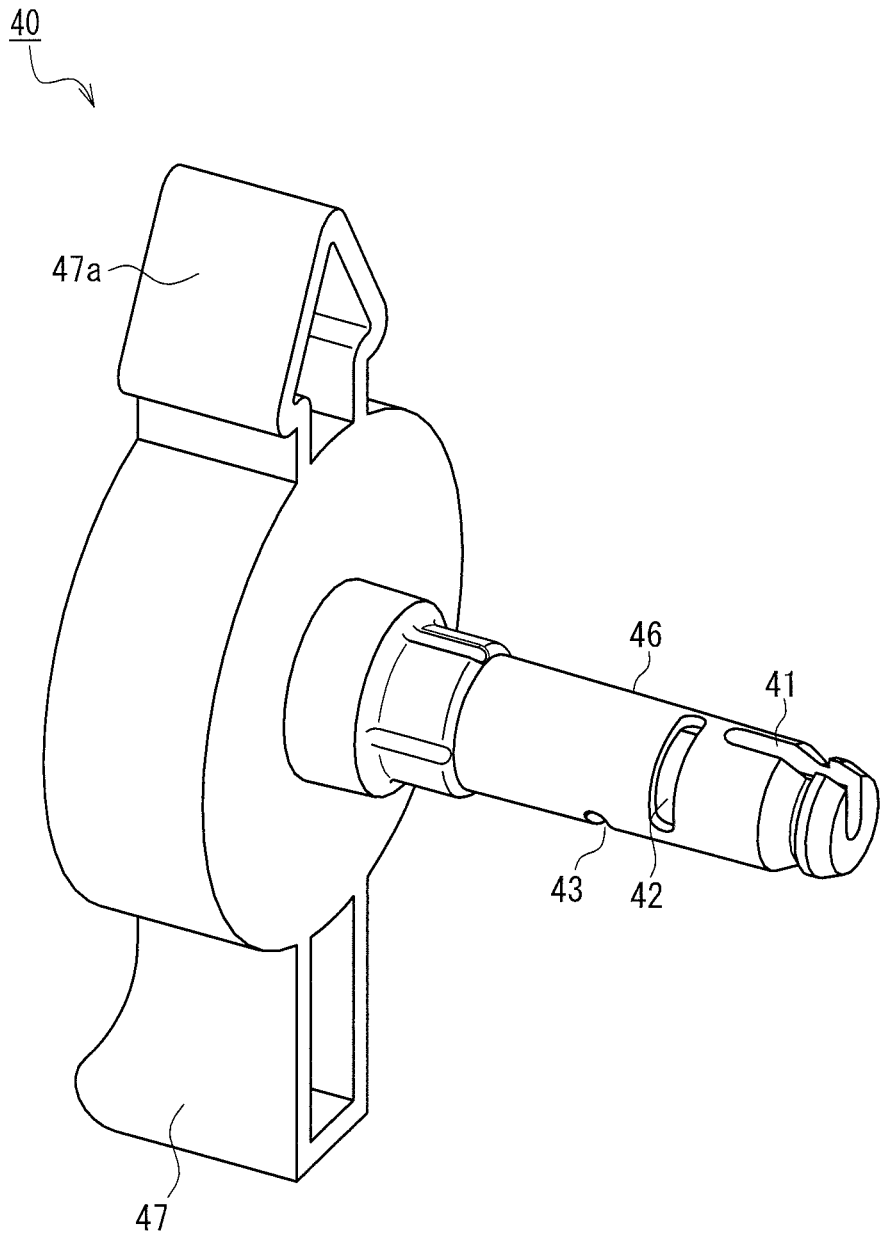
FIG. 18 is a perspective view of a stopcock constituting a part of the medical connector according to Embodiment 1 of the present invention.
Figure 19B:
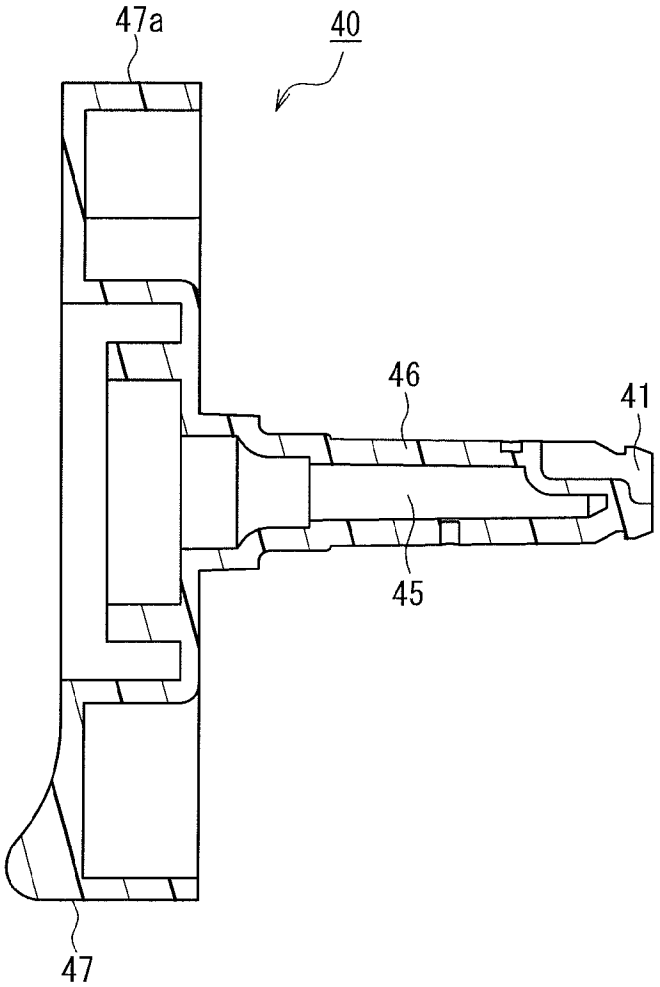
FIG. 19B is a cross-sectional view of the stopcock constituting a part of the medical connector according to Embodiment 1 of the present invention.
Figure 19A:
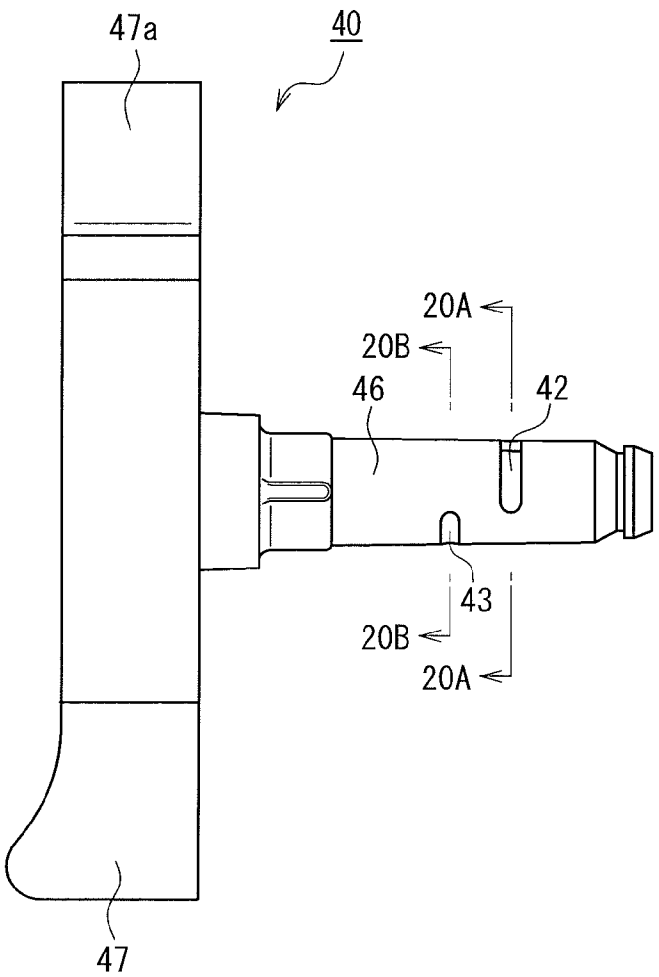
FIG. 19A is a side view of the stopcock constituting a part of the medical connector according to Embodiment 1 of the present invention.

FIG. 18 is a perspective view of the stopcock 40, FIG. 19A is a side view of the stopcock 40, and FIG. 19B is a cross-sectional view of the stopcock 40.

The stopcock 40 includes the insertion portion 46 that is inserted into the tubular portion 30, and the operation portion 47. The insertion portion 46 that has a substantially cylindrical outer circumferential face is connected at a right angle to the approximate center of the operation portion 47 in the lengthwise direction, so as to form an approximate "T" shape when viewed from the side (see FIG. 19A).

As shown in FIG. 19B, the insertion portion 46 is shaped as a hollow cylinder, is closed on the tip side (the side opposite to the operation portion 47), and is open on the operation portion 47 side. The hollow portion of the insertion portion 46 is called the inner cavity 45 of the stopcock 40 in the present invention.

As shown in FIG. 18, a first channel 41, a second channel 42, and a third channel 43 are formed in the insertion portion 46.

The first channel 41 is a channel that connects the tip face of the insertion portion 46 (the face of the insertion portion 46 on the side opposite to the operation portion 47) and the outer circumferential face of the insertion portion 46. As shown in FIG. 19B, the first channel 41 is not in communication with the inner cavity 45 of the stopcock 40. Although the first channel 41 is a groove formed in the outer face of the insertion portion 46 in the present example, it may be a through-hole that connects the tip face and the outer circumferential face of the insertion portion 46, as long as it is not in communication with the inner cavity 45.

Figure 20B:
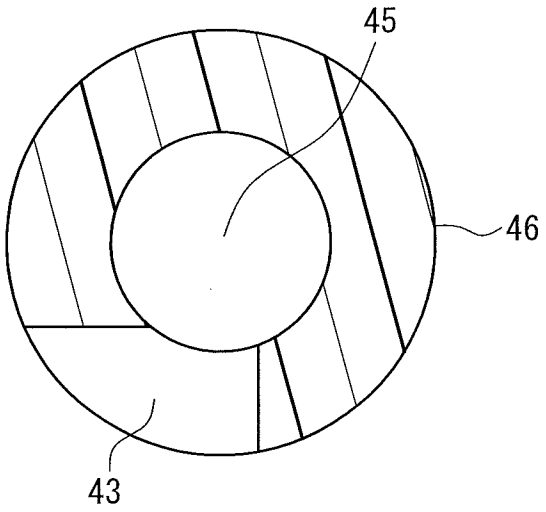
FIG. 20B is an end view of the stopcock taken along a plane including a line 20B-20B in FIG. 19A.
Figure 20A:
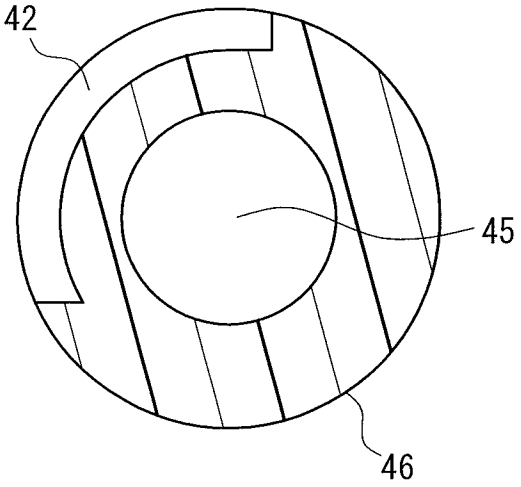
FIG. 20A is an end view of the stopcock taken along a plane including a line 20A-20A in FIG. 19A.

FIG. 20A is an end view of the stopcock 40 taken along a plane that passes through the second channel 42 and includes a line 20A-20A in FIG. 19A. The operation portion 47 and the like that are visible behind the cross-section are not shown in FIG. 20A in order to simplify the drawing. As can be understood from FIG. 20A, the second channel 42 is a groove that is formed in the outer circumferential face of the insertion portion 46 and extends along the circumferential direction of the insertion portion 46. The second channel 42 is not continuous over the entire circumference of the insertion portion 46, and is not in communication with the inner cavity 45 of the stopcock 40. Although the second channel 42 is a groove formed in the outer circumferential face of the insertion portion 46 in the present example, it may be a through-hole that passes through the insertion portion 46, as long as it is not in communication with the inner cavity 45.

FIG. 20B is an end view of the stopcock 40 taken along a plane that passes through the third channel 43 and includes a line 20B-20B in FIG. 19A. The operation portion 47 and the like that are visible behind the cross-section are not shown in FIG. 20B in order to simplify the drawing. As can be understood from FIG. 20B, the third channel 43 is an elongated hole that extends along the circumferential direction of the insertion portion 46. The third channel 43 puts the inner cavity 45 of the insertion portion 46 and the outside in communication. Although the third channel 43 is an elongated hole that extends in the circumferential direction of the insertion portion 46 in the present example, the third channel 43 may have any shape as long as the later-described functionality of the third channel 43 is exhibited, and may be circular, elliptical, or the like.

As shown in FIG. 18, an arrowhead shape 47*a* is formed at one end of the operation portion 47. The direction of the tip of the arrowhead shape 47*a* matches the direction of the first channel 41 formed in the outer circumferential face of the insertion portion 46. The operator can find out the direction of the first channel 41 based on the direction of the arrowhead shape 47*a* when the insertion portion 46 has been inserted into the tubular portion 30 of the second member 20.

It is preferable that the stopcock 40 is made of a hard material. Specifically, the stopcock 40 can be created with a method such as integral molding, using a resin material such as polyacetal, polycarbonate, polystyrene, polyamide, polypropylene, or rigid polyvinyl chloride.

The air supplying member 410 is attached to the stopcock 40 in order to airtightly block the opening of the insertion portion 46 on the operation portion 47 side (see FIG. 3 and later-described FIGS. 21 and 23). The air supplying member 410 is dome-shaped (or hemispherical or bowl-shaped). The air supplying member 410 is flexible and has rubber elasticity, and the convex bulge can be flattened easily when pressing force is applied (see later-described FIG. 30), and immediately returns to its initial state when the pressing force is canceled. There are no particular limitations on the material for the air supplying member 410, and examples of materials that can be used include silicone rubber, isoprene rubber, butyl rubber, olefinic elastomer, styrene elastomer, polyurethane, and soft polyvinyl chloride.

The insertion portion 46 of the stopcock 40 is inserted into the opening of the tubular portion 30 on the stopcock holding portion 36 (see FIG. 13) side. FIG. 21 is a cross-sectional perspective view of the connector 1. In FIGS. 1, 2A, 2B, and 21, the arrowhead shape 47*a* of the stopcock 40 is oriented on the first connector 100 side. In the present invention, this direction (orientation) of the stopcock 40 is referred to as the "first rotation position".

Figure 21:
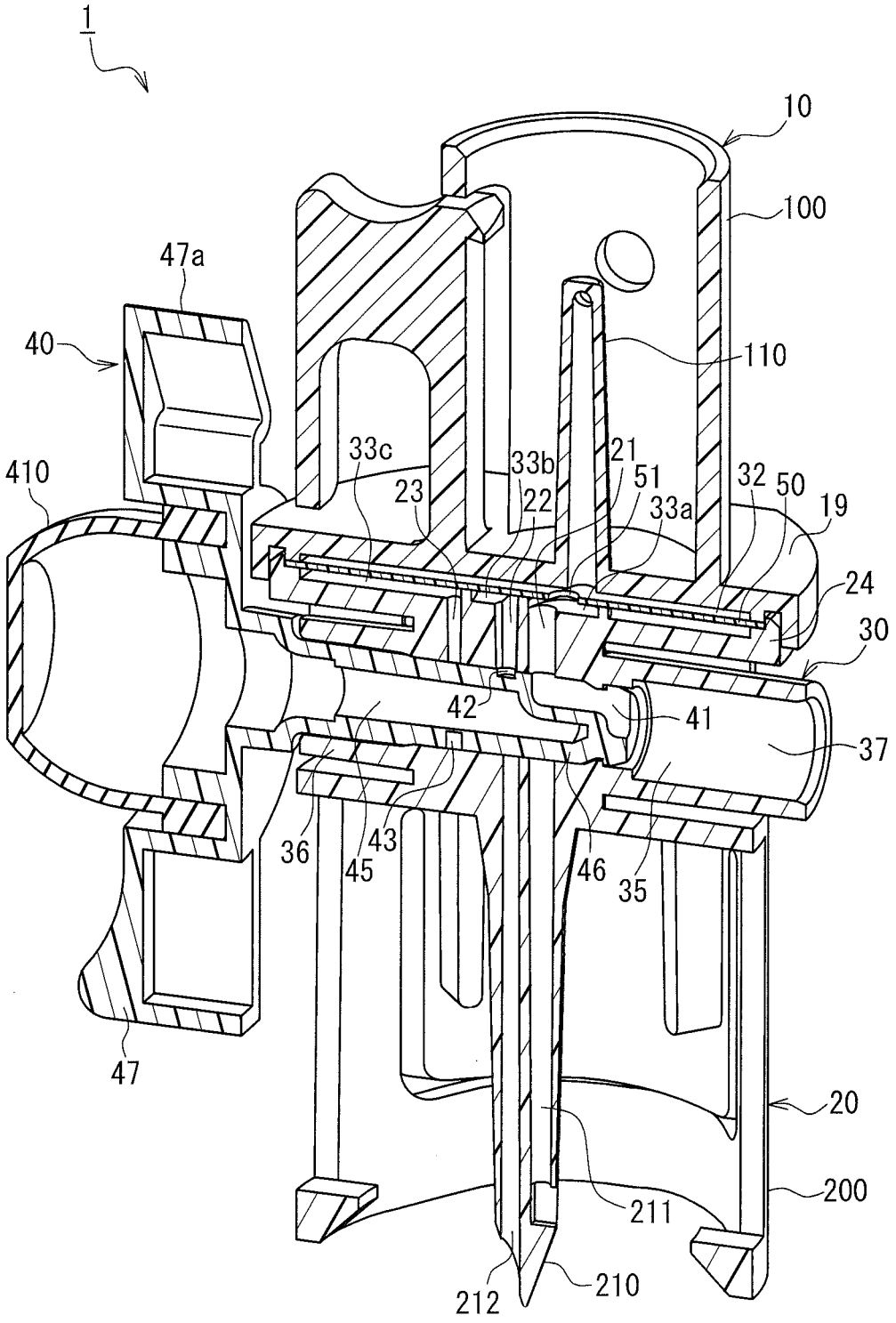
FIG. 21 is a cross-sectional perspective view of the medical connector according to the Embodiment 1 of the present invention, in which the stopcock is at a first rotation position.

As shown in FIG. 21, the base 19 of the first member 10 and the connection plate 24 of the second member 20 are connected via the hydrophobic filter 50. The space enclosed by the base 19 and the hydrophobic filter 50 is referred to as a bag-side space 32. The bag-side space 32 is in communication with the male luer 110.

The space enclosed by the connection plate 24, the first sealing protruding portion 26*a* (see FIG. 13), and the hydrophobic filter 50 is referred to as a bottle-side first space 33*a*. The bottle-side first space 33*a* is in communication with the bag-side space 32 via the through-hole 51 formed in the hydrophobic filter 50. Furthermore, the bottle-side first space 33*a* is in communication with the first hole 21.

The space enclosed by the connection plate 24, the second sealing protruding portion 26*b* (see FIG. 13), and the hydrophobic filter 50 is referred to as a bottle-side third space 33*c*. The bottle-side third space 33*c* is the space that corresponds to the second hydrophobic filter 50*b* in the hydrophobic filter 50 (see FIG. 17). The bottle-side third space 33*c* is in communication with the third hole 23.

The space enclosed by the connection plate 24, the outer circumferential sealing protruding portion 25 (see FIG. 13), and the hydrophobic filter 50 (particularly the first hydrophobic filter 50*a* (see FIG. 17)) is referred to as a bottle-side second space 33*b*. The bottle-side second space 33*b* is the space that corresponds to the first hydrophobic filter 50*a* in the hydrophobic filter 50 (see FIG. 17). The bottle-side second space 33*b* refers to the space excluding the bottle-side first space 33*a* and the bottle-side third space 33*c* in the space between the connection plate 24 and the hydrophobic filter 50. The bottle-side second space 33*b* is in communication with the second hole 22.

The bag-side space 32 opposes the bottle-side first space 33*a*, the bottle-side second space 33*b*, and the bottle-side third space 33*c* via the hydrophobic filter 50.

When the stopcock 40 is at the first rotation position, the first channel 41 of the stopcock 40 puts the first hole 21 and the inner cavity 35 of the tubular portion 30 (the syringe connection portion 37 in particular) in communication. As a result, the male luer 110 is in communication with the inner cavity 35 of the tubular portion 30 (the syringe connection portion 37 in particular) via the bag-side space 32, the through-hole 51 of the hydrophobic filter 50, the bottle-side first space 33*a*, the first hole 21, and the first channel 41 in the stated order. On the other hand, the opening of the liquid channel 211 on the inner circumferential face side of the tubular portion 30 is blocked by the outer circumferential face of the insertion portion 46 of the stopcock 40 inserted into the tubular portion 30.

Figure 22B:
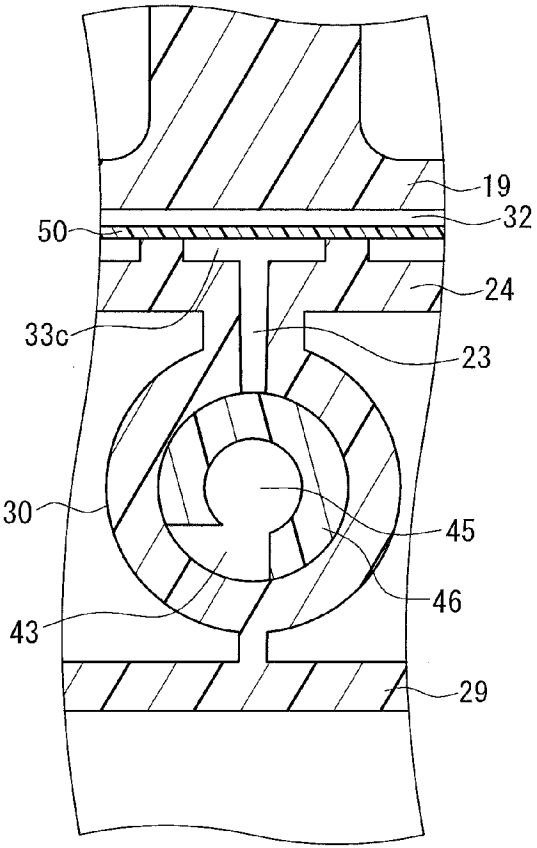
FIG. 22B is a cross-sectional view of the stopcock and the periphery thereof taken along a plane that passes through a third channel of the stopcock, in the medical connector according to the Embodiment 1 of the present invention, in which the stopcock is at the first rotation position.
Figure 22A:
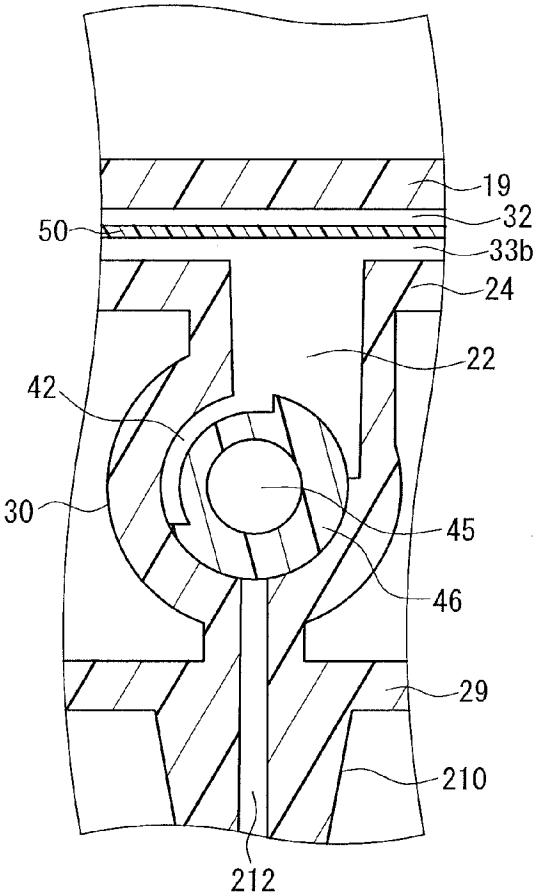
FIG. 22A is a cross-sectional view of the stopcock and the periphery thereof taken along a plane that passes through a second channel of the stopcock, in the medical connector according to the Embodiment 1 of the present invention, in which the stopcock is at the first rotation position.

FIG. 22A is an enlarged cross-sectional view of the stopcock 40 and the periphery thereof taken along a plane that passes through the second channel 42 of the stopcock 40. As can be understood from FIG. 22A, when the stopcock 40 is at the first rotation position, the outer circumferential face of the insertion portion 46 of the stopcock 40 inserted into the tubular portion 30 blocks the opening of the gas channel 212 on the inner circumferential face side of the tubular portion 30. Accordingly, the second hole 22 and the gas channel 212 that oppose each other are not in communication with each other.

FIG. 22B is an enlarged cross-sectional view of the stopcock 40 and the periphery thereof taken along a plane that passes through the third channel 43 of the stopcock 40. As can be understood from FIG. 22B, when the stopcock 40 is at the first rotation position, the outer circumferential face of the insertion portion 46 of the stopcock 40 inserted into the tubular portion 30 blocks the opening of the third hole 23 on the inner circumferential face side of the tubular portion 30. Accordingly, the third hole 23 and the inner cavity 45 of the stopcock 40 are not in communication with each other.

Figure 23:
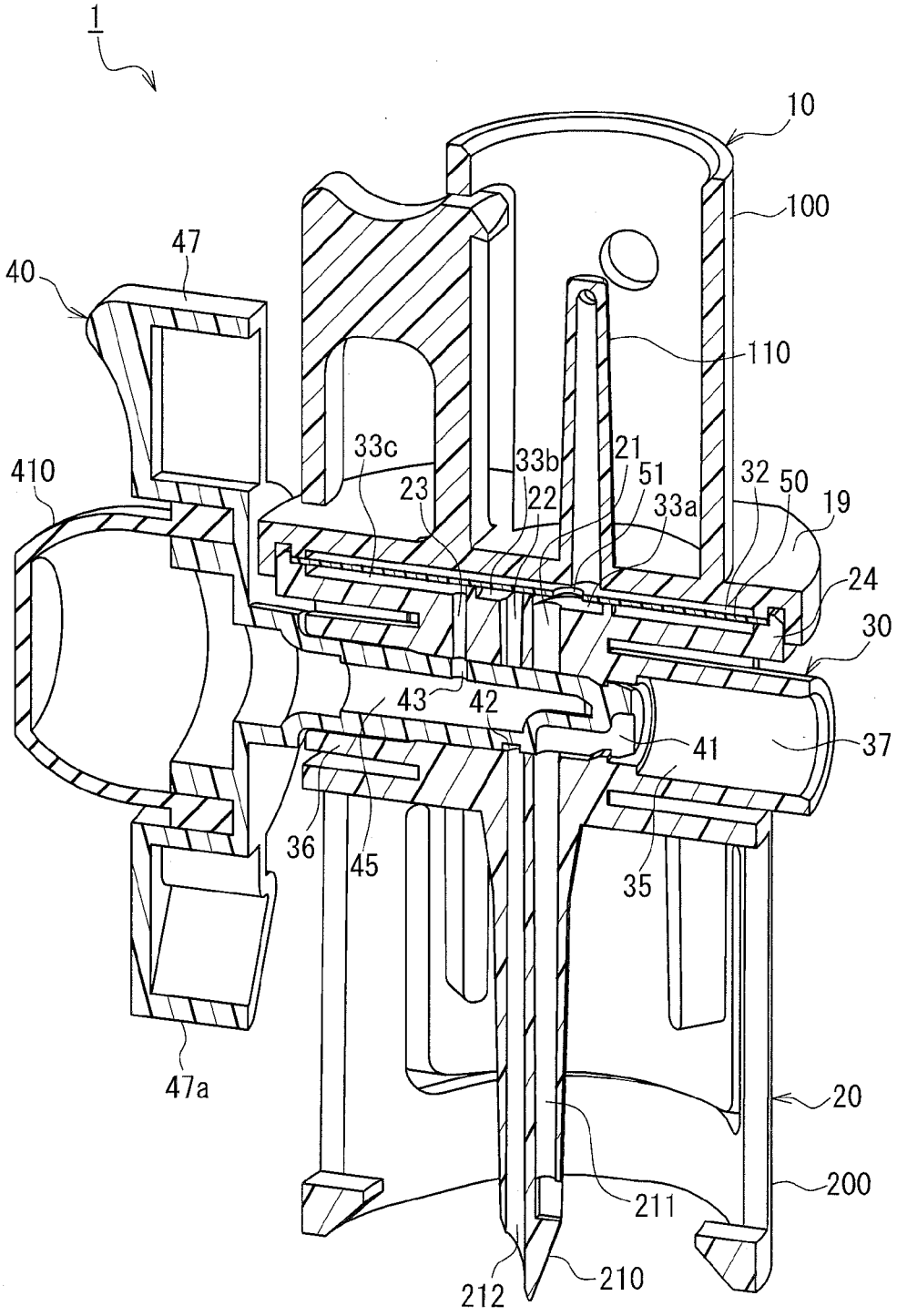
FIG. 23 is a cross-sectional perspective view of the medical connector according to the Embodiment 1 of the present invention, in which the stopcock is at a second rotation position.

FIG. 23 is a cross-sectional perspective view of the connector 1. In FIG. 23, the arrowhead shape 47*a* of the stopcock 40 is oriented on the second connector 200 side, and this point is different from FIG. 21 described above. In the present invention, this direction (orientation) of the stopcock 40 is referred to as the "second rotation position".

When the stopcock 40 is at the second rotation position, the first channel 41 of the stopcock 40 puts the liquid channel 211 and the inner cavity 35 of the tubular portion 30 (the syringe connection portion 37 in particular) in communication. The opening of the first hole 21 on the inner circumferential face side of the tubular portion 30 is blocked by the outer circumferential face of the insertion portion 46 of the stopcock 40 inserted into the tubular portion 30.

Figure 24B:
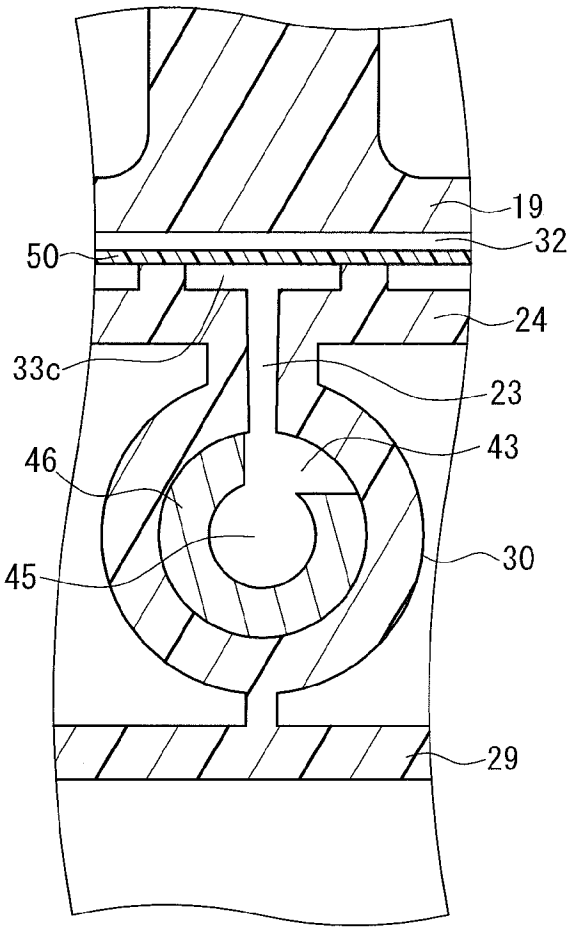
FIG. 24B is a cross-sectional view of the stopcock and the periphery thereof taken along a plane that passes through the third channel of the stopcock, in the medical connector according to the Embodiment 1 of the present invention, in which the stopcock is at the second rotation position.
Figure 24A:
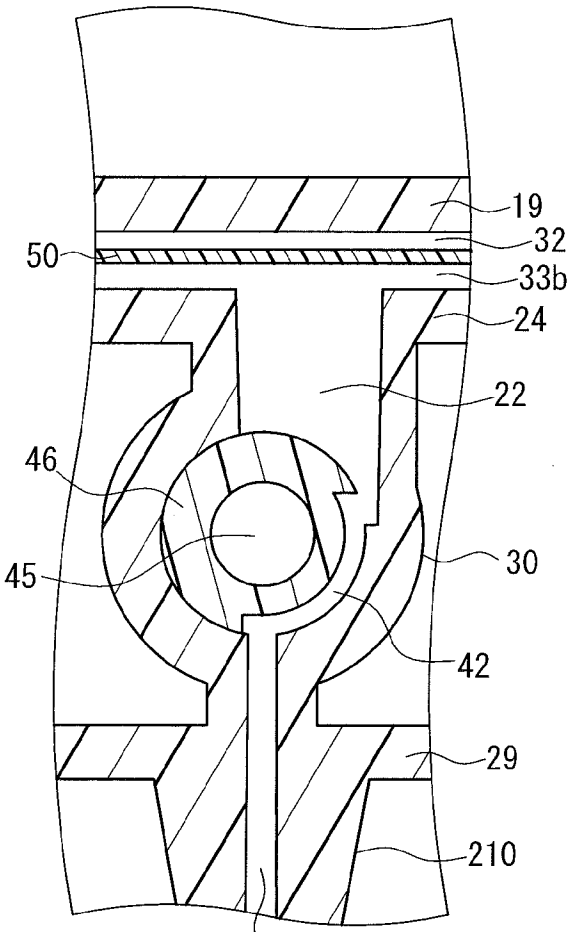
FIG. 24A is a cross-sectional view of the stopcock and the periphery thereof taken along a plane that passes through the second channel of the stopcock, in the medical connector according to the Embodiment 1 of the present invention, in which the stopcock is at the second rotation position.

FIG. 24A is an enlarged cross-sectional view of the stopcock 40 and the periphery thereof taken along a plane that passes through the second channel 42 of the stopcock 40. As can be understood from FIG. 24A, when the stopcock 40 is at the second rotation position, the second channel 42 of the stopcock 40 puts the second hole 22 and the gas channel 212 in communication. As a result, the gas channel 212 is in communication with the male luer 110 via the second channel 42, the second hole 22, the bottle-side second space 33*b*, the hydrophobic filter 50 (the first hydrophobic filter 50*a* (see FIG. 17) in particular), and the bag-side space 32 in the stated order.

FIG. 24B is an enlarged cross-sectional view of the stopcock 40 and the periphery thereof taken along a plane that passes through the third channel 43 of the stopcock 40. As can be understood from FIG. 24B, when the stopcock 40 is at the second rotation position, the third channel 43 of the stopcock 40 puts the inner cavity 45 of the stopcock 40 and the third hole 23 in communication. As a result, the inner cavity 45 of the stopcock 40 is in communication with the male luer 110 via the third channel 43, the third hole 23, the bottle-side third space 33*c*, the hydrophobic filter 50 (the second hydrophobic filter 50*b* (see FIG. 17) in particular), and the bag-side space 32 in the stated order.

Method of Use of Connector 1

The following describes a normal method of use of the connector 1 of Embodiment 1 configured as described above.

Figure 25A:
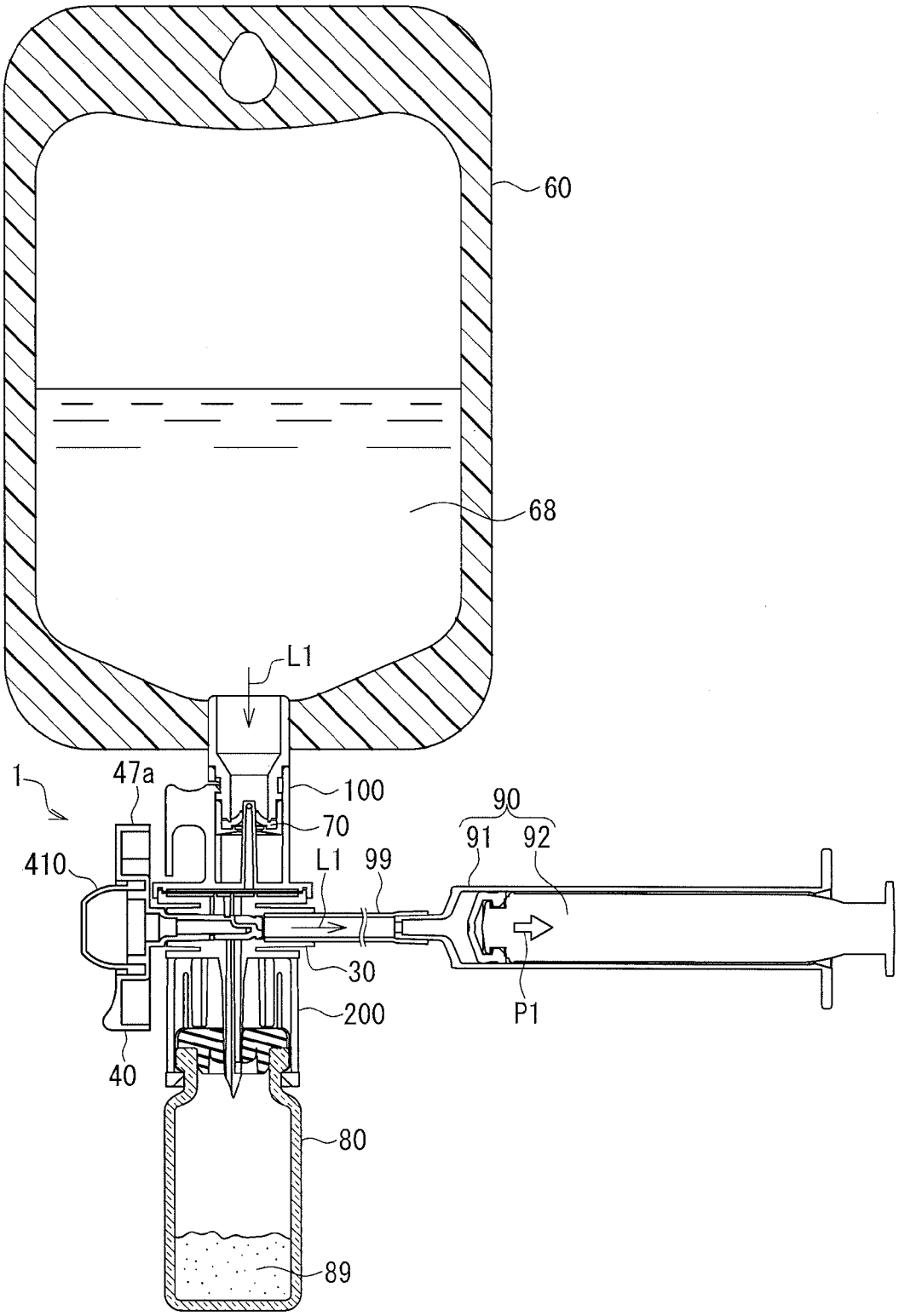
FIG. 25A is a cross-sectional view showing a process of transferring a solution in a drug solution bag to a syringe using the medical connector according to Embodiment 1 of the present invention.

First, as shown in FIGS. 1 and 25A, the needleless port 70 of the drug solution bag 60 is connected to the first connector 100 (see FIGS. 9, 10A, and 10B), and the vial container 80 is connected to the second connector 200 (see FIGS. 16A and 16B). A powdered drug 89 is stored in the vial container 80. A solution 68 for dissolving the drug in the vial container 80 is stored in the drug solution bag 60. The stopcock 40 inserted into the holding portion 36 at the one end of the tubular portion 30 (see FIG. 13) is at the first rotation position (see FIGS. 21, 22A, and 22B). The syringe 90 is connected to the syringe connection portion 37 at the other end of the tubular portion 30 (see FIG. 13) via the flexible tube 99. The plunger 92 of the syringe 90 has been inserted to the maximum depth in the outer cylinder 91 of the syringe 90. Note that although the syringe 90 is connected to the syringe connection portion 37 of the tubular portion 30 via the tube 99 in this example, the syringe 90 may be directly connected to the syringe connection portion 37 without the interposition of the tube 99.

Figure 25B:
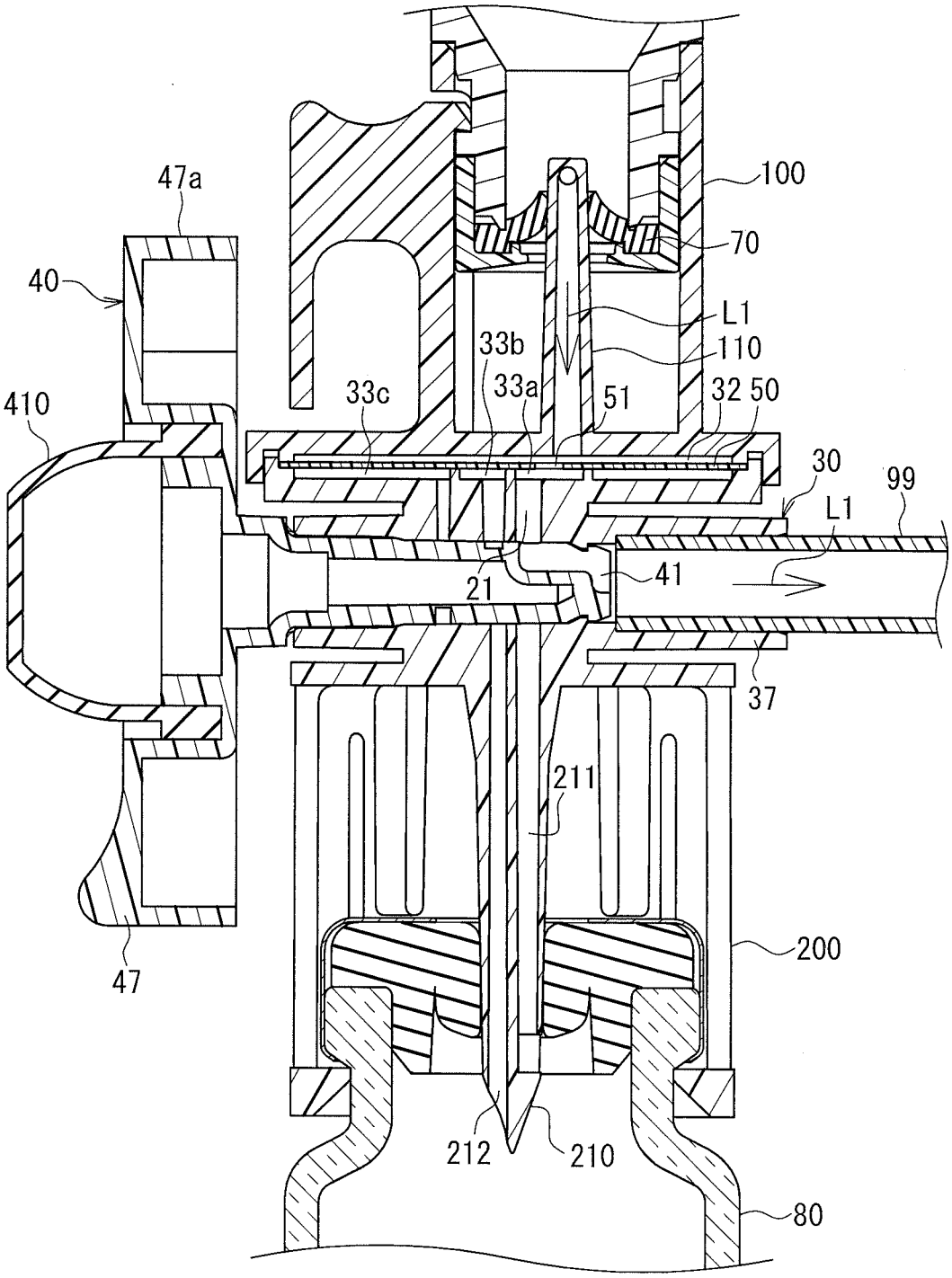
FIG. 25B is an enlarged cross-sectional view of the connector and peripheral portions in FIG. 25A.

As shown in FIGS. 1 and 25A, the connector 1 is held such that the drug solution bag 60 is at the top and the vial container 80 is at the bottom. The plunger 92 of the syringe 90 is pulled in this state (see arrow P1 in FIG. 25A). FIG. 25B is an enlarged cross-sectional view of the connector 1 and the periphery thereof. As described above, when the stopcock 40 is at the first rotation position, the first channel 41 of the stopcock 40 puts the first hole 21 and the syringe connection portion 37 in communication. Accordingly, as shown in FIG. 25B, the solution 68 in the drug solution bag 60 passes through the male luer 110, the bag-side space 32, the through-hole 51 of the hydrophobic filter 50, the bottle-side first space 33*a*, the first hole 21, the first channel 41, the syringe connection portion 37, and the tube 99 in the stated order, and then flows into the syringe 90 (see arrow L1). The pull amount of the plunger 92 is adjusted so as to transfer a predetermined amount of the solution 68 into the syringe 90. Since the drug solution bag 60 undergoes deformation as the solution 68 flows out, the air pressure inside the drug solution bag 60 is kept constant. The hydrophobic filter 50 (the first hydrophobic filter 50*a* and the second hydrophobic filter 50*b* (see FIG. 17)) prevent the solution 68 from flowing into the bottle-side second space 33*b* and the bottle-side third space 33*c*.

Figure 26A:
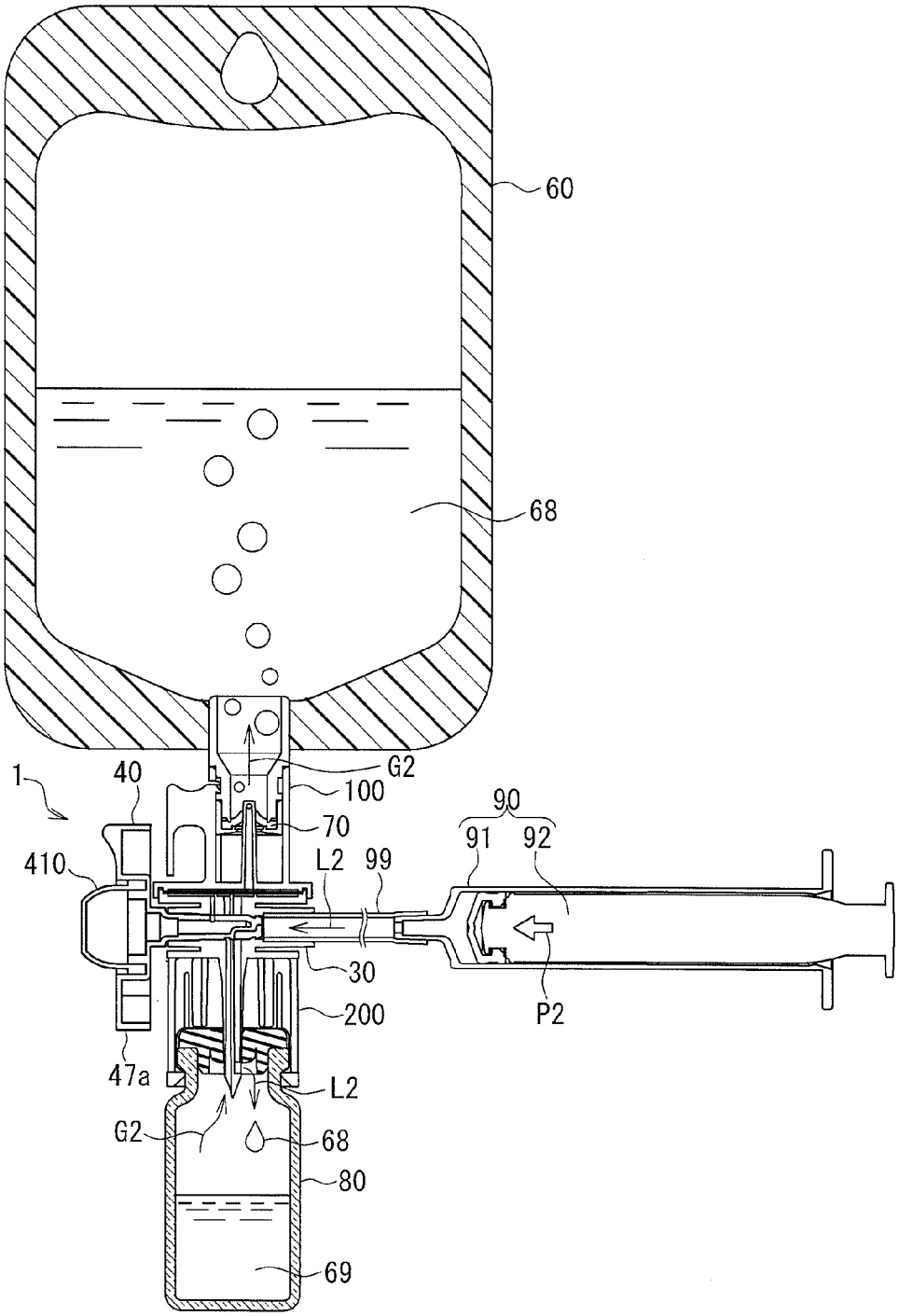
FIG. 26A is a cross-sectional view showing a process of transferring the solution in the syringe to a vial container using the medical connector according to Embodiment 1 of the present invention.
Figure 26B:
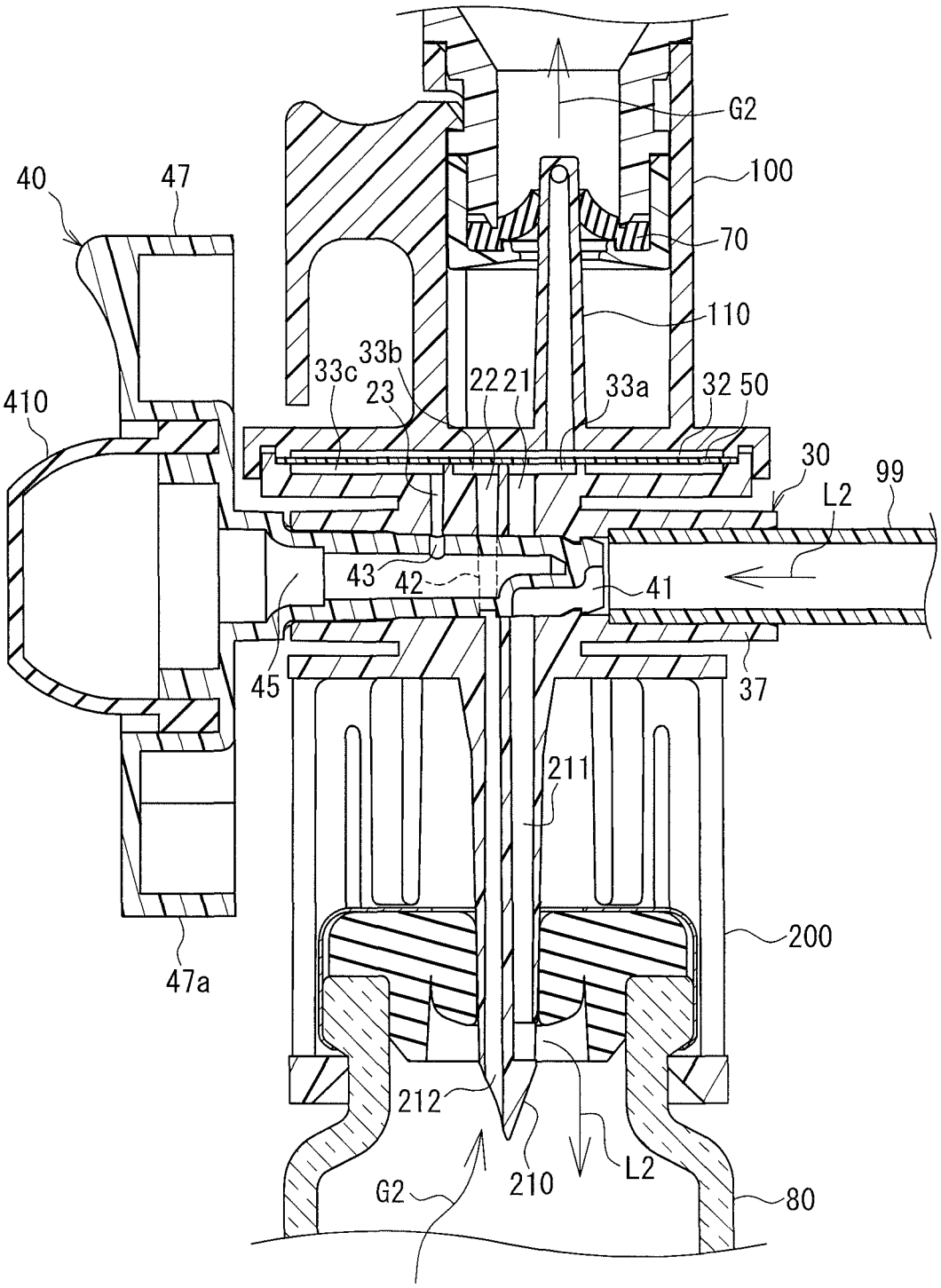
FIG. 26B is an enlarged cross-sectional view of the connector and peripheral portions in FIG. 26A.

Next, as shown in FIG. 26A, the stopcock 40 is rotated 180 degrees to the second rotation position while keeping the orientation of the connector 1 the same as in FIGS. 1 and 25A. FIG. 26B is an enlarged cross-sectional view of the connector 1 and the periphery thereof. Due to switching the stopcock 40 to the second rotation position, the first channel 41 of the stopcock 40 puts the liquid channel 211 and the syringe connection portion 37 in communication as described above. Also, the second channel 42 of the stopcock 40 puts the second hole 22 and the gas channel 212 in communication. The plunger 92 of the syringe 90 is pushed in this state (see arrow P2 in FIG. 26A). The solution 68 in the syringe 90 passes through the tube 99, the syringe connection portion 37, the first channel 41, and the liquid channel 211 in the stated order, and then flows into the vial container 80 (see arrow L2). Since the vial container 80 is an airtight container that undergoes substantially no deformation, the interior of the vial container 80 becomes positively pressured as the solution 68 flows in. For this reason, the air in the vial container 80 passes through the gas channel 212, the second channel 42, the second hole 22, the bottle-side second space 33*b*, the hydrophobic filter 50 (the first hydrophobic filter 50*a* (see FIG. 17)), the bag-side space 32, and the male luer 110 in the stated order, and then moves into the drug solution bag 60 (see arrow G2). The air pressure in the vial container 80 is thus kept constant. After a predetermined amount of solution has been injected into the vial container 80, the drug in the vial container 80 is dissolved by the solution, and the drug solution 69 is obtained.

As described above, when the stopcock 40 is at the second rotation position, the third channel 43 of the stopcock 40 puts the third hole 23 and the inner cavity 45 of the stopcock 40 in communication. However, the hydrophobic filter 50 (the second hydrophobic filter 50*b* (see FIG. 17)) prevents the solution in the bag-side space 32 from flowing into the inner cavity 45 of the stopcock 40.

When the stopcock 40 has been switched to the second rotation position as shown in FIGS. 26A and 26B, if the plunger 92 of the syringe 90 is mistakenly pulled, the interior of the vial container 80 becomes negatively pressurized. The vial container 80 is in communication with the drug solution bag 60 via the gas channel 212, the second channel 42, the second hole 22, the bottle-side second space 33*b*, the bag-side space 32, and the male luer 110. Accordingly, in order to eliminate the negative pressure inside the vial container 80, the solution 68 in the drug solution bag 60 attempts to flow into the vial container 80. However, the hydrophobic filter 50 (the first hydrophobic filter 50*a* (see FIG. 17)) arranged on the drug solution bag 60 side relative to the bottle-side second space 33*b* prevents this flow of the solution 68. Accordingly, it is possible to prevent the solution 68 in the drug solution bag 60 from flowing into the vial container 80 without passing through the syringe 90 due to an operation error.

Figure 27A:
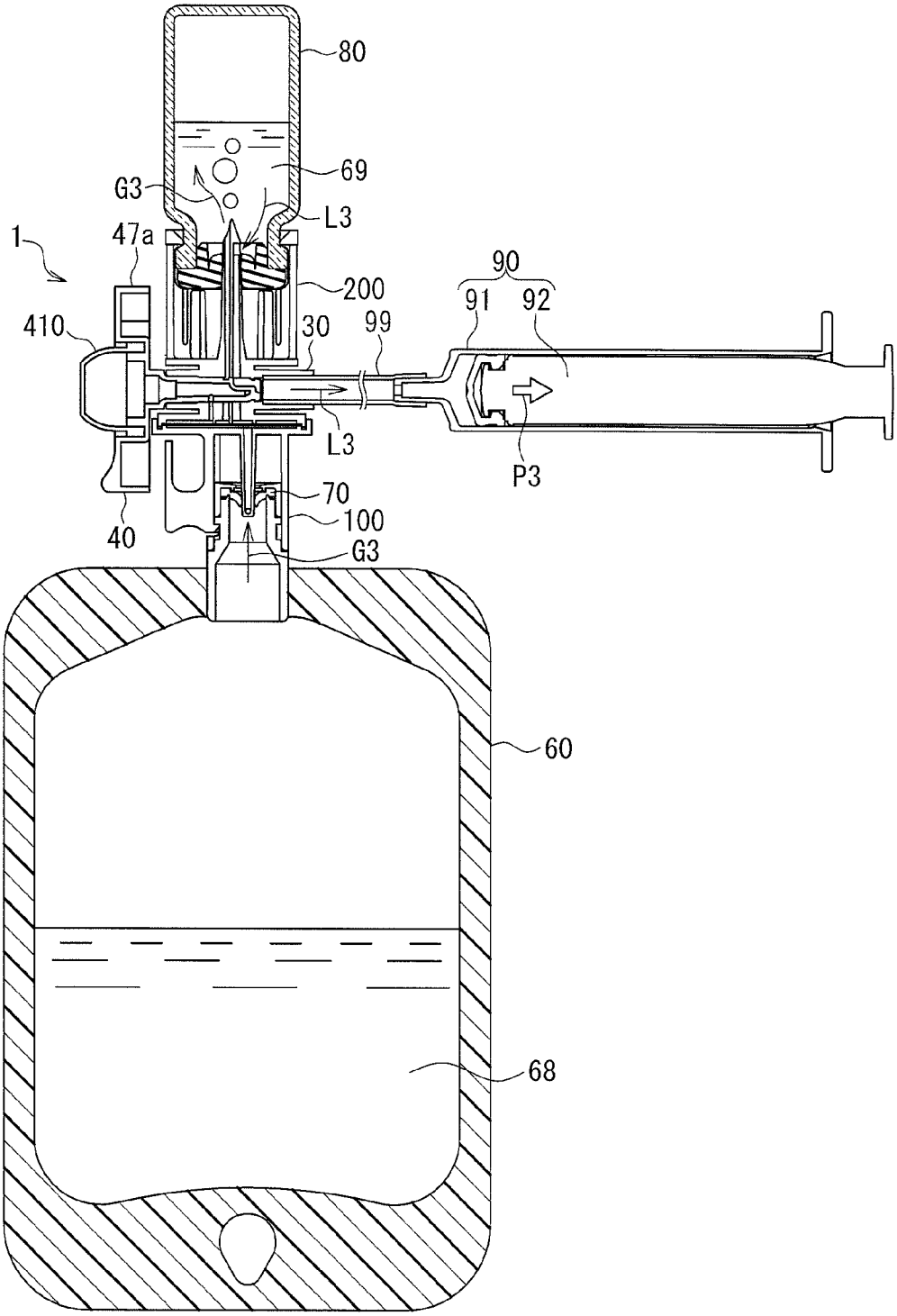
FIG. 27A is a cross-sectional view showing a process of transferring the drug solution in the vial container to the syringe using the medical connector according to Embodiment 1 of the present invention.
Figure 27B:
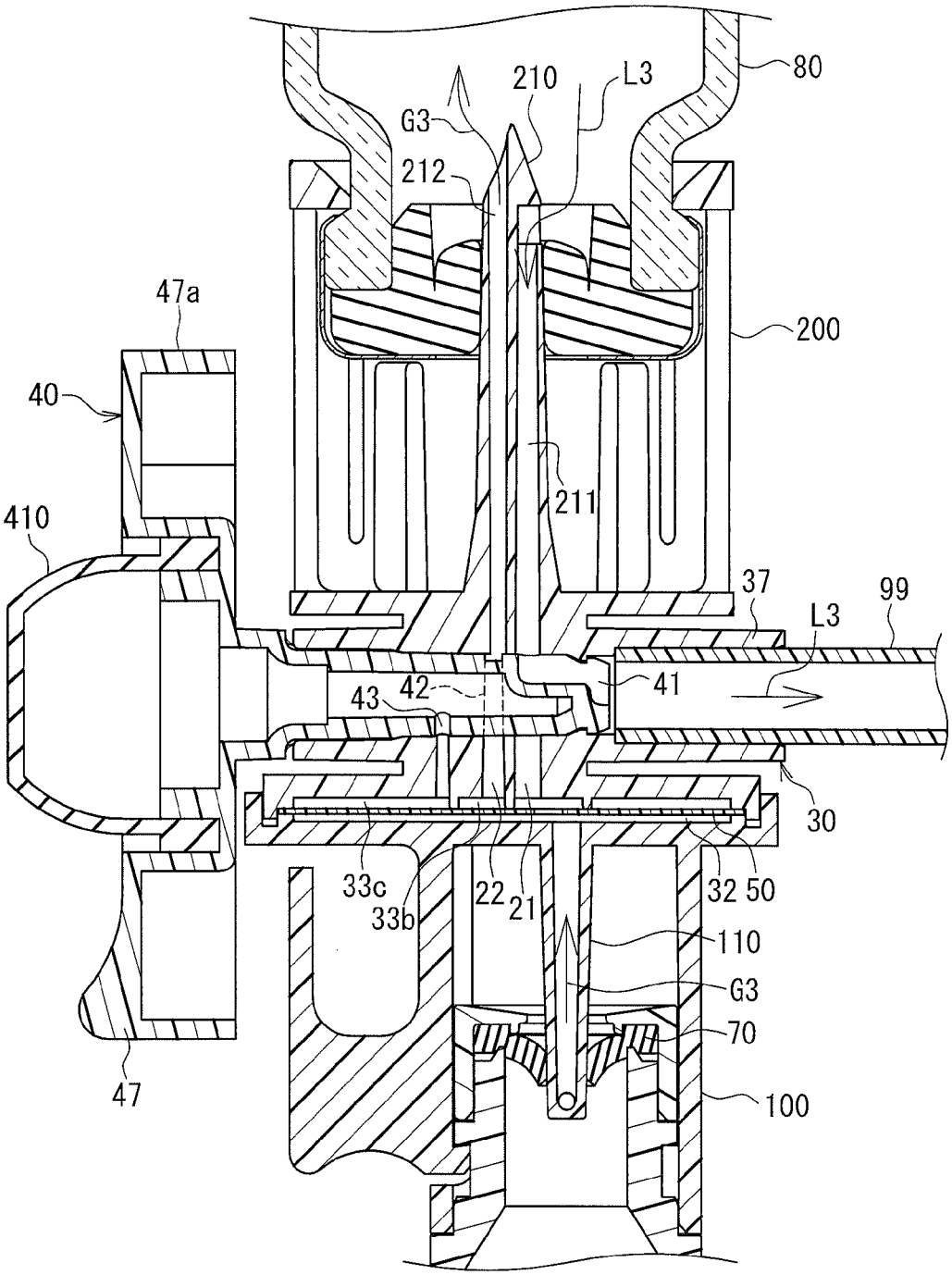
FIG. 27B is an enlarged cross-sectional view of the connector and peripheral portions in FIG. 27A.

Next, as shown in FIG. 27A, the connector 1 is inverted vertically such that the vial container 80 is at the top and the drug solution bag 60 is at the bottom, while keeping the direction of the stopcock 40 at the second rotation position likewise as in FIGS. 26A and 26B. The plunger 92 of the syringe 90 is pulled in this state (see arrow P3). FIG. 27B is an enlarged cross-sectional view of the connector 1 and the periphery thereof. The drug solution 69 in the vial container 80 passes through the liquid channel 211, the first channel 41, the syringe connection portion 37, and the tube 99 in the stated order, and then flows into the syringe 90 (see arrow L3). The interior of the vial container 80 becomes negatively pressurized as the drug solution 69 flows out. For this reason, the air in the drug solution bag 60 passes through the male luer 110, the bag-side space 32, the hydrophobic filter 50 (the first hydrophobic filter 50*a* (see FIG. 17)), the bottle-side second space 33*b*, the second hole 22, the second channel 42, and the gas channel 212 in the stated order, and then flows into the vial container 80 (see arrow G3).

Figure 28A:
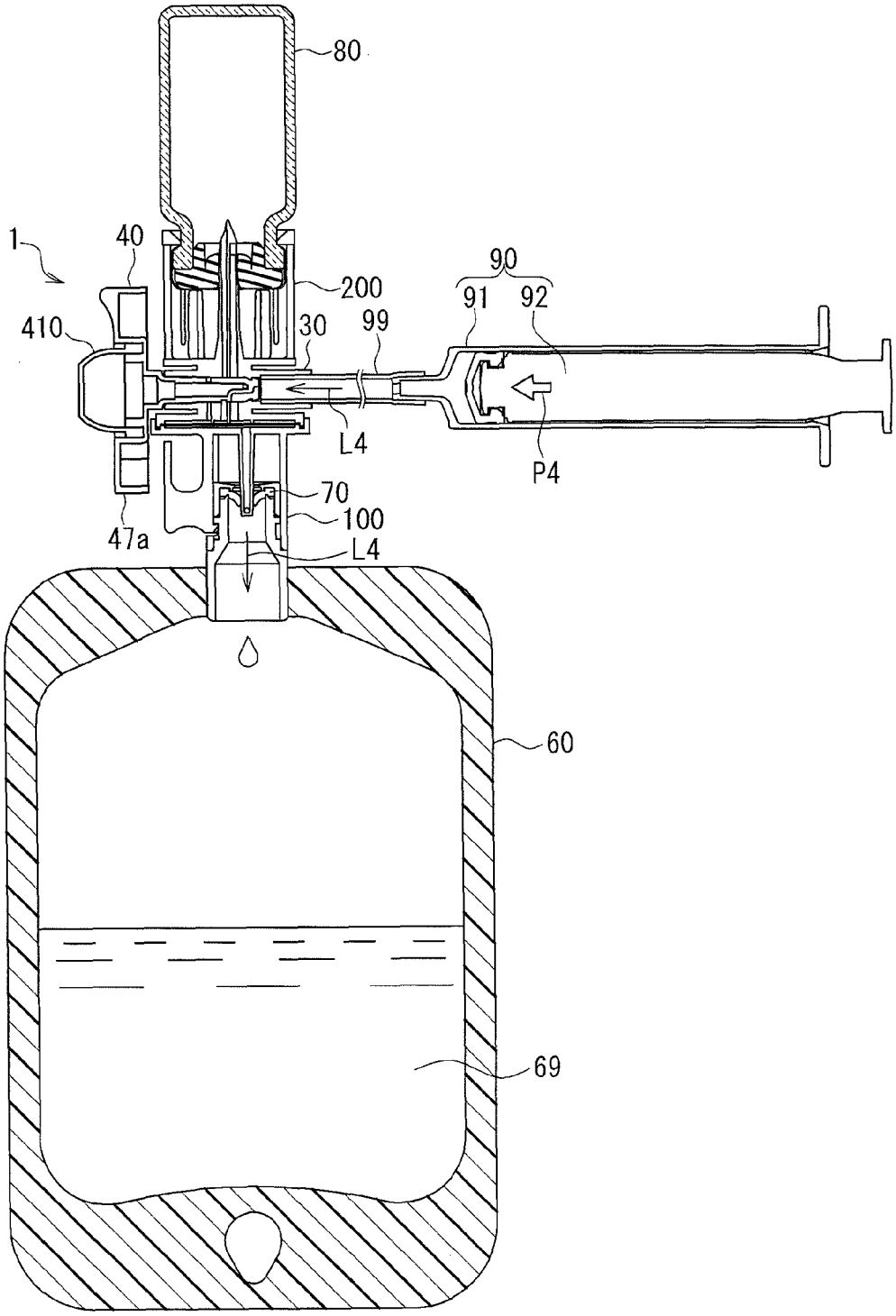
FIG. 28A is a cross-sectional view showing a process of transferring the drug solution in the syringe to the drug solution bag using the medical connector according to Embodiment 1 of the present invention.
Figure 28B:
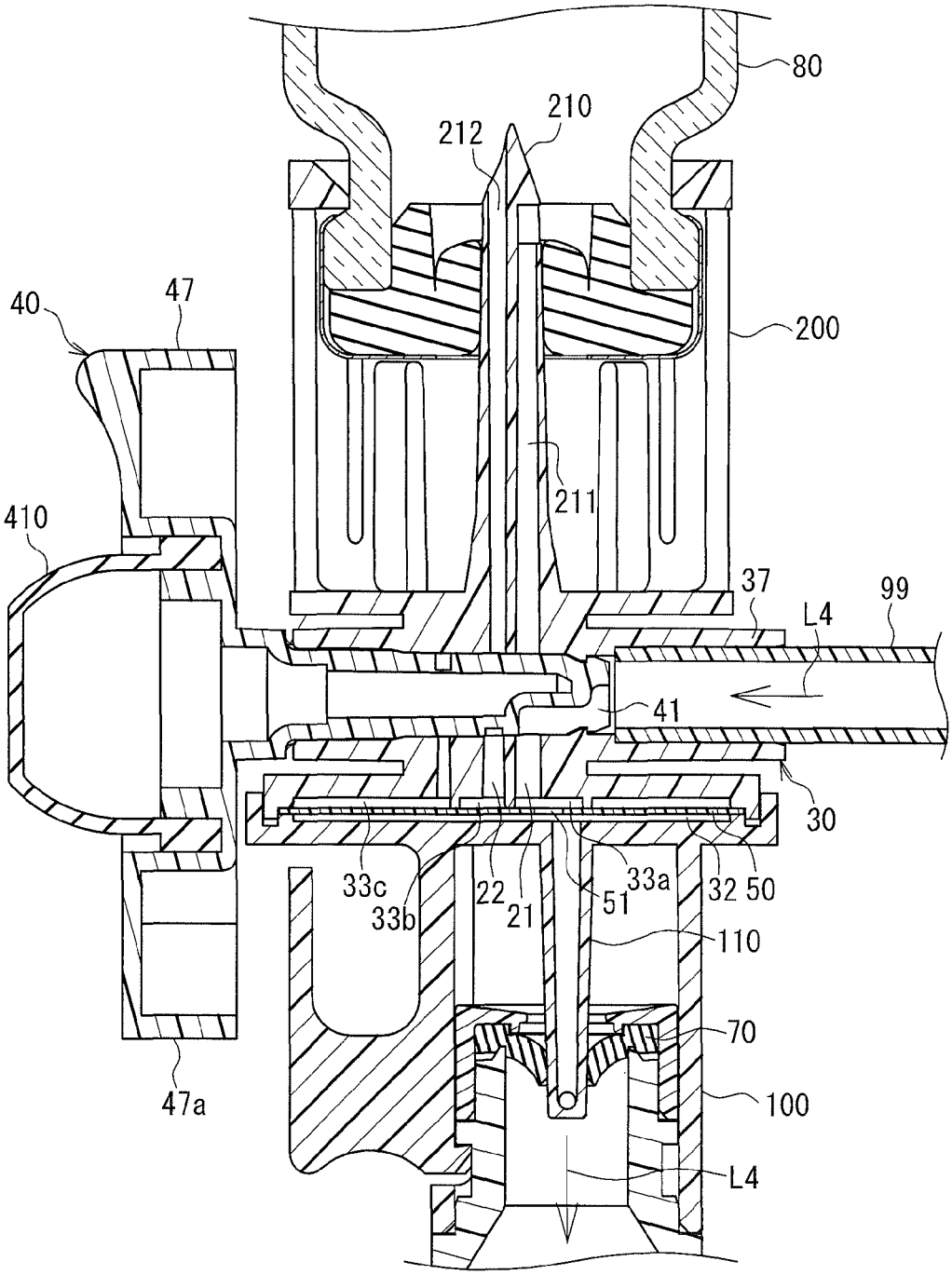
FIG. 28B is an enlarged cross-sectional view of the connector and peripheral portions in FIG. 28A.

Next, as shown in FIG. 28A, the stopcock 40 is rotated 180 degrees to the first rotation position while keeping the orientation of the connector 1 the same as in FIGS. 27A and 27B. The plunger 92 of the syringe 90 is pushed in this state (see arrow P4). FIG. 28B is an enlarged cross-sectional view of the connector 1 and the periphery thereof. Due to switching the stopcock 40 to the first rotation position, the first channel 41 of the stopcock 40 puts the first hole 21 and the syringe connection portion 37 in communication. Accordingly, the drug solution 69 in the syringe 90 passes through the tube 99, the syringe connection portion 37, the first channel 41, the first hole 21, the bottle-side first space 33*a*, the through-hole 51 of the hydrophobic filter 50, the bag-side space 32, and the male luer 110 in the stated order, and then flows into the drug solution bag 60 (see arrow L4). The push amount of the plunger 92 is adjusted so as to inject a predetermined amount of the drug solution 69 into the drug solution bag 60. A drug solution having a predetermined amount of a drug dissolved therein can thus be prepared in the drug solution bag 60.

As described above, according to the connector 1 of Embodiment 1, the amount of the solution 68 injected into the vial container 80 and the amount of the drug solution 69 injected into the drug solution bag 60 can be measured appropriately using the syringe 90.

The first connector 100 includes the first lock mechanism for maintaining the state in which the male luer 110 is inserted into the needleless port 70 of the drug solution bag 60. Also, the second connector 200 includes the second lock mechanism for maintaining the state in which the bottle needle 210 has punctured the rubber stopper 85 of the vial container 80. Accordingly, it is possible to prevent the occurrence of situations in which the male luer 110 unintentionally comes out of the needleless port 70 or the bottle needle 210 unintentionally comes out of the rubber stopper 85 of the vial container 80 in the series of tasks for preparing a drug from FIGS. 25A and 25B to FIGS. 28A and 28B described above. As a result, the connector 1 of Embodiment 1 is a closed-system device that is very safe and has a reduced possibility of a dangerous drug solution and vapor therefrom leaking to the outside.

The first hydrophobic filter 50*a* and the second hydrophobic filter 50*b* are provided in a single common member (the hydrophobic filter 50) (see FIG. 17). This makes it possible to reduce the number of parts constituting the connector 1 and the number of steps for assembling the connector 1.

The hydrophobic filter 50 including the first hydrophobic filter 50*a* and the second hydrophobic filter 50*b* is arranged between the first member 10 and the second member 20. With this configuration, the effective areas (areas through which gases can pass) of the first hydrophobic filter 50*a* and the second hydrophobic filter 50*b* can be made larger than in the case where, for example, the first hydrophobic filter 50*a* is provided in the second hole 22 and the second hydrophobic filter 50*b* is provided in the third hole 23. This thus makes it possible to reduce the passing resistance (airflow resistance) when a gas passes through the first hydrophobic filter 50*a* and the second hydrophobic filter 50*b*. A low airflow resistance for the first hydrophobic filter 50*a* is advantageous for easily and swiftly transferring solutions and drug solutions.

The through-hole 51 is formed in the hydrophobic filter 50 that includes the first hydrophobic filter 50*a* and the second hydrophobic filter 50*b*. Accordingly, the flow of a liquid between the male luer 110 and the first hole 21 can be maintained while the hydrophobic filter 50 is sandwiched between and firmly fixed by the first member 10 and the second member 20.

The syringe 90 is connected to the syringe connection portion 37 via the flexible tube 99. Accordingly, the orientation of the connector 1 is not influenced by changes in the orientation of the syringe 90 that occur when the plunger 92 of the syringe 90 is pushed and pulled. This thus makes it possible to push and pull the plunger 92 while keeping a constant orientation for the connector 1 and the drug solution bag 60 and the vial container 80 connected thereto. Accordingly, the operability of the plunger 92 is favorable.

Method of Use of Air Supplying Member 410

In order to prepare a drug solution using the connector 1 of Embodiment 1, similarly to the case of using the conventional connector 900, the operations of switching the stopcock 40 between the first rotation position and the second rotation position, vertically inverting the orientation of the connector 1, and pushing or pulling the plunger 92 of the syringe 90 need to be performed in a predetermined order. Accordingly, it cannot be said that there is no possibility of an operation error in which the operator makes a mistake in the operation order.

The air supplying member 410 makes it possible to continue with the drug solution preparation task in the case where the operator has made an operation error. This will be described below.

Figure 29A:
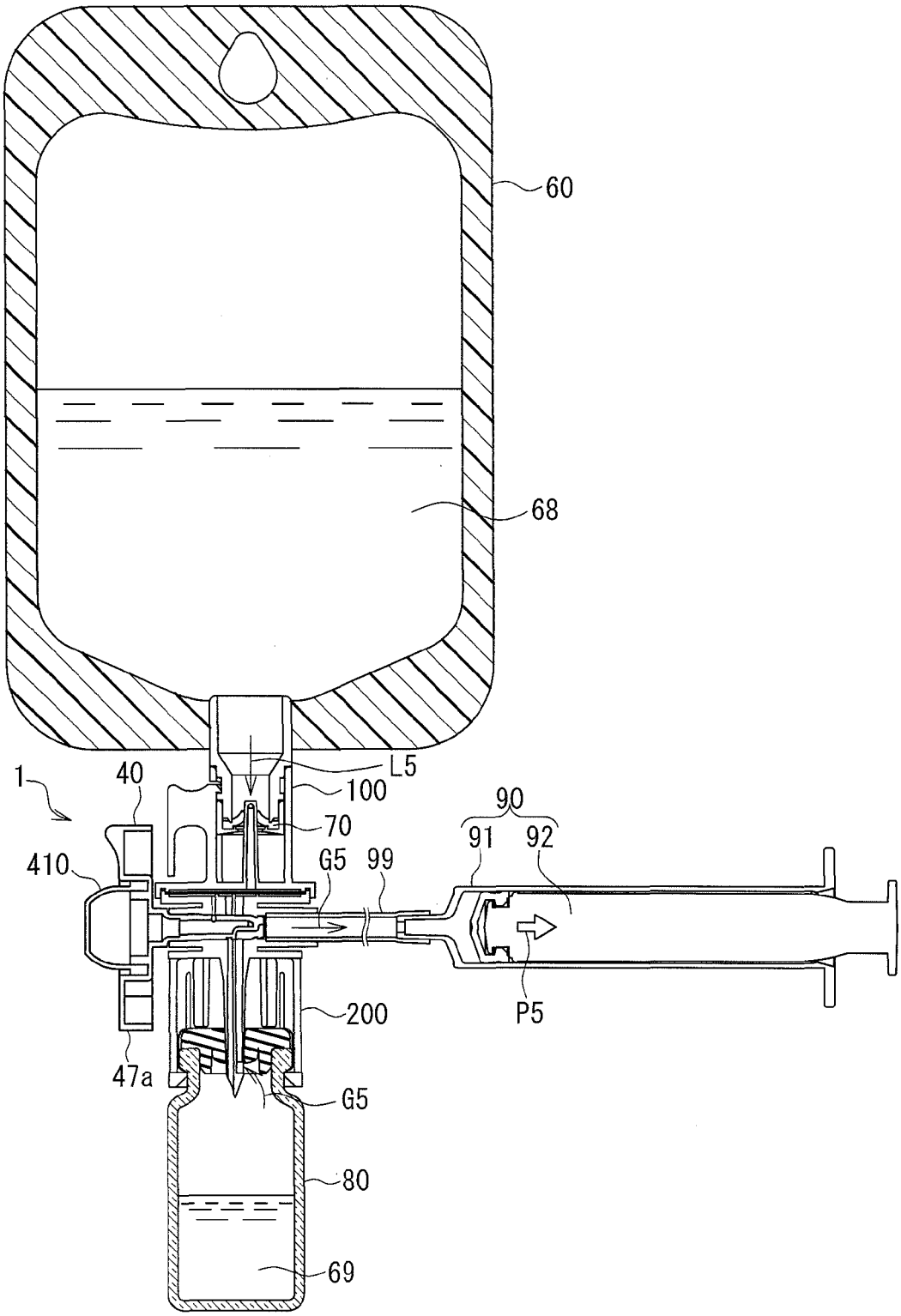
FIG. 29A is a cross-sectional view for describing an operation error made with the medical connector according to Embodiment 1 of the present invention.
Figure 29B:
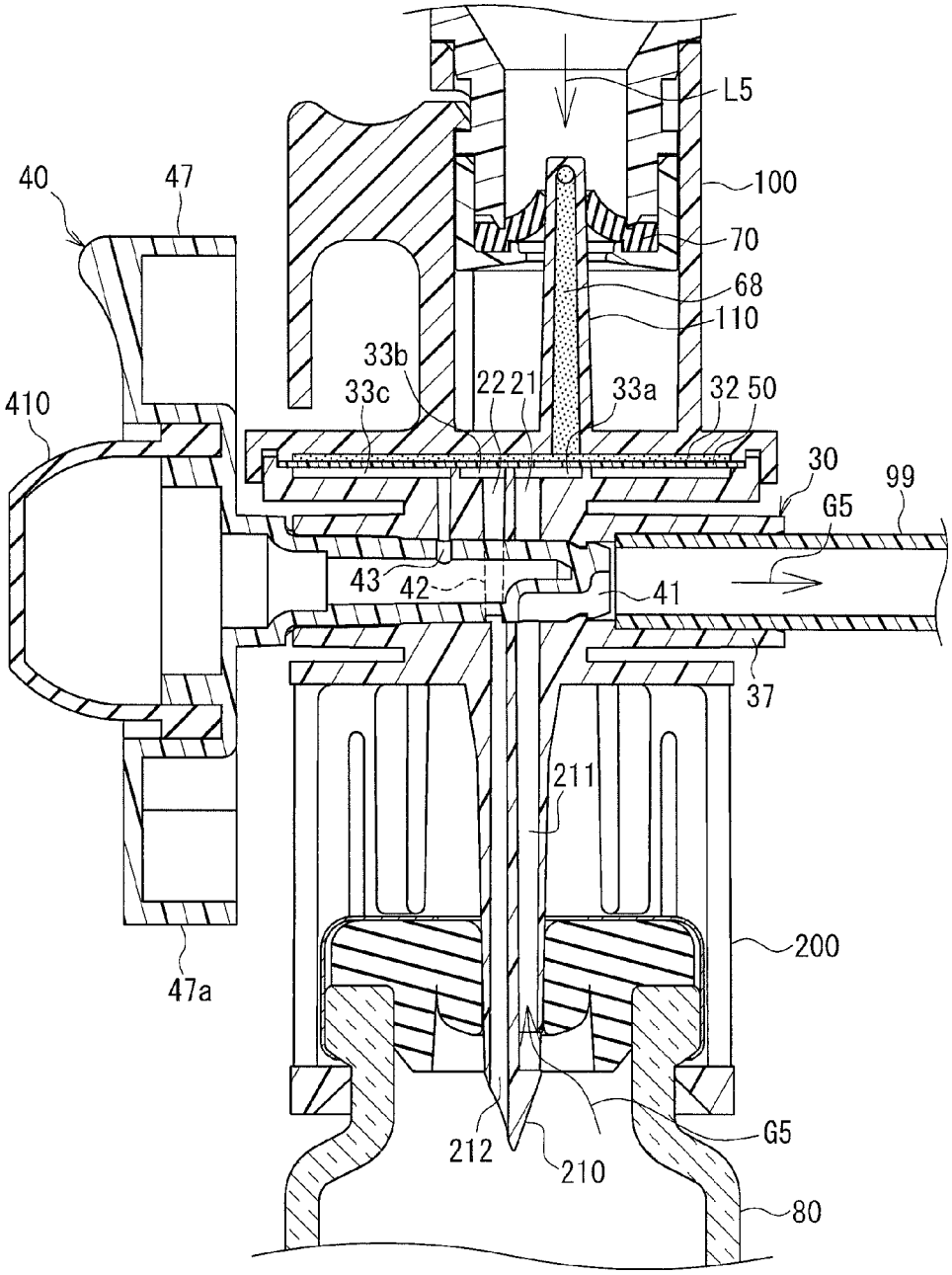
FIG. 29B is an enlarged cross-sectional view of the connector and peripheral portions in FIG. 29A.

As described above, following the steps in FIGS. 26A and 26B in which the drug in the vial container 80 is dissolved with a solution to obtain a drug solution, in the steps in FIGS. 27A and 27B it is necessary to vertically invert the connector 1 and then pull the plunger 92 of the syringe 90. At this time, in the case where, after the steps in FIGS. 26A and 26B, the plunger 92 of the syringe 90 is mistakenly pulled without having vertically inverted the connector 1 as shown in FIG. 29A (see arrow P5), the gas in the vial container 80 passes through the liquid channel 211, the first channel 41, the syringe connection portion 37, and the tube 99 in the stated order, and then flows into the syringe 90 (see arrow G5) as shown in FIG. 29B. The interior of the vial container 80 thus becomes negatively pressurized. Since the gas channel 212, the second channel 42, the second hole 22, and the bottle-side second space 33*b* are in communication with the vial container 80, the interior spaces thereof also become negatively pressurized. As a result, the solution 68 in the drug solution bag 60 flows into the male luer 110 and the bag-side space 32 in the stated order (see arrow L5). Note that the solution cannot pass through the hydrophobic filter 50 (the first hydrophobic filter 50*a* (see FIG. 17)). Accordingly, as shown in FIG. 29B, the male luer 110 and the bag-side space 32 that are on the drug solution bag 60 side relative to the hydrophobic filter 50 become filled with the solution 68. In FIG. 29B, the region in which the solution 68 is present in the connector 1 is denoted by a dotted pattern.

After this state is reached, even if an attempt is made to pull the plunger 92 of the syringe 90 farther, it cannot be pulled since the interior of the vial container 80 becomes negatively pressurized. At this point, the operator realizes the operation error of forgetting to vertically invert the connector 1. However, even if the connector 1 is vertically inverted at this stage, the solution 68 in the male luer 110 and the bag-side space 32 will not be discharged. Accordingly, regardless of how the orientation of the connector 1 is changed, the interior of the vial container 80 becomes negatively pressurized if the plunger 92 is pulled, and therefore the plunger 92 of the syringe 90 cannot be pulled. If the plunger 92 is inserted to the maximum depth in the syringe 90 when the steps in FIGS. 26A and 26B have ended, the plunger 92 can be inserted only a slight amount further in the outer cylinder 91 in the state shown in FIG. 29B. Accordingly, it is difficult to discharge the solution 68 that fills the male luer 110 and the bag-side space 32 by pushing the plunger 92.

Figure 30:
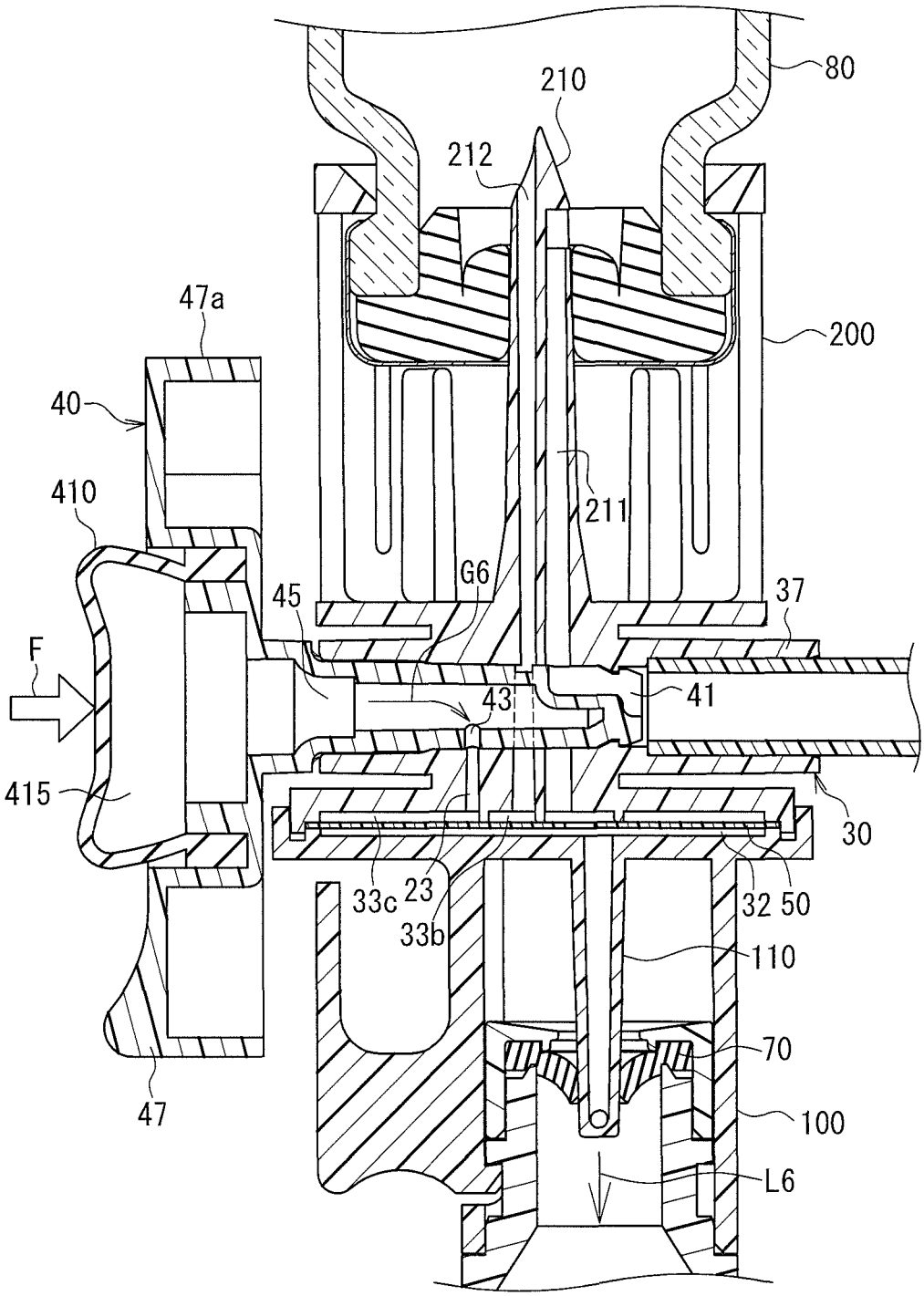
FIG. 30 is a cross-sectional view for describing the operation of an air supplying member when an operation error occurs in the medical connector according to Embodiment 1 of the present invention.

In Embodiment 1, if the male luer 110 and the bag-side space 32 have been filled with the solution 68 due to an operation error as shown in FIG. 29B, the connector 1 is vertically inverted such that the vial container 80 is at the top and the drug solution bag 60 is at the bottom as shown in FIG. 30. Then pressing force F is applied to the air supplying member 410 so as to flatten the air supplying member 410. If the stopcock 40 is at the second rotation position, the third channel 43 of the stopcock 40 puts the inner cavity 45 of the stopcock 40 and the third hole 23 in communication (see FIG. 24B). Accordingly, air in the inner cavity 415 of the air supplying member 410 passes through the inner cavity 45 of the stopcock 40, the third channel 43, the third hole 23, the bottle-side third space 33*c*, and the hydrophobic filter 50 (the second hydrophobic filter 50*b* (see FIG. 17)) in the stated order, and then flows into the bag-side space 32 (see arrow G6). As a result, the solution 68 that fills the bag-side space 32 and the male luer 110 is discharged to the drug solution bag 60 (see arrow L6). When the pressing force F applied to the air supplying member 410 is released, the air supplying member 410 undergoes elastic restoration to its initial shape. When this elastic restoration occurs, air in the drug solution bag 60 passes through the male luer 110, the bag-side space 32, the hydrophobic filter 50 (the second hydrophobic filter 50*b* (see FIG. 17)), the bottle-side third space 33*c*, the third hole 23, the third channel 43, and the inner cavity 45 of the stopcock 40 in the stated order, and then flows into the inner cavity 415 of the air supplying member 410.

Thereafter, the plunger 92 of the syringe 90 is pulled (see arrow P3) as described with reference to FIGS. 27A and 27B. Since the solution 68 no longer is present in the bag-side space 32, air in the drug solution bag 60 can pass through the hydrophobic filter 50 (the first hydrophobic filter 50*a* (see FIG. 17)) and flow toward the vial container 80 (see arrow G3). Accordingly, the drug solution 69 in the vial container 80 can be caused to flow into the syringe 90 (see arrow L3). Thereafter, the operations in FIGS. 28A and 28B can be performed, and a drug solution having a predetermined amount of a drug dissolved therein can be prepared in the drug solution bag 60.

In this way, according to Embodiment 1, even if it is difficult to push and pull the plunger 92 of the syringe 90 due to the operator making an operation error, the airflow of the hydrophobic filter 50 (the first hydrophobic filter 50*a* (see FIG. 17) in particular) can be restored by flattening the air supplying member 410. This thus makes it possible to continue with the drug solution preparation tasks even if an operation error is made in the drug solution preparation tasks.

The second hydrophobic filter 50*b* is arranged farther than the first hydrophobic filter 50*a* from the male luer 110. Accordingly, air that has passed through the second hydrophobic filter 50*b* and flowed into the bag-side space 32 due to operating the air supplying member 410 then flows over the first hydrophobic filter 50*a* and flows into the male luer 110. The solution 68 that existed on the first hydrophobic filter 50*a* thus is discharged from the male luer 110 to the drug solution bag 60. Accordingly, the arrangement of the first hydrophobic filter 50*a*, the second hydrophobic filter 50*b*, and the male luer 110 is advantageous in restoring the airflow of the first hydrophobic filter 50*a* using the air supplying member 410.

Embodiment 2

In Embodiment 1 described above, as described with reference to FIG. 30, by applying pressing force F to the air supplying member 410 so as to flatten the air supplying member 410, the solution 68 in the male luer 110 and the bag-side space 32 is discharged to the drug solution bag 60. However, there is the possibility that the solution 68 will remain in the male luer 110 and/or the bag-side space 32 after the air supplying member 410 has been flattened, and the airflow of the hydrophobic filter 50 will not be restored. In this case, it remains difficult to pull the plunger 92 of the syringe 90. Also, since air cannot flow from the drug solution bag 60 to the inner cavity 415 of the air supplying member 410 after the air supplying member 410 has been flattened, the air supplying member 410 cannot undergo elastic restoration to its initial shape. Accordingly, it is difficult to repeatedly apply pressing force F and flatten the air supplying member 410 so as to send air to the bag-side space 32. In this way, in Embodiment 1, it is not possible to completely eliminate the possibility of difficulty in continuing with the preparation of the drug solution with the hydrophobic filter 50 even if the air supplying member 410 is used when an operation error has been made.

Embodiment 2 reduces the possibility of this occurring.

Figure 31:
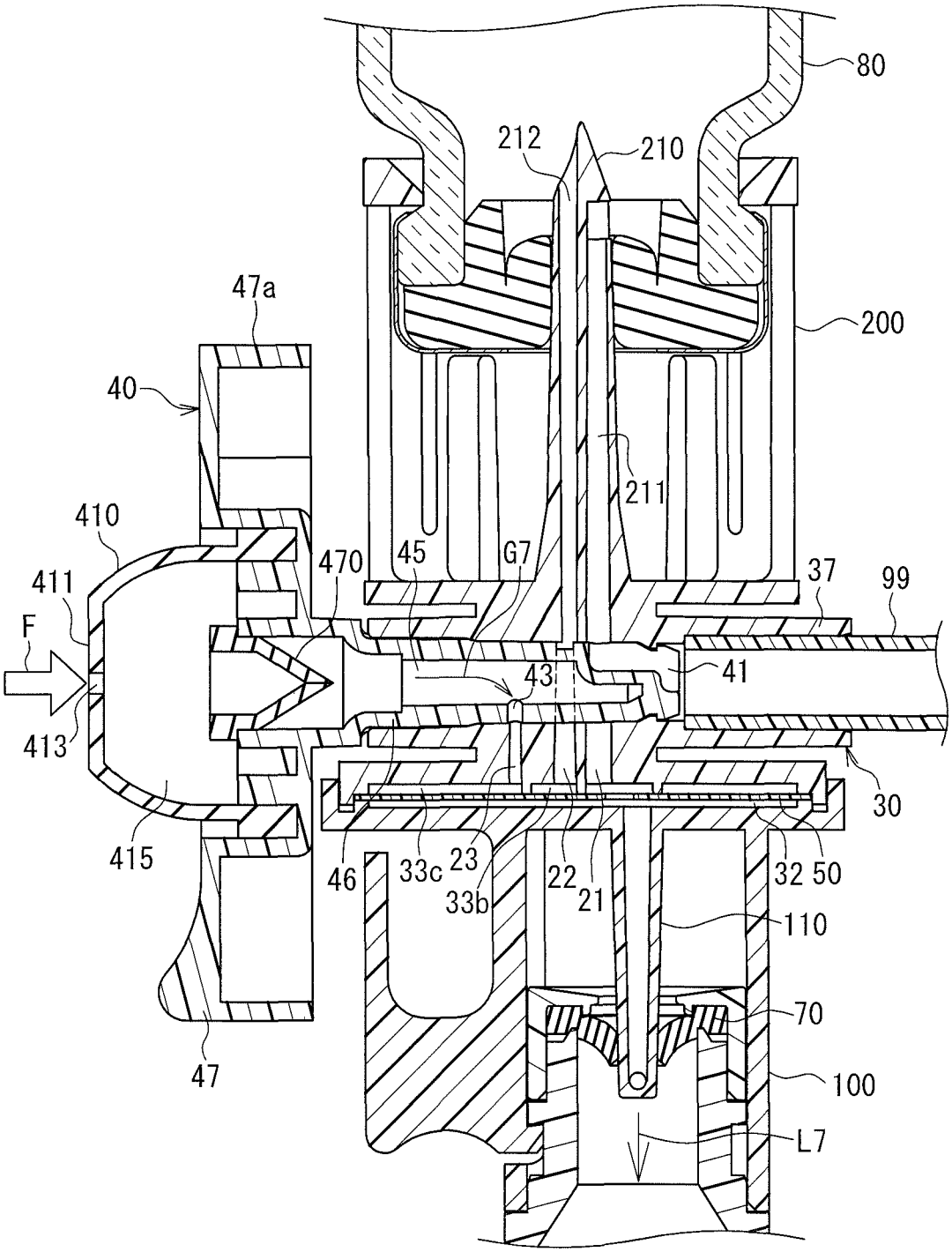
FIG. 31 is an enlarged cross-sectional view of a medical connector according to Embodiment 2 of the present invention and peripheral portions.

FIG. 31 is an enlarged cross-sectional view of a connector 2 according to Embodiment 2 of the present invention and the periphery thereof. In FIG. 31, the stopcock 40 is at the second rotation position. Members that are the same as the members shown in FIGS. 1 to 30 described in Embodiment 1 are denoted by the same reference numerals, and descriptions will not be given for them.

In Embodiment 2, a hole (through-hole) 413 is formed in a top face 411 of the air supplying member 410 to which pressing force F (see FIG. 30) is applied. The hole 413 puts the inner cavity 415 of the air supplying member 410 in communication with the atmosphere outside the air supplying member 410.

Also, a one-way valve (or check valve) 470 is attached to the opening of the insertion portion 46 of the stopcock 40 on the operation portion 47 side. The one-way valve 470 separates the inner cavity 45 of the stopcock 40 from the inner cavity 415 of the air supplying member 410. The one-way valve 470 permits the movement of gas from the inner cavity 415 of the air supplying member 410 toward the inner cavity 45 of the stopcock 40, and prohibits the opposite movement of gas from the inner cavity 45 toward the inner cavity 415. Although there are no particular limitations on the one-way valve 470 as long as it has such a function, it is possible to use a so-called duckbill check valve that includes a pair of lips made of an elastic material (e.g., silicone rubber or isoprene rubber), for example.

As described in Embodiment 1, in the case where the solution 68 has filled the male luer 110 and the bag-side space 32 due to an operation error (see FIG. 29B), as shown in FIG. 31, the connector 1 is held such that the vial container 80 is at the top and the drug solution bag 60 is at the bottom, and pressing force F is applied to the air supplying member 410 so as to flatten the air supplying member 410. When a finger is brought into contact with the top face 411 of the air supplying member 410 in order to apply the pressing force F to the air supplying member 410, the hole 413 is blocked by the finger. Accordingly, the air in the inner cavity 415 does not escape to the outside through the hole 413 when the air supplying member 410 is flattened. The air in the inner cavity 415 of the air supplying member 410 passes through the one-way valve 470 and then, similarly to the case of Embodiment 1 (see FIG. 30), passes through the inner cavity 45 of the stopcock 40, the third channel 43, the third hole 23, the bottle-side third space 33*c*, and the hydrophobic filter 50 (the second hydrophobic filter 50*b* (see FIG. 17)) in the stated order, and then flows into the bag-side space 32 (see arrow G7). As a result, the solution 68 that fills the bag-side space 32 and the male luer 110 is discharged to the drug solution bag 60 (see arrow L7).

The pressing force F then is released, and the finger is removed from the air supplying member 410. Air from the outside flows into the inner cavity 415 through the hole 413, and the air supplying member 410 undergoes elastic restoration to its initial shape.

The plunger 92 of the syringe 90 then is pulled. If solution 68 remains in the male luer 110 and/or the bag-side space 32, the airflow of the hydrophobic filter 50 (the first hydrophobic filter 50*a* (see FIG. 17) in particular) will not be restored, and therefore the plunger 92 will not be able to be pulled. In this case, the finger again is brought into contact with the top face 411 of the air supplying member 410 so as to flatten the air supplying member 410.

Similar operations are subsequently repeated until the plunger 92 of the syringe 90 can be pulled.

In this way, according to Embodiment 2, gas for restoring the airflow of the hydrophobic filter 50 (the first hydrophobic filter 50*a* (see FIG. 17) in particular) is introduced through the hole 413 from the outside. Accordingly, even if the airflow of the hydrophobic filter 50 (the second hydrophobic filter 50*b* (see FIG. 17) in particular) is not restored, the air supplying member 410 can be repeatedly flattened. If the operation of flattening the air supplying member 410 is repeated, the airflow of the hydrophobic filter 50 (the first hydrophobic filter 50*a* (see FIG. 17) in particular) can be restored. As a result, it is possible to reduce further the possibility of reaching a situation in which it is difficult to continue with the drug solution preparation task if an operation error is made.

When the stopcock 40 is at the second rotation position, the bag-side space 32 is in communication with the inner cavity 45 of the stopcock 40 via the hydrophobic filter 50 (the second hydrophobic filter 50*b* (see FIG. 17)). Accordingly, there is the possibility of vapor from the drug solution flowing from the drug solution bag 60 into the inner cavity 45 of the stopcock 40 via the hydrophobic filter 50 (the second hydrophobic filter 50*b* (see FIG. 17)). The one-way valve 470 prevents this flow of vapor from the drug solution. Accordingly, the possibility of vapor from a dangerous drug solution leaking to the outside via the hole 413 of the air supplying member 410 is reduced, and safety is improved.

As long as the one-way valve 470 can prevent the above-described flow of vapor from a drug solution, the installation position thereof is not limited to FIG. 31. It can be provided at any position in the channel between the hydrophobic filter 50 (the second hydrophobic filter 50*b* (see FIG. 17)) and the inner cavity 415 of the air supplying member 410 that is formed when the stopcock 40 is at the second rotation position.

Embodiments 1 and 2 above are merely illustrative examples. The present invention is not limited to Embodiments 1 and 2 above, and can be modified as appropriate.

In Embodiments 1 and 2 above, the first hydrophobic filter 50*a* and the second hydrophobic filter 50*b* are provided in a single common member (the hydrophobic filter 50) (see FIG. 17). However, the first hydrophobic filter 50*a* and the second hydrophobic filter 50*b* may be divided into separate members. In this case, at least one of the first hydrophobic filter 50*a* and the second hydrophobic filter 50*b* may be arranged at a different location than in Embodiments 1 and 2 described above. For example, the first hydrophobic filter 50*a* may be provided at any location in the channel that connects the male luer 110 and the gas channel 212 (not including the male luer 110) when the stopcock 40 is at the second rotation position. Also, the second hydrophobic filter 50*b* may be provided at any location in the channel that connects the air supplying member 410 and the male luer 110 (not including the air supplying member 410 and the male luer 110) when the stopcock 40 is at the second rotation position.

The opening shape of the through-hole 51 of the hydrophobic filter 50 is smaller than the first sealing protruding portion 26*a* on the connection plate 24 (see FIGS. 13 and 14) in Embodiments 1 and 2 described above, but it may conform to the first sealing protruding portion 26*a*.

In Embodiments 1 and 2 described above, the connector 1 is divided into the first member 10 that includes the first connector 100 and the second member 20 that includes the second connector 200 and the tubular portion 30. However, the connector of the present invention can be divided into any number of members. For example, the first connector 100 and the tubular portion 30 may be configured by one member. Alternatively, the connector may be divided into three members, namely a member that includes the first connector 100, a member that includes the second connector 200, and a member that includes the tubular portion 30. Alternatively, at least one of these three members may be further divided into multiple members.

Figure 32:
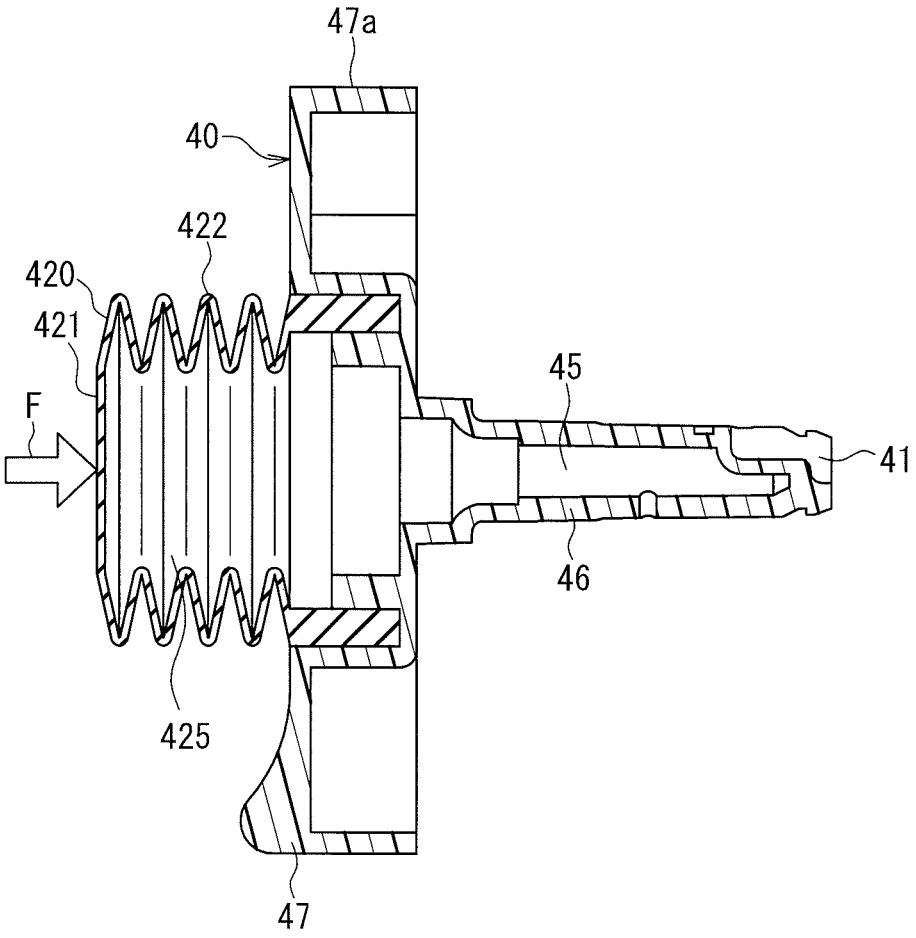
FIG. 32 is a cross-sectional view of a stopcock constituting a part of the medical connector of the present invention, which includes a different air supplying member.
Figure 33:
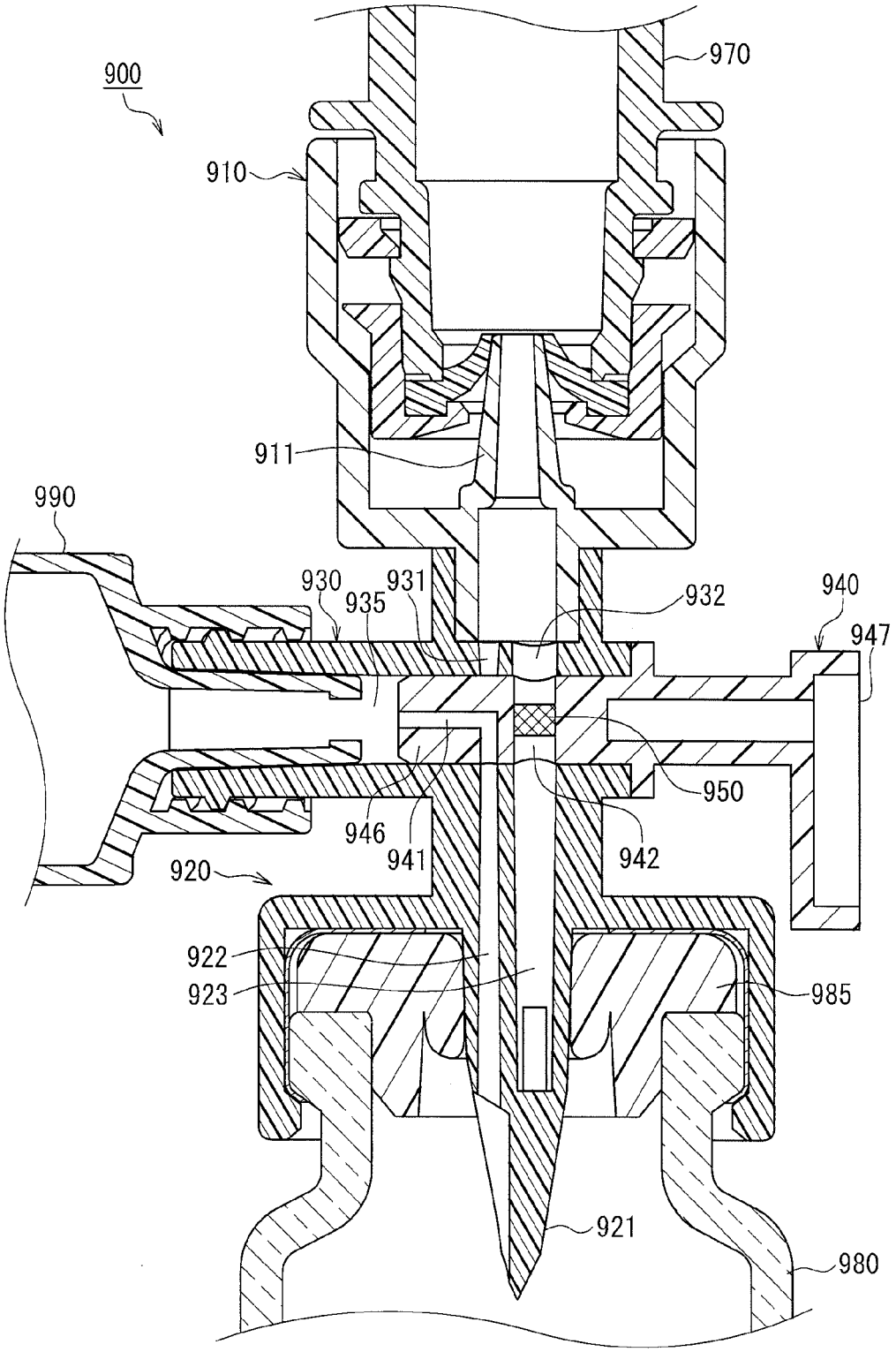
FIG. 33 is a cross-sectional view showing a conventional medical connector.
Figure 34:
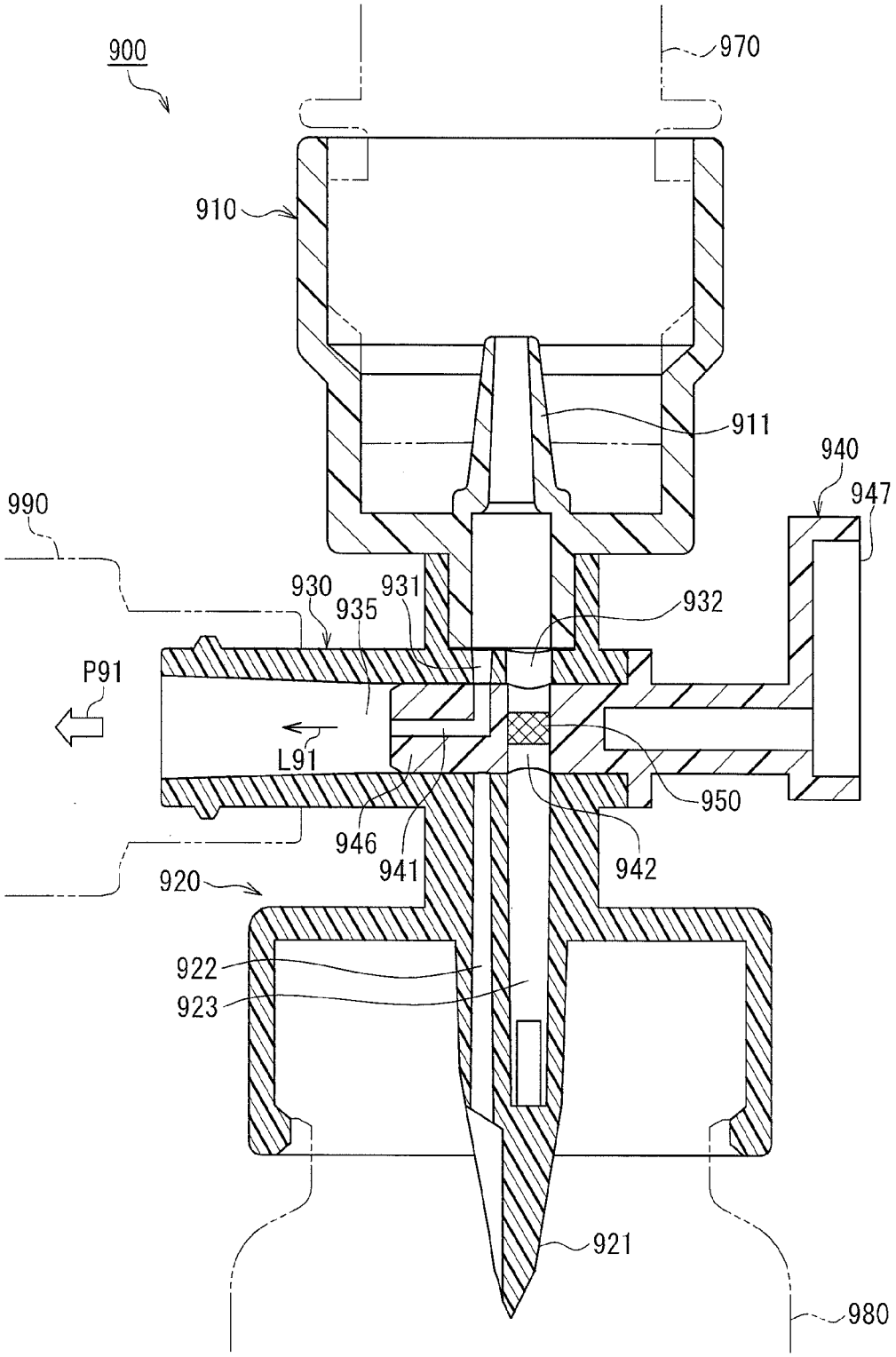
FIG. 34 is a cross-sectional view showing a process of transferring a solution in a drug solution bag to a syringe using the conventional medical connector.
Figure 35:
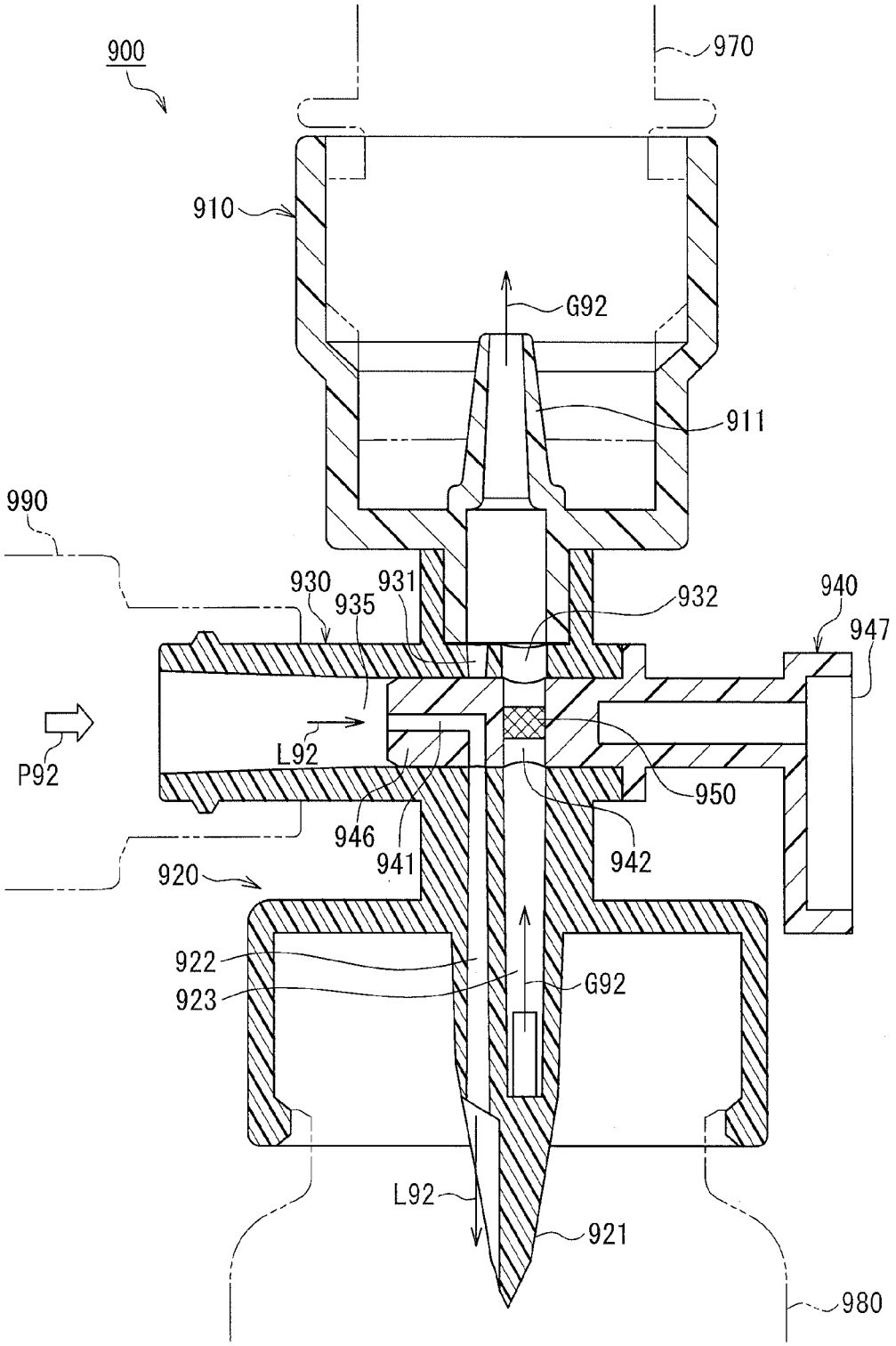
FIG. 35 is a cross-sectional view showing a process of transferring the solution in the syringe to a vial container using the conventional medical connector.
Figure 36:
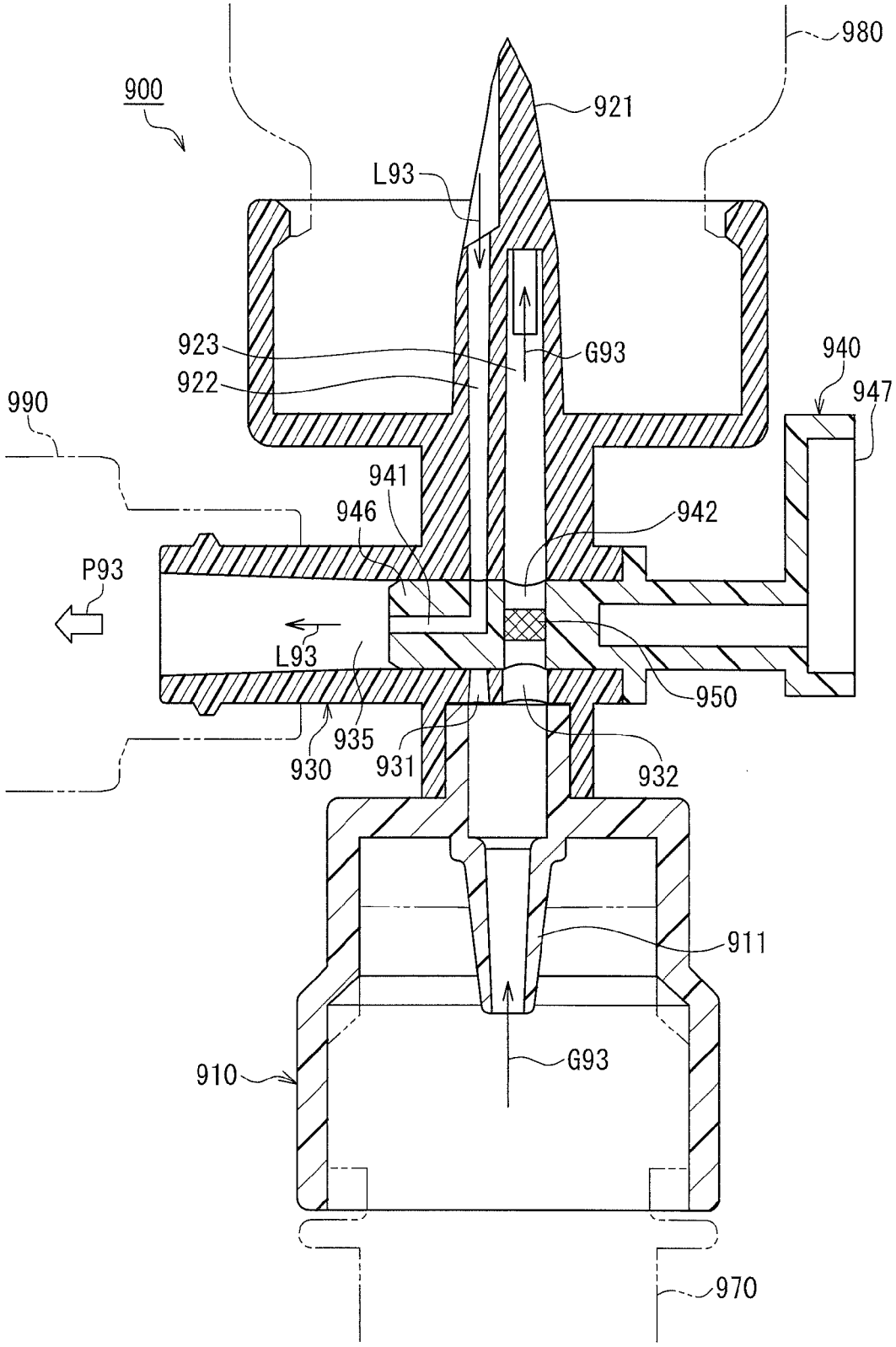
FIG. 36 is a cross-sectional view showing a process of transferring a drug solution in the vial container to the syringe using the conventional medical connector.
Figure 37:
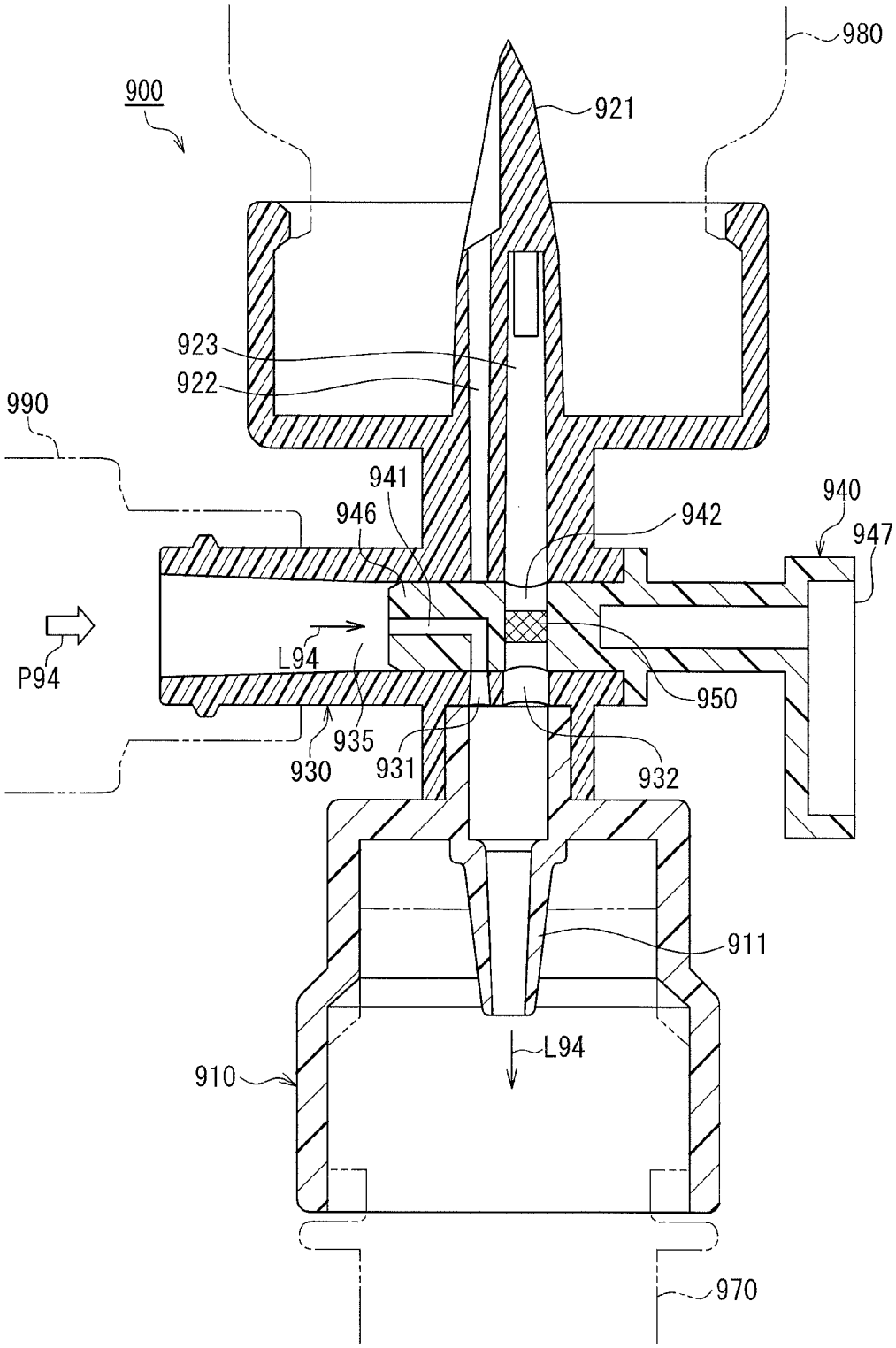
FIG. 37 is a cross-sectional view showing a process of transferring the drug solution in the syringe to the drug solution bag using the conventional medical connector.
Figure 38:
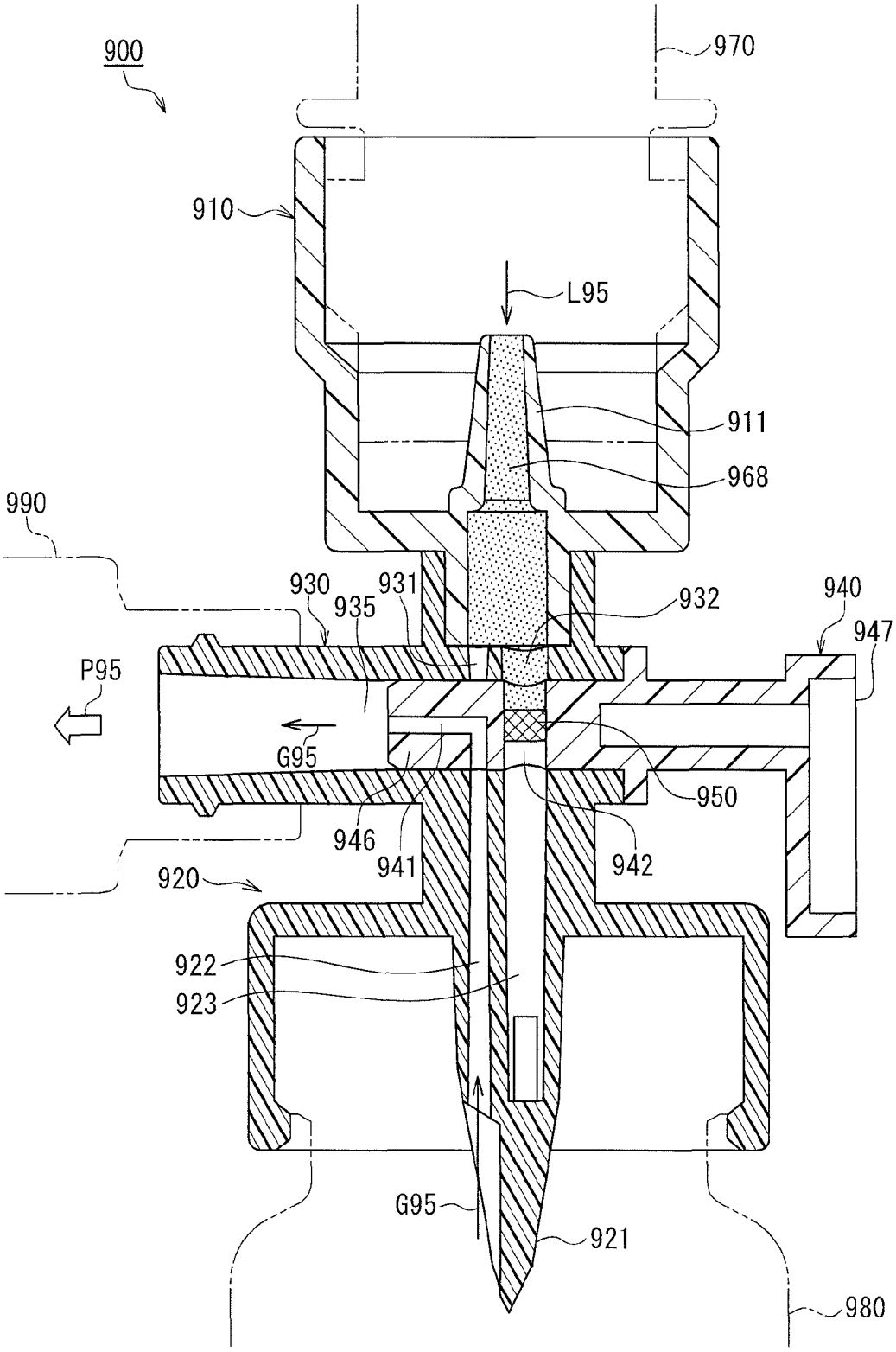
FIG. 38 is a cross-sectional view for describing an operation error made with the conventional medical connector.
Figure 39:
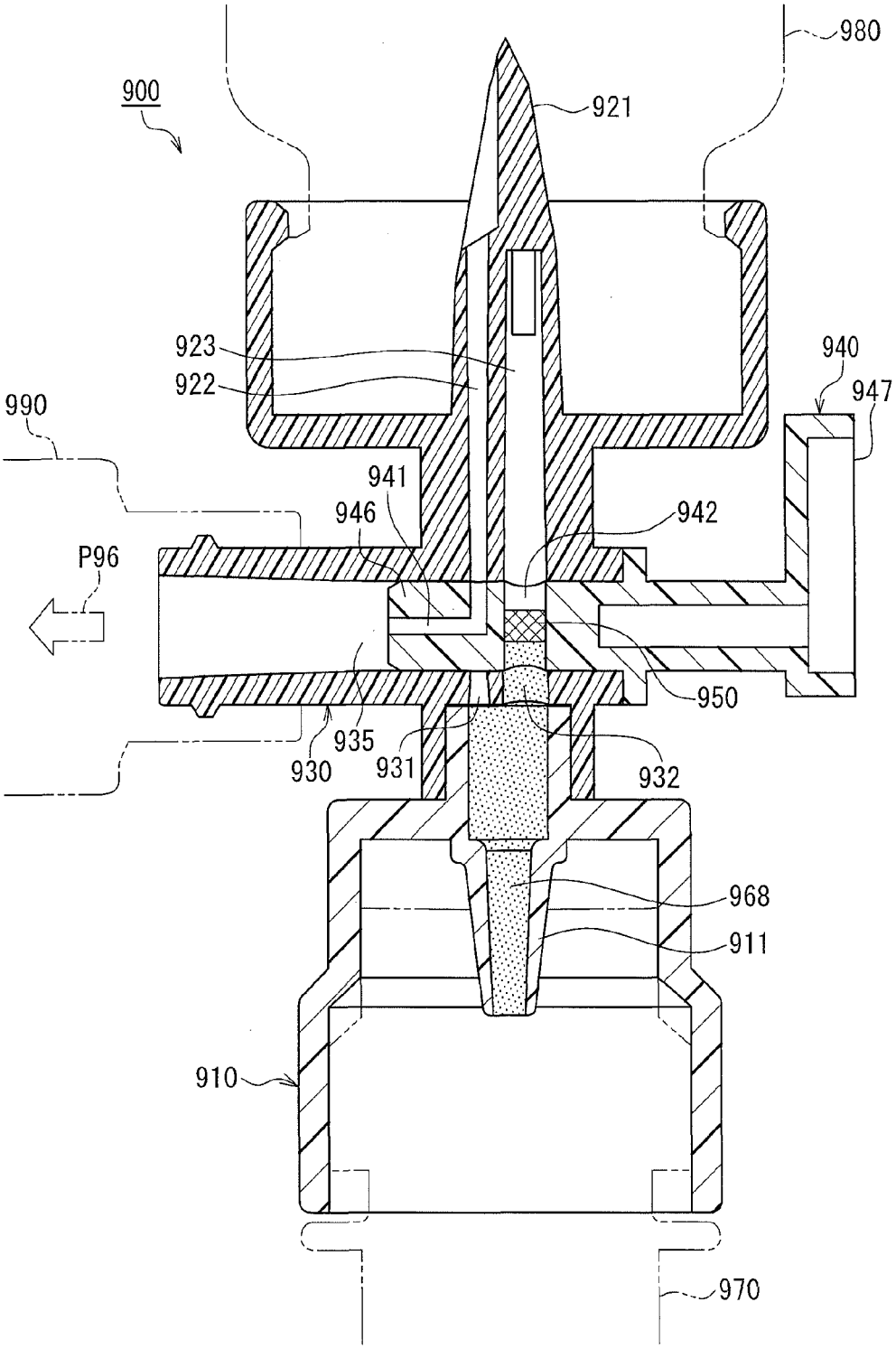
FIG. 39 is a cross-sectional view for describing the reason why drug solution preparation tasks cannot be continued after an operation error occurs in the conventional medical connector.

The configuration of the air supplying member is not limited to Embodiments 1 and 2 described above as long as it can supply a gas to the inner cavity 45 of the stopcock 40. For example, a bellows-shaped air supplying member 420 may be used as shown in FIG. 32. When pressing force F is applied to a top face 421 of the air supplying member 420, surrounding bellows 422 undergo elastic compression deformation such that the volume of an inner cavity 425 thereof contracts, and thus a gas can be supplied to the inner cavity 45 of the stopcock 40. If this air supplying member 420 is applied to Embodiment 2, a hole similar to the hole 413 can be formed in the top face 421.

Although the hole 413 is formed in the top face 411 pressed by a finger when applying force F for flattening the air supplying member in Embodiments 1 and 2 described above, the position of the hole is not limited to this, and the hole can be formed at any position where it is possible to put the inner cavity of the air supplying member in communication with the outside. In this case, a stopper or one-way valve (or check valve) for blocking the hole further may be provided in order to prevent air inside the inner cavity of the air supplying member from leaking to the outside through the hole when the air supplying member is flattened.

Instead of attaching the air supplying member directly to the stopcock 40 as in Embodiments 1 and 2 described above, the air supplying member and the inner cavity 45 of the stopcock 40 may be connected via a flexible tube, for example. In this case, the degree of freedom in the configuration of the air supplying member increases. For example, a known air pump having a sphere shape or an egg shape can be used as the air supplying member.

Although the first container is the drug solution bag 60 and the second container is the vial container 80 in Embodiments 1 and 2 described above, the first container and the second container are not limited to this. It should be noted that it is preferable that the first container is flexible such that its volume freely changes according to the inflow and outflow of the content thereof, whereas it is preferable that the second container is rigid such that its volume substantially does not change even with the inflow and outflow of the content thereof.

The first lock mechanism of the first connector 100 and the second lock mechanism of the second connector 200 can be changed to arbitrary configurations other than those shown in Embodiments 1 and 2 described above. The lock mechanism of the second connector 200 may be used as the first lock mechanism of the first connector 100, and conversely, the lock mechanism of the first connector 100 may be used as the second lock mechanism of the second connector 200. Alternatively, the lock mechanism may be omitted from the first connector 100 and/or the second connector 200.

The shape of the lock lever 130 constituting the first connector 100 can be changed as desired. For example, although the operation portion 135 is a concave curved face having an approximately cylindrical face shape in Embodiments 1 and 2 described above, the shape and location of the operation portion 135 can be set as desired as long as force F1 in the direction of separation from the male luer 110 (see FIG. 6) can be applied to the lock lever 130. For example, it may be a protrusion for catching a finger, or a hole for the insertion of a finger. The stopper 138 may be omitted. Although the fixed end of the lock lever 130 is provided on the base 19, it may be provided on the hood 120.

Although the claw 134 of the first connector 100 is engaged with the protruding portion 75 of the needleless port 70, the portion of the needleless port that the claw 134 engages with may be changed appropriately according to the configuration of the needleless port. The shape and location of the claw 134 can be changed according to the portion for engaging with the needleless port.

The shape of the hood 120 also is not limited to Embodiments 1 and 2 described above. For example, the opening 121 does not need to reach the base 19, and it may be a small opening to the extent that only the claw 134 can be inserted.

Although the lateral hole 112 of the male luer 110 extends along a straight line orthogonal to the central axis 110*a* (i.e., along the radial direction) in Embodiments 1 and 2 described above, the present invention is not limited to this, and it may extend along a straight line that intersects the central axis 110*a* at an angle other than a right angle. The number of lateral holes 112 is also not limited to the number in Embodiments 1 and 2 described above, and can be changed as desired. Also, a configuration is possible in which the lateral hole 112 is not formed, and the channel 111 is open at the tip face 110*t* of the male luer 110.

Although the first lock mechanism of the first connector 100 is constituted by the hood 120 and the one lock lever 130 in Embodiments 1 and 2 described above, it may have a configuration other than this. Also, a configuration is possible in which the first connector 100 does not include a lock mechanism for maintaining the state in which the first male member (male luer 110) is in communication with the female connector.

The shape of the ring-shaped portion 21 that constitutes the second connector 200 in a plan view does not need to be approximately elliptical or approximately oblong with the minor axis in the direction in which the pair of claws oppose each other and the major axis in the direction orthogonal to the minor axis as in Embodiments 1 and 2 described above, and may have any shape, such as a circle or a diamond. It should be noted that it is desirable that an appropriate gap is formed between the ring-shaped portion in the natural state and the female connector such that when the pair of pressing portions are pressed while the female connector (rubber stopper 85) has been inserted into the ring-shaped portion, the ring-shaped portion can undergo elastic deformation such that the gap between the pair of pressing portions decreases and the gap between the pair of claws increases.

Although the ribs 228 extend in the up-down direction in the second connector 200 of Embodiments 1 and 2 described above, the shape of the ribs is not limited to this. For example, a rib may extend in the circumferential direction on the inner circumferential face of the holding plate 226 so as to surround the second male member (bottle needle 210). In this case, the face of the rib on the side opposite to the base 29 is a contact portion for coming into contact with the female connector (rubber stopper 85). Alternatively, the ribs 228 may be omitted.

Openings may be formed in the second connector 200 by omitting the pair of holding plates 226.

The area of the pressing portions 223 may be increased so as to facilitate the application of pressing force to the pressing portions 223 of the ring-shaped portion 221, or asperity may be formed in the outer surface of the pressing portions 223 so as to prevent fingers from slipping on the pressing portions 223.

Although the second lock mechanism of the second connector 200 is constituted by the hood 220 that includes the ring-shaped portion 221 in Embodiments 1 and 2 described above, it may have a configuration other than this. Also, a configuration is possible in which the second connector 200 does not include a lock mechanism for maintaining the state in which the second male member (bottle needle 210) is in communication with the rubber stopper 85.

A cover may be attached to the first male member and/or the second male member such that the opening of the channel on tip side is not exposed when the first male member and/or the second male member is not connected to the female connector. This cover is made of a flexible material, and when the first male member and/or the second male member is connected to the female connector, the cover undergoes elastic compression deformation and the first male member and/or the second male member passes through it (see Patent Documents 1 and 2).

INDUSTRIAL APPLICABILITY

Although there are no particular limitations on the field of use of the connector of the present invention, it can be used in a wide range as a device used when preparing a drug solution by dissolving a powdered (or solid) drug. In particular, the present invention can be preferably used as a medical closed-system device for handling dangerous drugs (e.g., anticancer drugs).

DESCRIPTION OF REFERENCE NUMERALS

1 Medical connector
10 First member
20 Second member
21 First hole
22 Second hole
23 Third hole
30 Tubular portion
36 Cock holding portion
37 Syringe connection portion
40 Cock
41 First channel of stopcock
42 Second channel of stopcock
43 Third channel of stopcock
45 Inner cavity of stopcock
50 Hydrophobic filter
50*a* First hydrophobic filter
50*b* Second hydrophobic filter
51 Through-hole of hydrophobic filter
60 Drug solution bag (first container)
70 Needleless port (first female connector)
80 Vial container (second container)
85 Rubber stopper (second female connector)
90 Syringe
92 Plunger of syringe
100 First connector
110 Male luer (first male member)
112 Lateral hole of first male member
120 Hood (first lock mechanism) of first connector
130 Lock lever (first lock mechanism) of first connector
134 Claw
135 Operation portion
200 Second connector
210 Bottle needle (second male member)

211 Liquid channel
211*a* Lateral hole of second male member
212 Gas channel
220 Hood (second lock mechanism) of second connector
221 Ring-shaped portion
222 Claw
223 Pressing portion
410, 420 Air supplying member
413 Hole of air supplying member
415, 425 Inner cavity of air supplying member
470 One-way valve

The invention claimed is:

1. A medical connector comprising:

a first connector including a bar-shaped first male member capable of being in communication with a first container;

a second connector including a bar-shaped second male member capable of being in communication with a second container;

a tubular portion including a syringe connection portion that is configured to be in communication with a syringe; and a stopcock that is inserted into the tubular portion and is capable of rotation relative to the tubular portion, wherein a first hole, a second hole, and a third hole that put the first male member and the tubular portion in communication are formed in the tubular portion, a liquid channel and a gas channel formed in the second male member are in communication with the tubular portion, a first channel, a second channel, and a third channel are formed in the stopcock, by rotating the stopcock, the position of the stopcock can be switched to a first rotation position at which the first channel puts the first hole and the syringe connection portion in communication, and a second rotation position at which the first channel puts the liquid channel and the syringe connection portion in communication, when the stopcock is at the second rotation position, the second hole and the gas channel of the second male member are in communication via the second channel, a first hydrophobic filter that allows passage of a gas and does not allow passage of a liquid is provided in a channel that connects the first male member and the gas channel and is formed when the stopcock is at the second rotation position, when the stopcock is at the second rotation position, the first male member and an inner cavity of the stopcock are in communication via the third hole and the third channel, an air supplying member capable of supplying a gas to the inner cavity of the stopcock is connected to the stopcock, and a second hydrophobic filter that allows passage of a gas and does not allow passage of a liquid is provided in a channel that connects the air supplying member and the first male member and is formed when the stopcock is at the second rotation position.

2. The medical connector according to claim 1, wherein if a gas is supplied from the air supplying member to the inner cavity of the stopcock when the stopcock is at the second rotation position, the gas is introduced to a channel between the first hydrophobic filter and the first male member.

3. The medical connector according to claim 1, wherein if a gas is supplied from the air supplying member to the inner cavity of the stopcock when the stopcock is at the second rotation position, the gas passes through the second hydrophobic filter, then flows over the first hydrophobic filter, and thereafter flows into the first male member.

4. The medical connector according to claim 1, wherein the first hydrophobic filter and the second hydrophobic filter are provided in a single common member.

5. The medical connector according to claim 4, wherein the first connector is provided on a first member, the first hole, the second hole, and the third hole are formed in a second member, and the single member provided with the first hydrophobic filter and the second hydrophobic filter is arranged between the first member and the second member.

6. The medical connector according to claim 5, wherein a through-hole is formed in the single member provided with the first hydrophobic filter and the second hydrophobic filter, such that a liquid flows between the first male member and the first hole.

7. The medical connector according to claim 1, wherein a hole that puts the inner cavity of the air supplying member and the outside in communication is formed in the air supplying member.

8. The medical connector according to claim 7, wherein a one-way valve is provided in a channel that connects the second hydrophobic filter and the air supplying member and is formed when the stopcock is at the second rotation position, the one-way valve permitting a gas to flow from the air supplying member toward the second hydrophobic filter and prohibiting the gas from flowing from the second hydrophobic filter toward the air supplying member.

9. The medical connector according to claim 1, further comprising:

a syringe that is in communication with the syringe connection portion.

10. The medical connector according to claim 9, further comprising:

a flexible tube that puts the syringe connection portion and the syringe in communication.

11. The medical connector according to claim 1, wherein the first connector includes a first lock mechanism for maintaining a state in which the first male member is in communication with the first container, the first lock mechanism includes a hood that is arranged so as to surround the first male member and receives insertion of a first female connector of the first container, and a single lock lever having a cantilever support structure capable of elastic deformation, the lock lever includes a claw for engaging with the first female connector, and an operation portion for causing the lock lever to undergo elastic deformation in a direction of separation from the first male member, and the claw and the operation portion are provided on a free end side of the lock lever.

12. The medical connector according to claim 1, wherein the second connector includes a second lock mechanism for maintaining a state in which the second male member is in communication with the second container, the second lock mechanism includes a ring-shaped portion that is arranged so as to surround the second male member and receives insertion of a second female connector of the second container, a pair of claws that oppose each other and are provided on the ring-shaped portion so as to protrude toward the second male member, and a pair of pressing portions that are provided on the ring-shaped portion and oppose each other in a direction orthogonal to the direction in which the pair of claws oppose each other, and when pressing force in a direction in which the pair of pressing portions approach each other is applied to the pair of pressing portions, the ring-shaped portion undergoes elastic deformation such that the pair of claws separate from each other.

13. The medical connector according to claim 1, wherein a lateral hole in communication with a channel in which a liquid flows is formed in an outer circumferential face of at least one of the first male member and the second male member.

* * * * *